US006554394B1

(12) United States Patent
Yamaguchi et al.

(10) Patent No.: US 6,554,394 B1
(45) Date of Patent: Apr. 29, 2003

(54) CARRIAGE, LIQUID EJECTION HEAD, PRINTER, HEAD INSERTING METHOD AND HEAD POSITIONING METHOD

(75) Inventors: Yukuo Yamaguchi, Tokyo (JP); Shinya Asano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/655,769

(22) Filed: Sep. 5, 2000

(30) Foreign Application Priority Data

Sep. 3, 1999 (JP) ..... 11-250924
Sep. 3, 1999 (JP) ..... 11-250925

(51) Int. Cl.[7] ..... B41J 2/175
(52) U.S. Cl. ..... 347/37
(58) Field of Search ..... 347/37, 49, 85, 347/86, 50; 400/208

(56) References Cited

U.S. PATENT DOCUMENTS

| | | | | |
|---|---|---|---|---|
| 4,408,914 A | * | 10/1983 | Ciesiel et al. | 400/208 |
| 4,594,598 A | | 6/1986 | Iwagami | 347/37 |
| 4,714,932 A | | 12/1987 | Reynaud | 347/49 |
| 4,731,639 A | | 3/1988 | Gutmann et al. | 355/64 |
| 4,990,938 A | | 2/1991 | Brandon et al. | 347/37 |
| 5,187,497 A | | 2/1993 | Hirano et al. | 347/8 |
| 5,212,502 A | | 5/1993 | Bowling | 347/49 |
| 5,317,339 A | | 5/1994 | Braun et al. | 347/87 |
| 5,448,274 A | | 9/1995 | Hirabayashi et al. | 347/86 |
| 5,696,541 A | | 12/1997 | Akahane et al. | 347/8 |
| 5,861,901 A | * | 1/1999 | Kashimura et al. | 347/50 |
| 5,917,518 A | | 6/1999 | Ohashi et al. | 347/37 |
| 5,936,740 A | | 8/1999 | Fukazawa et al. | 358/296 |
| 6,270,184 B1 | * | 8/2001 | Igarashi et al. | 347/37 |

FOREIGN PATENT DOCUMENTS

| | | |
|---|---|---|
| EP | 0 145 025 | 6/1985 |
| EP | 0 765 751 | 4/1997 |
| EP | 0 827 839 A1 | 3/1998 |
| JP | 9-289971 | 11/1997 |
| JP | 11-258939 | 9/1999 |

OTHER PUBLICATIONS

Suzuki Junichi, "Ink Jet Type Printer", European Patent Office, Patent Abstracts of Japan, 08132602, May 28, 1996, Abstract.

* cited by examiner

*Primary Examiner*—Anh T. N. Vo
(74) *Attorney, Agent, or Firm*—Fitzpatrick, Cella, Harper & Scinto

(57) ABSTRACT

A carriage for carrying a liquid ejecting head unit for effecting printing by ejecting droplets through a plurality of ejection outlets includes, a supporting mechanism for supporting the liquid ejecting head unit for rotation about a predetermined portion; and an angle adjusting mechanism for adjusting an angular position of the liquid ejecting head unit supported by the supporting mechanism.

13 Claims, 60 Drawing Sheets

CARRIAGE, LIQUID EJECTION HEAD, PRINTER, HEAD INSERTING METHOD AND HEAD POSITIONING METHOD

FIELD OF THE INVENTION AND RELATED ART

The present invention relates to a liquid ejecting head unit provided with a liquid ejecting head capable of effecting printing on a print medium by ejecting droplets through ejection outlets, a carriage for carrying the liquid ejecting head unit, and a printing apparatus equipped with them. The present invention also relates to a positioning method of the liquid ejecting head unit, and an inserting method therefor.

In a conventional printing apparatus, the use is made with a liquid ejecting head unit which includes a liquid ejecting head for effecting print on a print medium by ejecting the ink through the ejection outlets, and an ink container accommodating the ink to be supplied to the liquid ejection printing head, which may be integral or separate. The liquid ejection printing apparatus is provided with a carriage reciprocable in a substantially perpendicular to the feeding direction of the print medium, and the liquid ejecting head unit is barred on such a carriage.

As the liquid ejecting head, known ones include a liquid ejecting head which ejects fine droplets using thermal energy generated by electrothermal transducers or the like, and a liquid ejecting head which ejects the droplets deflected by a pair of electrodes. Among them, an ink jet printing head which ejects the ink droplets using the thermal energy has advantages in that liquid ejection portions (ejection outlets) for forming the printing droplet can be arranged at high density, and therefore, high resolution print is possible and in that total size of the printer can be reduced, and such an ink jet printing head has been put into practice.

The ink jet printing head is provided with a plurality of ejection outlet, a plurality of liquid flow paths in fluid communication with the respective ejection outlet, and a plurality of energy conversion elements such as electrothermal transducer elements disposed in the respective liquid flow paths, wherein ejection energy (the thermal energy effective to create film boiling in the liquid, for example) is applied to the liquid by the energy conversion element, by which the liquid droplet is ejected to effect printing. Referring to FIG. 73, the description will be made as to a general structure of the ink jet printing head.

As shown in FIG. 73, the ink jet printing head comprises an element substrate 1001 provided with a heat generating element 1001*a* (energy producing member) for ejecting the ink, a top plate 1002 connected to the element substrate 1001, and an orifice plate 1010 connected to the element substrate 1001 handed to the front end surface of the top plate 1002.

The element substrate 1001 is fixed to the supporting member 1004 of aluminum or the like by die bonding. To the supporting member 1004, an element substrate 1001 and a printed wiring substrate 1003 for effecting electric contact with the main assembly of the printing apparatus are bonded, and the printed wiring substrate 1003 and the element substrate 1001 are electrically connected by wire bonding. Although not shown in the Figure, the printed wiring substrate 1003 is equipped with a contact pad for contact with the main assembly of the printing apparatus. On the element substrate 1001, there are provided a shift register and a wiring pattern in addition to the heat generating element 1001*a* s. The shift register and the wiring pattern may be built in the element substrate 1001 together with the heat generating elements 1001*a* through silicon formation technique.

The top plate 1002 is made of a resin material integrally having recesses which constitute the ink flow paths 1002*a* and a recess which constitutes the ink liquid chamber 1002*b* through an injection molding or the like, or made of silicon material through an anisotropic etching process or the like. The top plate 1002 is fixed to the element substrate 1001 by urging means (unshown) such as a spring or by connecting means (unshown) such as adhesive material or the like, thereby providing a plurality of ink flow paths 1002*a* corresponding to the respective heat generating elements 1001*a* and providing the ink liquid chamber 1002*b* for supplying the liquid to the liquid flow path 7*s*.

The orifice plate 1010 has group of fine ink ejection outlets 1010*a* for ejecting the ink, and the outlets are formed through a laser machining, electro-forming, press work injection molding or another ultra-fine processing. The group of ejection outlets 1010*a* is one of important factors influential to the ejection performance of the liquid ejection printing head. The orifice plate 1010 may be formed integrally with the top plate 1002 in one case, and is formed by connecting a separate top plate 1002 thereto. In the latter case, the ejection outlets 1010*a* of the orifice plate 1010 are aligned with and connected to the ink flow paths 1002*a* provided by the press-contact between the element substrate 1001 and the top plate 1002, and this is advantageous in that material of the orifice plate 1010 which requires durability can be relatively freely selected. On the other hand, in the former case, the ejection outlets 1010*a* and the ink flow paths 1002*a* can be formed with the fluid communication accomplished therebetween, and therefore, the ink flow paths 1002*a* can be provided by simple mechanical press-contact between the top plate 1002 and the element substrate 1001 so that productivity is good.

The ink jet printing apparatus using the ink jet printing head described above is usable with a word processor, a color printer connected with a personal computer, a facsimile machine, a copying machine or the like.

FIG. 74 is a perspective view of a conventional liquid ejecting head unit (ink jet print cartridge). As shown in the Figure, the main assembly 1130 of the ink jet print cartridge comprises an ink jet printing head H at a predetermined position, and a first common liquid chamber 1120 is disposed adjacent the ink jet printing head H. The first common liquid chamber 1120 and the ink jet printing head H are supported by supporting member 1121, 1122 s. In the main assembly 1130 of the ink jet print cartridge covered with a cap member 1131, there is provided a container (unshown) containing printing liquid such as ink, and the printing liquid is properly supplied from the container to the first common liquid chamber 1120.

The ink jet printing head H may be an integral type in which one printing head is provided with ink ejection portions for respective colors, for example, black, yellow, magenta and cyan. With such a type, the number of ejection outlets per color is small, but the head is less expensive. However, the integral type head is not advantageous for the high speed printing.

In another type, which may be costly, a plurality of ink jet print cartridges are juxtaposed, and the printing heads for the respective colors are independently provided, in which the number of ejection outlets can be made larger. In another type, the independent plurality of ink ejection portions are mounted on a single base. With this type, the printing heads are disposed on the base with high precision on the basis of predicted positional deviations among ink droplets injected from the ejection outlets in the orifice plate for the respective colors. Additionally, since the printing heads are integrally mounted on the base, the misregistration of the colors is small, and the exchange of the head is easy.

FIG. 75 is a perspective view of an ink jet recording head assembly disclosed in Japanese Laid-open Patent Application Hei 9-289971.

The conventional ink jet recording head assembly 1306 shown in the Figure comprises a base 1301 having a plurality of ink ejection portion with ink ejection outlet, and a printed board 1302 having a ROM1304 storing positional data set for the respective ink ejection portions on the basis of actually measured positional deviations among the ink droplets ejected from the ink ejection outlets of the ink ejection portions, and storing property data peculiar to the ink ejection portion and data for correcting the property.

The ink jet recording head assembly is provided with an ink supply port 1303 receiving a supply of the ink from an unshown ink container or the like. The printed board 1302 is equipped with a contacting electrode 1305 for electrically connecting the ink jet recording head assembly to a controller of the main assembly of the recording device.

When the printing operation is carried out, the controller in the main assembly of the recording device effects correction process for the generation timing and the pulse of the driving signal for driving the producing member for generating the ejection energy to eject the ink on the basis of the data stored in the ROM1304. By doing so, occurrences of print defect such as misregistration of print can be prevented.

Recently, the demand is directed to high speed and high image quality full-color print, and therefore, the improvement in the printing speed, the resolution and a tone gradient is further desired. In other to accomplish a print having a quality equivalent to a photograph, a proposal has been made as to a use of six colors or seven colors ink container containing the above described four color inks (black, yellow, magenta and cyan inks) plus inks of the same colors but having different densities.

In order to accomplish the high speed, high image quality ink jet printing apparatus, it is desirable to use a type having a plurality of ink jet print cartridges, or a set type or a combination thereof.

In another accomplish a high image quality color image without color non-uniformity or misregistration, it is desired that position of the ink droplet deposited on the print medium from the printing head (deposition position) is correct. Particularly, a relative inclination of the printing head in the direction of the ejection outlet arrangement is most influential to the print quality, and it is desirable that error in the relative inclination of the printing head in the direction of the ejection outlet arrangement is minimum. As a measure for reducing the relative inclination in this direction, it is known that abutting portion for abutment to a predetermined position of the carriage is provided in the ink jet print cartridge so that ejection outlets of the printing head are correctly positioned.

FIG. 76 shows a conventional example in which a plurality of liquid ejecting units (ink jet print cartridges) are juxtaposed and fixed on the carriage.

In this Figure, designated by 418 shows one ink jet print cartridge. In a frame 482 which functions as a casing of the ink jet print cartridge 481, there is provided an ink storing chamber for containing the ink. Designated by a reference numeral 483 is a face in which ejection outlets (unshown) are provided, and 484 is a contact pad to be electrically connected with a contact provided in the carriage on which the cartridge is mounted, and 485 is an ink supplying portion for supplying the ink into an ink storing chamber in the frame 482.

The frame 482 is provided with projections 482*a* and 482*b*, which are abutted to predetermined positions of the carriage so that ink jet print cartridge 481 is correctly positioned. The carriage is provided with pressing means (unshown) at a central portion of the projections 482*a* and 482*b*, which is defective to abut the projections 482*a*, 482*b* to the carriage. The pressing means for fixing the ink jet print cartridge 481 includes a means for urging the cartridge downwardly and a means for urging the contact pad and a carriage contact (unshown) to each other.

As described hereinbefore, the recent demand is directed to high speed and high image quality full-color print, and therefore, the improvement in the printing speed, the resolution and a tone gradient is further desired. Therefore, the position of deposition of the ink droplet on the print medium is decided to be more correct.

Even if the conventional positioning method in which the liquid electing head unit is adopted to the predetermined position of the carriage, is not enough to properly adjust the relative inclination in the direction of the ejection outlet arrangement in the printing head with a sufficient precision.

It is considered that liquid electing head unit is supported for rotation about a predetermined fulcrum, and a cam mechanism is provided at a position remote from the fulcrum to adjust the inclination.

As described in the foregoing, in the liquid ejecting head unit, the relative inclination into direction of the ejection outlet arrangement of the liquid ejecting head is significantly influence to the print quality, it is desirable that relative inclination in the direction of the ejection outlet arrangement is minimized. Heretofore, in order to solve this problem, an abutting portion of the liquid ejecting head unit at the predetermined position is abutted to a predetermined position of the carriage. However, with such a structure, a high precision connecting portion is required between the liquid ejecting head unit and the carriage, and therefore, the cost is high, and the yield is low.

Additionally, in the conventional example, the casing (frame) of the liquid ejecting head unit is easily be formed (support at each of the opposite ends), and therefore, the positional accuracy tends to be low, and the mounting-and-demounting of the liquid ejecting head unit is not uniform.

Furthermore, in the conventional example, the liquid ejecting head unit is relatively easily inclined in any directions, and therefore, the relative inclination of the liquid ejecting head unit in the ejection outlet arranging direction may become large after it is mounted on the carriage. However, in the conventional example, once the relative inclination in the ejection outlet arranging direction occurs, the inclination cannot be corrected, and therefore, the printing operation may be carried out with the large relative inclination in the ejection outlet arranging direction.

SUMMARY OF THE INVENTION

Accordingly, it is a principal object of the present invention to provide a printing apparatus and a liquid ejecting head unit in which the user can easily mount a liquid ejecting head unit on a carriage provided with an adjusting mechanism portion with which an angular position is adjustable.

It is another object of the present invention to provide a carriage and a liquid ejecting head unit wherein the relative inclination of the liquid ejecting head in the direction of the ejection outlet arrangement, so that print quality is stabilized.

It is a further object of the present invention to provide a printing apparatus provided with such a carriage and such a liquid ejecting head unit.

It is a further object of the present invention to provide a liquid ejecting head unit positioning method usable with such a printing apparatus.

According to an aspect of the present invention, there is provided a printing apparatus comprising: a liquid ejecting head unit for effect printing on a print medium by ejecting droplets from ejection outlets; a carriage for detachably mounting the liquid ejecting head unit, the carriage being provided with an angular position adjusting mechanism portion for rotatably positioning the liquid ejecting head unit; a liquid ejecting head unit including a pin functioning as a fulcrum for the rotation and a projection for guiding the carriage to a predetermined position; wherein the carriage is provided with a hole for supporting the liquid ejecting head unit by insertion of the pin thereinto, and a guide portion on which the projection is slidable.

According to another aspect of the present invention, there is provided a printing apparatus comprising; a liquid ejecting head unit for effect printing on a print medium by ejecting droplets from ejection outlets; a carriage for detachably mounting the liquid ejecting head unit, the carriage being provided with an angular position adjusting mechanism portion for rotatably positioning the liquid ejecting head unit; a liquid ejecting head unit including a hole functioning as a fulcrum for the rotation and a projection for guiding the carriage to a predetermined position; wherein the carriage is provided with a pin for supporting the liquid ejecting head unit by insertion thereof into the hole, and a guide portion on which the projection is slidable.

According to a further aspect of the present invention, there is provided a printing apparatus comprising: a liquid ejecting head unit for effect printing on a print medium by ejecting droplets from ejection outlets; a carriage for detachably mounting the liquid ejecting head unit, the carriage being provided with an angular position adjusting mechanism portion for rotatably positioning the liquid ejecting head unit; wherein the liquid ejecting head unit is provided with a projection for guiding the liquid ejecting head unit to a predetermined portion of the angular position adjusting mechanism portion; wherein the carriage is provided with a guide portion on which the projection is slidable.

According to a further aspect of the present invention, there is provided the liquid ejecting head unit is limited by the projection so as not to be disengaged from a predetermined position of the angular position adjusting mechanism portion when the liquid ejecting head unit is removed from the carriage.

According to a further aspect of the present invention, there is provided a method inserting a liquid ejecting head, comprising: a step of providing a liquid ejecting head unit for effecting printing on a print medium by ejecting droplets from ejection outlets with a pin functioning as a fulcrum for rotation of the liquid ejecting head unit and with a projection for guiding the pin to a predetermined position; a step of providing a carriage which rotatably mounts the liquid ejecting head unit and which is provided with an angular position adjusting mechanism portion for rotatably positions the liquid ejecting head unit, with a hole for supporting the liquid ejecting head unit by supporting the pin and a guide portion for guiding the projection to a predetermined position; a step of inserting the liquid ejecting head unit to a predetermined position in the carriage while abutting the projection to and sliding it on the guide portion so as the insert the pin into the hole.

According to a further aspect of the present invention, there is provided a method inserting a liquid ejecting head, comprising; a step of providing a liquid ejecting head unit for effecting printing on a print medium by ejecting droplets from ejection outlets with a hole functioning as a fulcrum for rotation of the liquid ejecting head unit and with a projection for guiding the pin to a predetermined position; a step of providing a carriage which rotatably mounts the liquid ejecting head unit and which is provided with an angular position adjusting mechanism portion for rotatably positions the liquid ejecting head unit, with pin for supporting the liquid ejecting head unit by being inserted into the hole and a guide portion for guiding the projection to a predetermined position; a step of inserting the liquid ejecting head unit to a predetermined position in the carriage while abutting the projection to and sliding it on the guide portion so as the insert the pin into the hole.

According to a further aspect of the present invention, there is provided a method of inserting a liquid ejecting head, comprising: a step of providing a liquid ejecting head unit for effecting printing on a print medium by ejecting droplets from ejection outlets with a projection for guiding the liquid ejecting head unit to a predetermined position; a step of providing a carriage which rotatably mounts the liquid ejecting head unit and which is provided with an angular position adjusting mechanism portion for rotatably positions the liquid ejecting head unit, with a guide portion for guiding the projection to a predetermined position; a step of inserting the liquid ejecting head unit to a predetermined position of the angular position adjusting mechanism portion while abutting the projection to and sliding it on the guide portion so as the insert the pin into the hole.

With the above described printing apparatus or the liquid ejecting head unit insertion method, the projection is provided on the side surface of the liquid ejecting head unit come and the liquid ejecting head unit is inserted to the carriage while the projection slides on the guide portion of the carriage, so that liquid ejecting head unit is correctly led to the predetermined the position of the angular position adjusting mechanism portion provided in the carriage. Additionally, a pin functioning as a pivot of the rotational of the liquid ejecting head unit is correctly led to a hole for the pin.

According to an aspect of the present invention, there is provided a carriage for carrying a liquid ejecting head unit for effecting printing by ejecting droplets through a plurality of ejection outlets, comprising: means for supporting the liquid ejecting head unit for rotation about a predetermined portion; and means for adjusting an angular position of the liquid ejecting head unit supported by the supporting means.

According to another aspect of the present invention, there is provided a casing of the liquid ejecting head unit has a guide pin having a circular column configuration at a predetermined position of a bottom surface thereof, a first spherical projection on a side surface adjacent the guide pin, and a second projection on a side surface adjacent the side surface having the first projection, and wherein the carriage includes a first U-shape or V-shape receiving portion having a cylindrical inner surface for receiving an outer surface of the guide pin, a second U-shape or V-shaped receiving portion having a cylindrical inner surface for receiving the first projection, and a third receiving portion for receiving the second projection.

According to a further aspect of the present invention, there is provided a liquid ejecting head unit detachably mountable on a carriage, comprising: a liquid ejecting head for effecting printing on a print medium by ejecting droplet d from a plurality of ejection outlets; a casing for supporting the liquid ejecting head; wherein the casing including; a guide pin having a circular column configuration provided at a predetermined position of a bottom surface thereof; a spherical first projection provided on a side surface adjacent a side having the guide pin; and a second projection provided on a side surface adjacent the side surface having the first projection; and wherein the first and second projection and side guide pin are engageable with corresponding portions of the carriage.

According to a further aspect of the present invention, there is provided the guide pin and first projection constitutes a fulcrum for rotating the liquid ejecting head unit by engagement with corresponding portions of the carriage.

According to a further aspect of the present invention, there is provided a printing apparatus comprising: a liquid ejecting head unit for effecting printing by ejecting droplets from a plurality of ejection outlets; a carriage for detachably carrying the liquid ejecting head unit; wherein the liquid ejecting head unit is supported on the carriage for rotation about a predetermined portion of the liquid ejecting head unit, and an angular position of the liquid ejecting head unit supported thereon is adjustable.

According to a further aspect of the present invention, there is provided a casing of the liquid ejecting head unit has a guide pin having a circular column configuration at a predetermined position of a bottom surface thereof, a first spherical projection on a side surface adjacent the guide pin, and a second projection on a side surface adjacent the side surface having the first projection, and wherein the carriage includes a first U-shape or V-shape receiving portion having a cylindrical inner surface for receiving an outer surface of the guide pin, a second U-shape or V-shaped receiving portion having a cylindrical inner surface for receiving the first projection, and a third receiving portion for receiving the second projection.

According to a further aspect of the present invention, there is provided a positioning method for a liquid ejecting head unit in a printing apparatus, comprising: a step of contacting the first and second projections of the liquid ejecting head unit to the second and third receiving portions of the carriage while engaging the guide pin of the liquid ejecting head unit into the first receiving portion of the carriage; a step of engaging the guide pin and the first projection of the liquid ejecting head unit with the first and second receiving portions of the carriage; and a step of angle adjustment for adjusting an angular position of the liquid ejecting head unit.

According to the intention, the liquid ejecting head unit mounted on the carriage is rotated about the fulcrum at the predetermined position. Therefore, the relative inclination of the liquid ejecting head in the direction of the ejection outlet arrangement can be minimized by adjusting the angular position of the liquid ejecting head unit.

In addition, the control of the angular position of the liquid ejecting head unit can be carried out stepwisely at regular angles. In such a case, by counting to the number of the steps, the amount of the control can be known, and therefore, the angular position of the liquid ejecting head unit can be easily known. By selecting a fine angle for the step of the adjusted angle, the angle adjustment can be carried out with high precision.

Furthermore, the guide pin of the liquid ejecting head unit and first and second projections are engaged with first and third receiving portions of the carriage. By doing so, the liquid ejecting head unit is correctly mounted at the predetermined position of the carriage.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 8 is a front view illustrating connection between the carriage frame and the carriage gap plate or the like.

FIG. 9 is an enlarged sectional view illustrating connection between the carriage frame and a carriage gap plate or the like.

FIG. 15 is a front view illustrating connection between the carriage and the carriage connector or the like.

DESCRIPTION OF THE PREFERRED EMBODIMENTS

Figure 1:
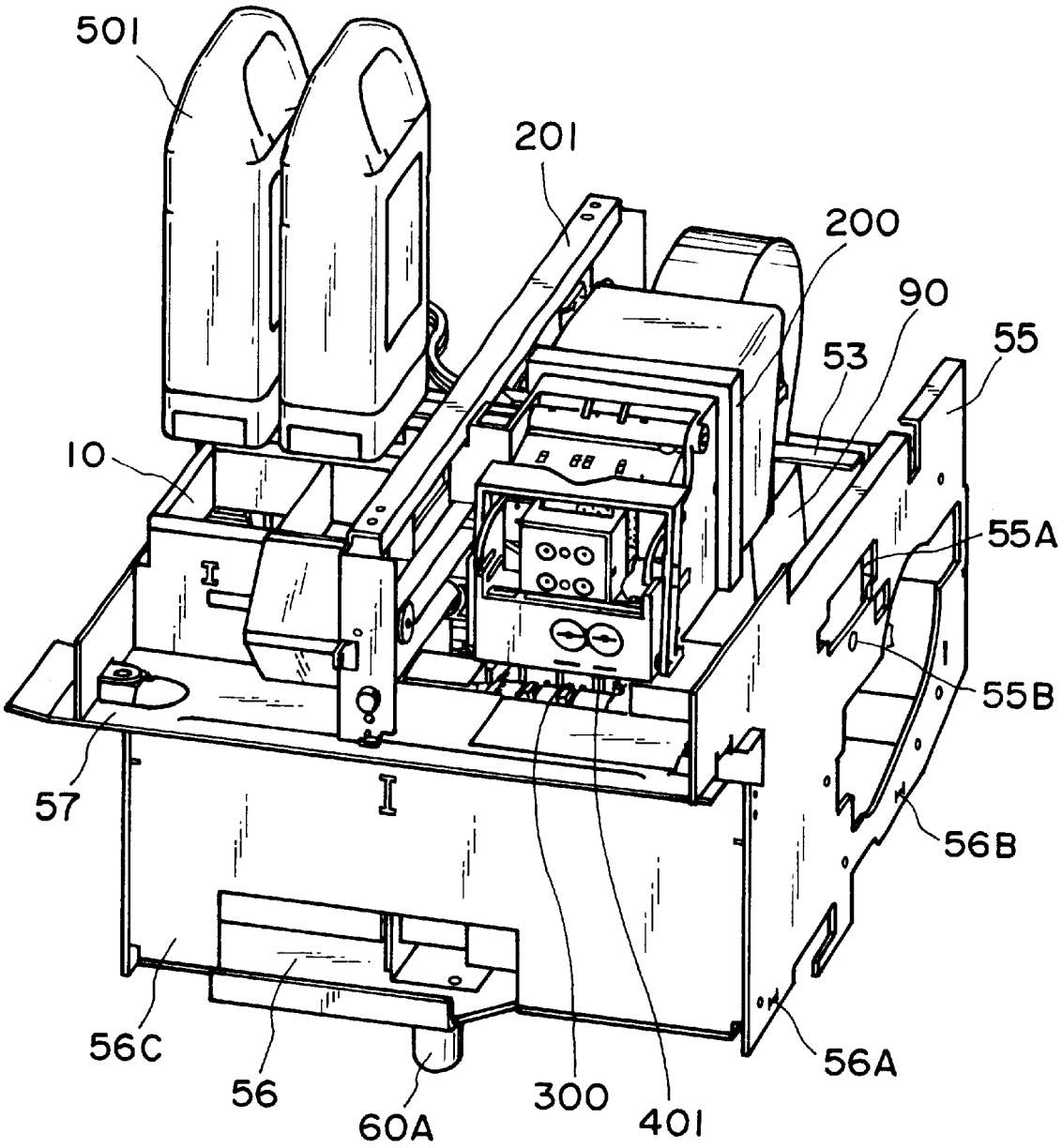
FIG. 1 is a perspective view illustrating a major part of a printing apparatus according to an embodiment of the present invention.

Hereinafter, the embodiments of the present invention will be described with reference to the drawings.

[General Structure]

First, a printing apparatus with a structure in accordance with the present invention will be described. This printing apparatus has a plurality of fixed printing positions, so that it can accommodate a plurality of printing media, for example, an envelope and a roll of continuous printing paper which can be cut with optional timing. It can continuously print a given pattern, and is removably mounted on the main assembly of a printing machine.

This printing apparatus includes the following units: a liquid ejection head unit 401 which prints images by ejecting ink; a carriage unit for moving the liquid ejection head unit 401 to the printing positions and a standby position; an ink supply system unit 10 for supplying the liquid ejection head unit 401 with ink; a main container 501 removably attachable to the ink supply system unit 10; a recovery system unit 300 for recovering the performance of the liquid ejection head unit 401 when the unit 401 suffers from problems such as poor ejection; a frame unit 70 in which the above described units are contained; a control board 80 which electrically controls the printing operation; and an electrical power unit 90.

Next, the structure of this printing apparatus will be described in detail, referring to each of the above described units.

[Frame Unit]

First, referring to FIGS. 1 and 2, the frame unit 70 will be described.

A bottom plate 56 is an approximately L-shaped metallic plate. It is provided with several parallel positioning projections (unillustrated), which are located on the left and right sides to maintain equal distance. It is also provided with positioning projections 56A and 56B, which project one for one from the edges of the bottom plate 56. It is also provided with a plurality of threaded portions. The left and right plates 54 and 55 are provided with a positioning hole into which the positioning projections 56A and 56B are inserted, respectively. The left and right side plates 54 and 55 are parallelly attached to the bottom plate 56 by screwing the threaded portions of the bottom plate 56 into the corresponding screw holes, with the positioning projections 56A and 56B inserted in the corresponding positioning holes, until the side plates 54 and 55 contact the positioning projections of the bottom plate. The bottom plate 56 functions as the central stay. The front portion 56C, that is, the portion approximately perpendicularly bent upward from the center stay portion, and the rear plate 53, that is, the portion located opposite to the front portion 56C, are screwed to the bottom plate 56 to complete the outer shell of the printing apparatus, which is in the shape of a box opening upward.

The bottom plate 56 is provided with a total of three cylindrical legs, one in front (left side in the drawing) and two in the rear, which are crimped to the bottom plate 56. These legs are enabled to be fitted into the threaded projections (unillustrated) of the main assembly of the printing machine, so that the bottom plate 56 can be fixed to the main assembly of the printing machine using screws. Further, the bottom portion is provided with an elongated hole (unillustrated), which is used in combination with the front leg 60A to position the printing apparatus relative to the main assembly of the printing machine.

This printing apparatus is provided with two spaces through which printing medium is conveyed. One of the spaces is constructed as follows. Above the front portion 56C, that is, the portion approximately perpendicularly bent upward from the central stay portion, an L-shaped resist plate 57 is mounted with the use of screws, bridging the left and right side plates 54 and 55. An envelope, or one of the printing media which this printing machine can accommodate, is conveyed from the left to the right in the drawing, along the inward upright portion of the resist plate 57, while being pinched between the upwardly facing surface of the sheet R conveyance belt of the printing machine main assembly and the downwardly facing surface of the resist plate 57.

The other space is constructed as described below. Referring to FIG. 2, the space square window 55A of the right side plate 55 constitutes the continuous paper conveyance space in which a continuous paper conveyance trough is positioned. Though not illustrated, the trough is positioned between the continuous paper storage and the delivery end of the continuous paper conveyance unit equipped with a conveying means driving system. The positioning dowel located at the end of the trough is inserted into the positioning hole 55B of the right side plate 55 to accurately position the printing apparatus relative to the continuous paper conveyance unit, and the trough is screwed to the left side plate 54 to fix the printing apparatus and continuous paper conveyance unit to each other.

(CR Frame and Carriage Unit)

At the approximate center of the space between the left and right side plates 54 and 55, a CR frame 201 is perpendicularly fixed to the bottom plate 56. The aforementioned positioning projections of the bottom plate 56 for positioning the left and right side plats 54 and 55 are provided with holes into which the CR frame 201 is inserted. The distances between the adjacent two of these holes are equal. The top portion of the front portion 56C, that is, the portion approximately perpendicularly bent upward from the center stay portion of the bottom plate 56, and the top portion of the rear plate 53, are provided with a groove 53B which keeps the CR frame 201 upright. With the provision of this groove 53B, the CR frame 201 is kept upright relative to the bottom portion of the bottom plate 56. If the name of a component of this printing apparatus contains the term "CR", this indicates that the component is related to the carriage portion of the printing apparatus.

A carriage 200 is where the liquid ejection head unit 401 for printing images is mounted. It is mounted on the right side of the CR frame 201, or the downstream side of the CR frame 201 in terms of the printing medium conveyance direction, and is enabled to move through the aforementioned two printing medium conveyance spaces.

(Ink Supply System Unit)

Figure 2:
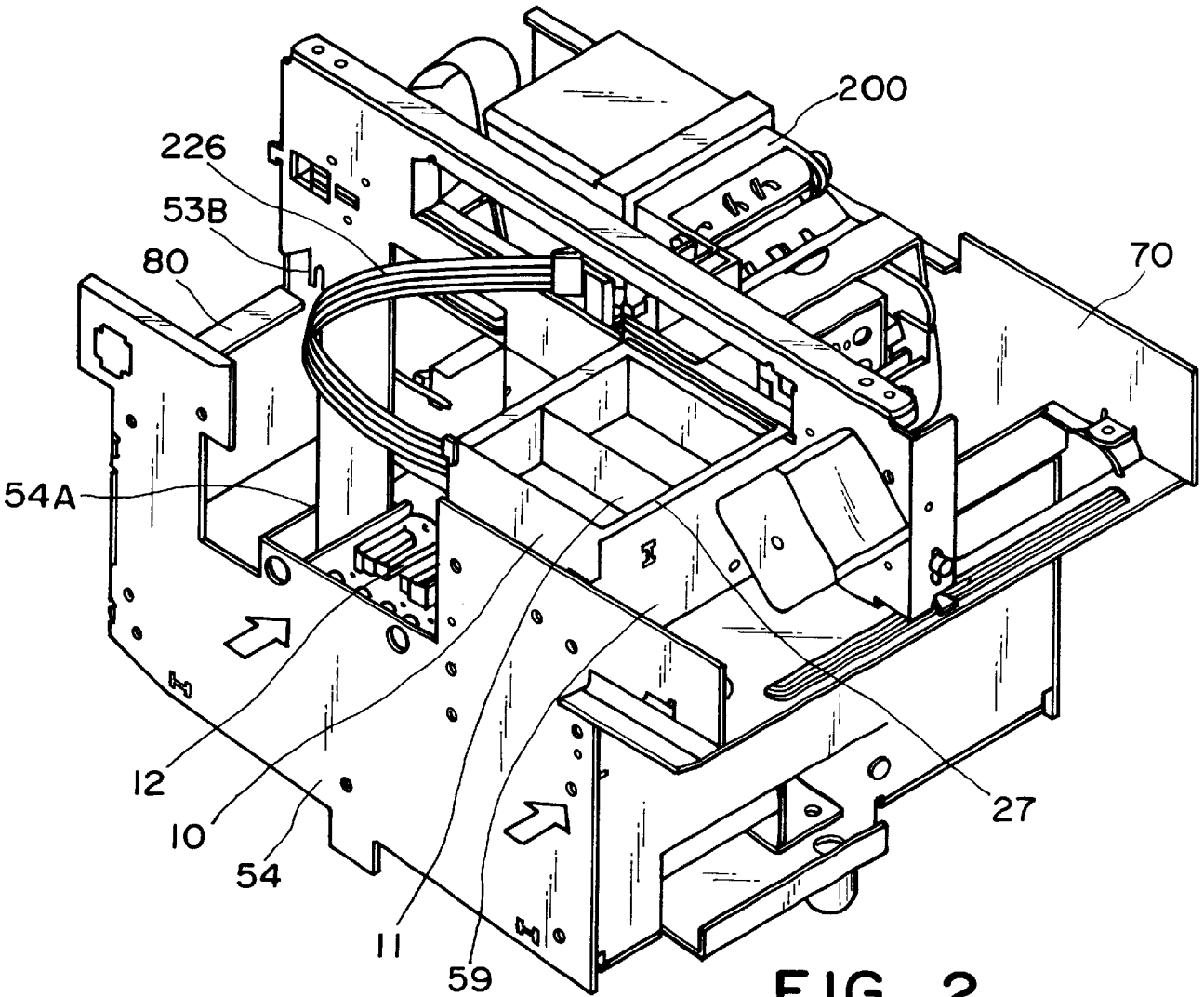
FIG. 2 is a perspective view of a major part of a printing apparatus according to the embodiment of the present invention as seen in a different direction from FIG. 1.

Referring to FIG. 1, there is an ink supply system unit 10 for supplying ink ejecting liquid ejection head unit 401 with ink, on the right side of the CR frame 201, that is, the downstream side of the frame unit 70 in terms of the printing medium conveyance direction. The ink supply system unit 10 holds a plurality of large capacity main containers 501, on the upstream side in terms of the printing medium conveyance direction. This ink supply system unit 10 comprises a container storage portion 11 which holds the plurality of main containers 501 and is enabled to release the ink within the main ink containers 501, and a sub-container unit 12 for supplying the released ink to the liquid ejection head unit 401. The details of the ink supply system unit 10 will be described later.

(Recovery System Unit)

Also referring to FIG. 1, there is a recovery system unit 300 on the right side of the CR frame 201, that is, the downstream side of the CR frame 201 in terms of the printing medium conveyance direction, and between the aforementioned two conveyance spaces. The recovery system unit 300 is for recovering the performance of the liquid election head unit 401 when the printing apparatus suffers from improper ejection. More specifically, the recovery unit 300 forcefully ejects ink from the liquid ejection head unit 401 to restore the printing apparatus performance when the apparatus suffers from improper ejection. The waste ink or the ink consumed for this performance recovery ejection is discharged into a waste ink storage within the printing machine main assembly, through the hole of the bottom plate 56 located below the bottom Portion of the recovery system unit 10.

(Control Board and Electric Power Unit)

The control board 80 which controls the printing operation and various systems of this printing apparatus is fixed to the rearwardly facing surface of the external rear plate 53 of the boxy frame unit 70. Although not illustrated, this control board 80 is covered with a cover, with a connector for receiving signals from the printing machine main assembly exposed from the frame unit. The cover is provided with a hole through which a cable for sending the control signals from the control board 80 to the liquid ejection head unit 401 within the carriage 200 is connected between the carriage 200 and control board 80.

The electric power unit 90 is fixed to the rear plate 53, on the side opposite to where the control board 80 is fixed, and on the inward side of the frame unit 70. The electrical power receptacle for receiving electric power from outside is fitted in the square hole cut in the left side plate 54, and is connected to the external power source from outside the frame unit. The electrical power unit 90 is wired so that the electrical power is supplied to the control board 80 and the printed circuit boards on the carriage 200.

[Container Holding Portion]

Figure 3:
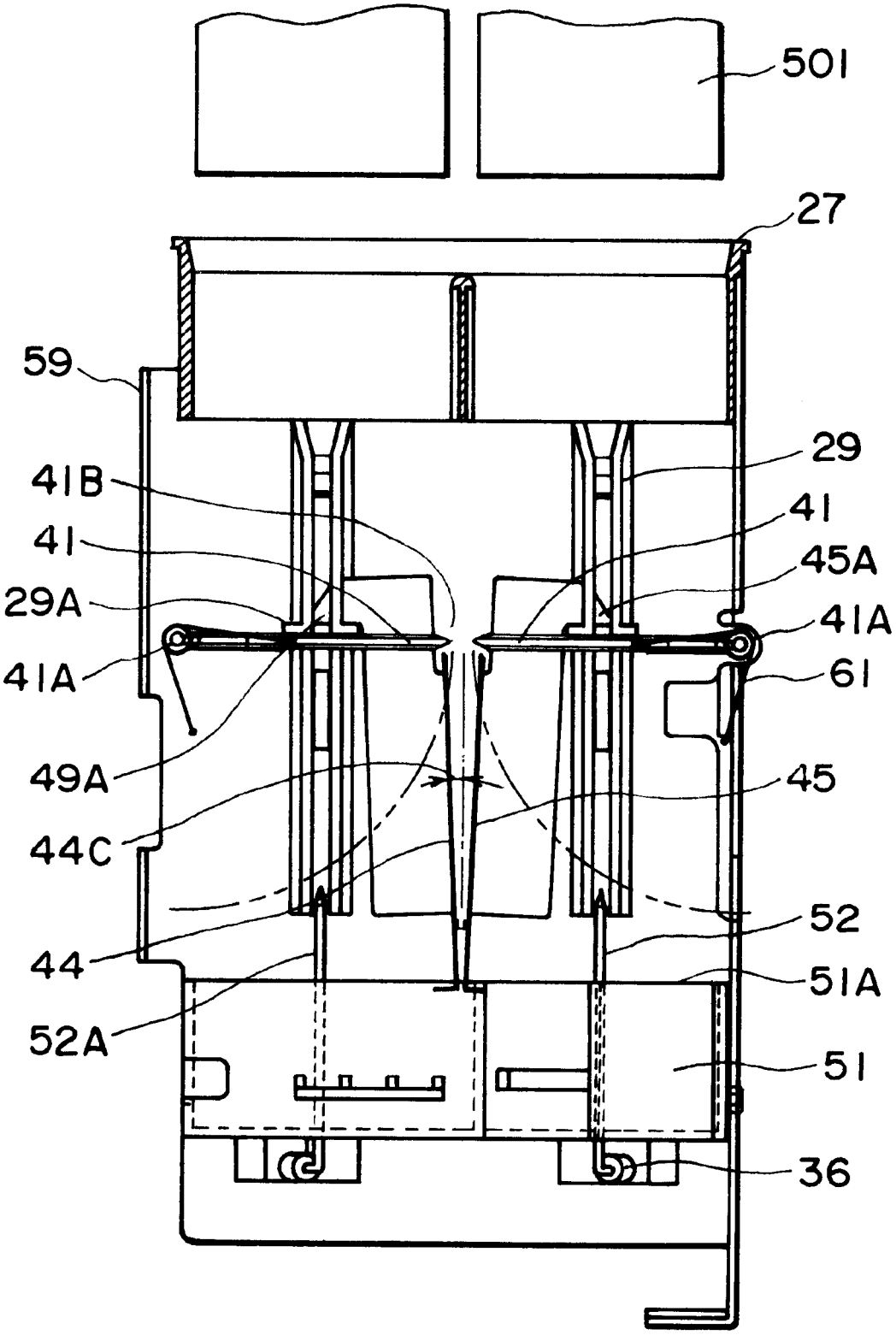
FIG. 3 is a sectional view of a container accommodating portion in which main container is not accommodated.
Figure 4:
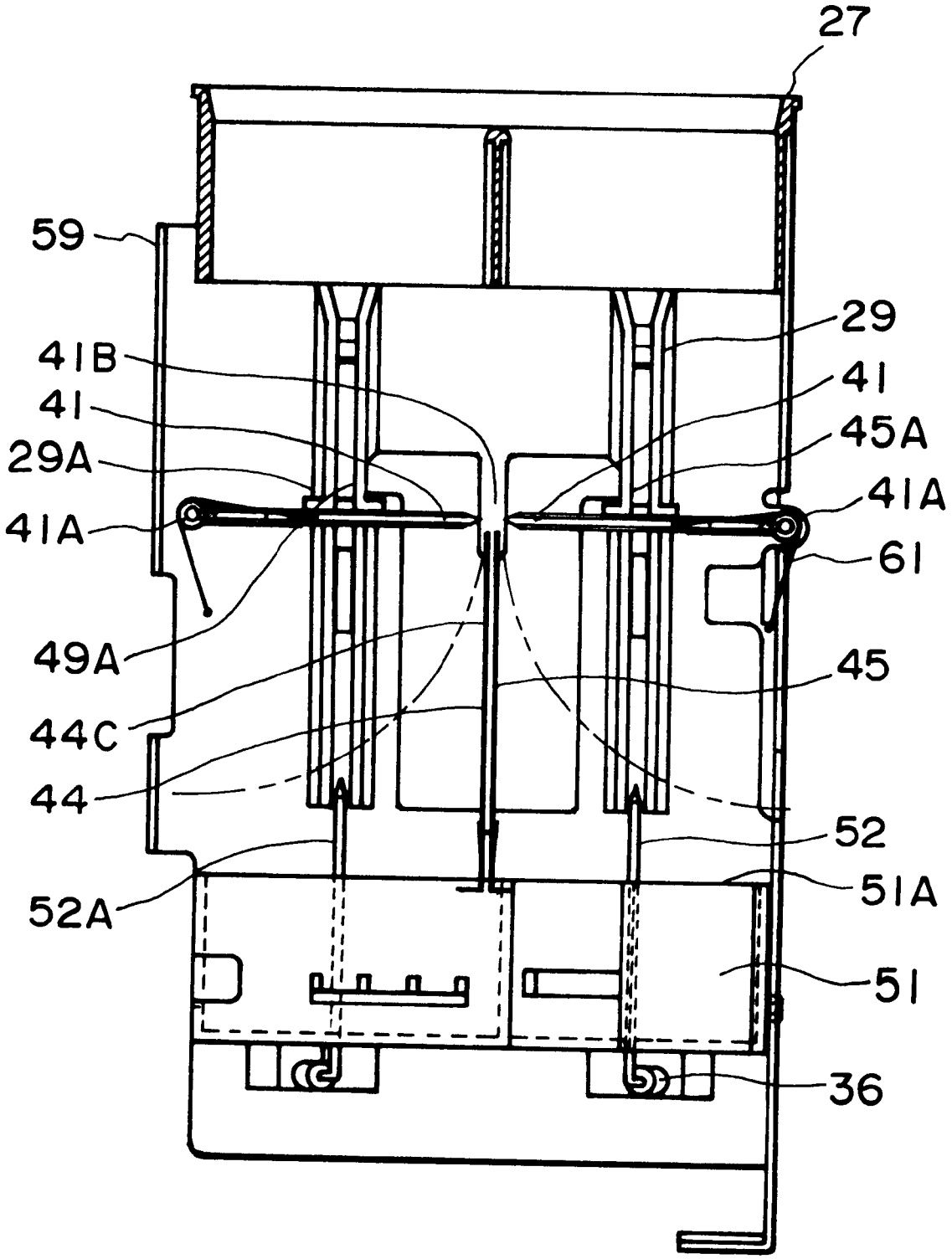
FIG. 4 is a sectional view of a container accommodating portion of FIG. 3 in a main container accommodatable state.

Next, referring to FIGS. 3–5, the container holding portion 11 will be described. The container holder 59 is a frame for holding the main containers 501, and is provided with opening which is cut in the top wall of the frame, and through which the main containers 501 are inserted, The container holding portion 11 is U-shaped, and one of its side walls is screwed to the left side plate 54, with one end of the bottom wall of the container holding portion 11 in contact with the bottom plate 56. Fitted through the aforementioned top opening of the container holder 59 is a container slot 27, the cross section of which is largest at the entrance and gradually reduces toward the actual holding portion to match the cross section of the main container 501. Located below the container slot 27 are positioning rails 29 for positioning the main containers 501, and container guides (unillustrated), which are positioned to sandwich the plurality of main containers 501 side by side Each main container 501 is provided with a rib 524 (FIG. 5) which is located on one of the smaller side walls, that is, the side walls correspondent to the short edge of the cross section of the container 501 perpendicular to the main container insertion direction. The rib 524 extends in the main container insertion direction. When inserting the main container 501 into the container holder 59, the rib 524 is fitted into the groove of one of the positioning rails 29 to accurately position the main container 501 in the direction parallel to one of the surfaces of the main container 501, and the final position of the main container 501 in the container holder 59 is determined as it is sandwiched in the direction parallel to the aforementioned short edge.

A needle base 51 constitutes the main container holder space bottom 51A, to which a hollow needles 52 are vertically fixed to serve as ink delivery outlets. Each hollow needle 52 is a metallic tube and has a hole in its side wall. Its tip is sharply pointed. It is fixed by an ink detection plate (unillustrated), with a half of the straight portion of the hollow needle 52 buried in the needle base 51. There are two hollow needles for each main container 501.

The bottom portion of the main container 501 is provided with two connection holes, the positions of which correspond to those of the hollow needles 52. Normally, these holes are plugged with a rubber plug 513. When installing the main container 501, as the bottom portion of the main container 501 reaches the main container holding space bottom 51A, the hollow needles 52 penetrate the correspondent rubber plugs, which are plugging the connection holes of the main container 501. As a result, the ink within the main container 501 is enabled to be delivered outward through the hollow needles 52 (to the ink supply system unit which will be described later). More specifically, one combination of the connection hole and hollow needle 52 functions as an ink outlet, and the other functions as an air inlet through which air is guided into the ink main container 501, so that the liquid within the main container 501 is smoothly replaced by the ambient air. One end of the aforementioned ink detection plate is electrically connected to the control board 80 with a piece of electrical wire. Whether ink is present in the main container 501 or not can be detected by measuring the value or the current which flows between the two hollow needles, the end of each of which is exposed in the main container 501. This subject will be further described later.

There are a plurality of protective lids at the approximate center portion of the container holding portion 11. They prevent operators from being injured by the sharp tip of the hallow needle 52. The number of the protective lids is the same as that of the main container 501.

First, referring to FIG. 3, a state of the container holding portion 11, in which the main containers 501 are not in the container holding portion 11, will be described.

The protective lid 41 is provided with a rotational axis 41A which is on the lateral wall of the container holding portion 11. It is under the pressure generated by a torsional coil spring 61 in the direction to rotate it to cover the container insertion opening. The rotation of the protective lid 41 caused by the force of the torsional coil spring 61 is regulated by the projection 29A of the positioning rail 29, so that the protective lids becomes approximately horizontal as it completely closes the container insertion opening. Located below the frees end 41B of the protective lids 41 when the protective lids 41 are in the closed position, are stoppers 44 and 45 which regulate the opening or closing movement of the protective lids 41. The stoppers 44 and 45 are symmetrical to each other, and are rotatable. Their rotational axes are located below the space which constitutes the gap between the two main containers 501 when the two main containers 501 are in the container holding portion 11. The stoppers 44 and 45 are fixed to the container holder 59 by inserting the arms of the supporting points of the stoppers 44 and 45 into the two side walls of the container holder 59, one for one, being positioned virtually vertically, or at an angle 44C, that is, slightly tilted from the vertical position, relative to the bottom surface of the container holding space, so that the top end of each stopper is positioned to be enabled to engage with the free end of the protective lid 41, within the rotational range of the protective lid 41.

When the main containers 501 are not in the container holder 59, the end portions 44A and 45A of the stoppers 44 and 45, on the positioning rail side, are in the grooves of the rails to maintain their positions. In this state, even if the protective lids 41 are pushed downward, they do not open, because, the protective lids 41 are prevented from rotating by the top ends of the stoppers 44 and 45, which are in contact with the free ends of the stoppers 44 and 45.

As the main container 501 begins to be inserted, the rib of the main container 501 pushes away the end portion 44A (45A) of the stopper 44 (45) which is in the positioning rail. As the stopper 44 (45) is pushed away, the angle of the stopper 44 (45) becomes close to perpendicular; in other words, the end portion 44A (45A) of the stopper 44 (45) moves out of the range of the rotational radius of the free end of the protective lid 41, allowing the protective lid 41 to rotate downward. As a result, the main container 501 can be further inserted toward the bottom surface of the container insertion space without the interference from the protective lid 41.

[Sub-container Unit]

(General Description of Ink Path of Ink Supply System)

Next, the ink path through which ink is supplied from the main container 501 to the liquid ejection head unit 401, and its structure, will be described with reference to FIGS. 51–54.

Figure 51:
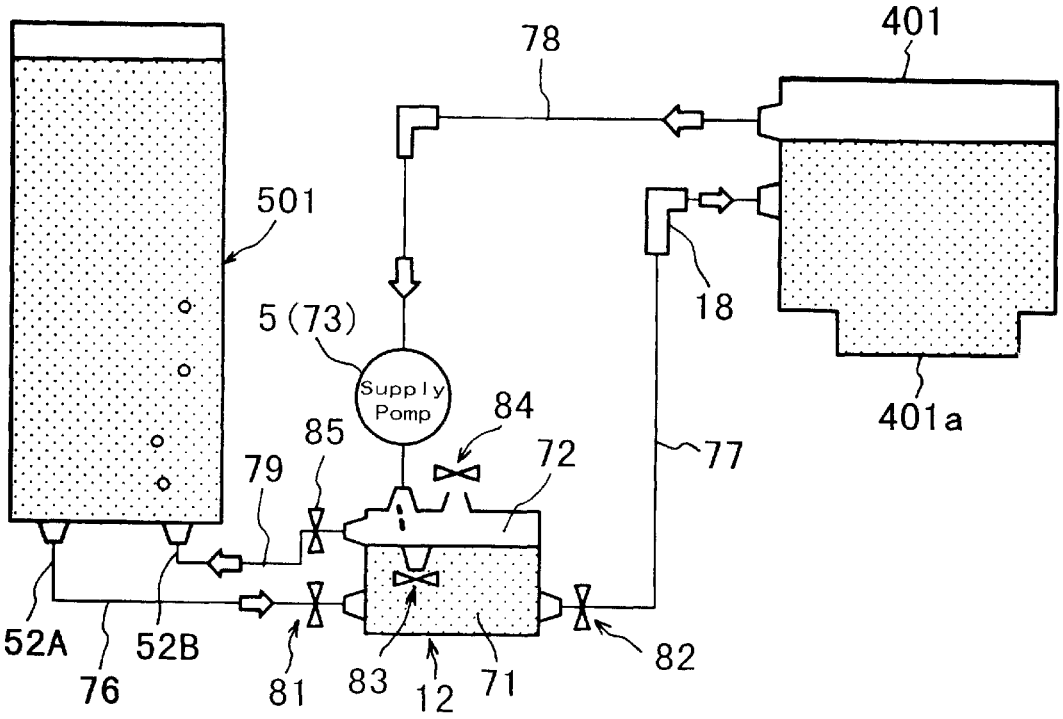
FIG. 51 is a block diagram showing an ink supplying system flow path used in the printing apparatus according to an embodiment of the present invention.

In order to provide the ink within the liquid election head unit 401 with the negative pressure, by the head pressure difference, so that the measures at the nozzle equipped surface 401*a* of the liquid. ejection head unit 401 is not destroyed by the pressure, a sub-container unit 12 is provided at a given point of the liquid path between the main container unit 501 and liquid ejection head unit 401. The position of the sub-container unit 12 is below that of the nozzle equipped surface 401*a* (FIG. 51). Further, a pressure generating means 5 (73) for making negative the internal pressure of the common liquid chamber of the liquid ejection head unit 401 is connected to the liquid ejection head unit 401. The sub-container unit 12 is connected to the pressure generating means 5 with piece of tube, and also is connected to the liquid ejection head unit 401 with two pieces of tube and a rubber joint. The pressure generating means 5 is connected to the liquid ejection head unit 401 with two pieces of tube and a rubber joint.

Figure 52:
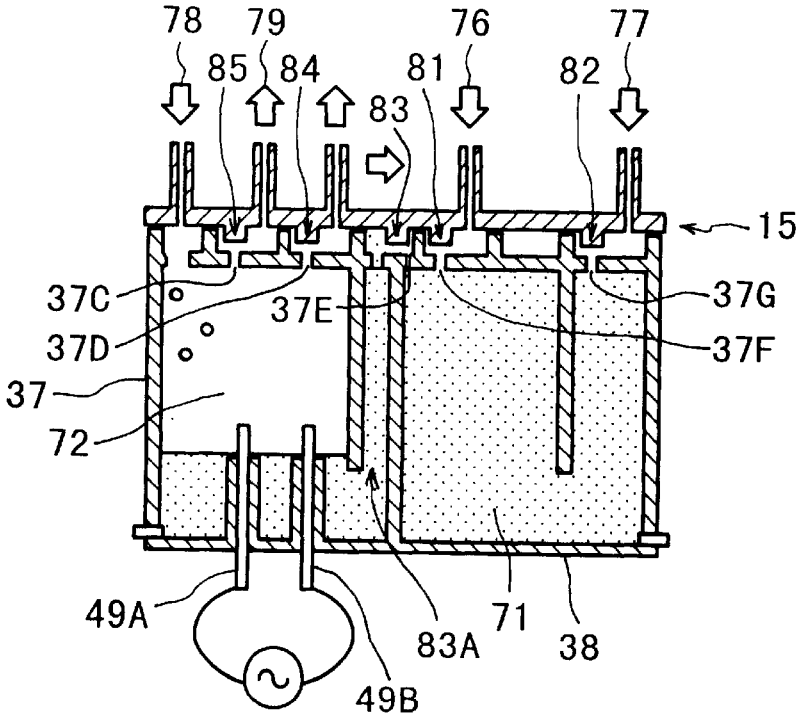
FIG. 52 is a block diagram showing a mechanism for opening and closing a valve in an ink supplying system used in a printing apparatus according to an embodiment of the present invention.

Referring to FIG. 52, the sub-container unit 12 has a sub-container base 37 which comprises a plurality of small chambers, and a sub-container cover 38. More specifically, the sub-container unit 12 generally comprises a first small chamber 71 (called hereinafter "head pressure difference generation chamber") for generating head pressure difference, a second small chamber 72 (called hereinafter "full state detection chamber") for detecting that the liquid ejection head unit 401 is completely filled with ink, a pressure generating means 73 for generating ink suctioning negative pressure, a plurality of valves of the different types which are located one for one at the inlets and outlets of the chambers. These valves are opened or closed in various combinations to change the pattern of the flow path to realize various operational modes.

More specifically, after being guided out of the main container 501 by the first hollow needle 52A, the ink from the main container 501 flows through a needle joint 36 (FIG. 3) connected to the follow needle 52A, and the first supply tube 76, and is temporarily stored in the head pressure difference generation chamber 71. The ink outlet of the head pressure difference generation chamber 71 is provided with a print valve 82. The ink flows perpendicularly upward from the head pressure difference generation chamber 71 through a print tube 77, and changes its direction to flow in parallel to the carriage movement direction, at a joint portion (unillustrated) which is located at an approximately the same level as the carriage 200, and in which a plurality of rubber joints L18 with an L-shaped path are parallelly arranged. Then, the ink flows further through the tube extending from the carriage 200, to be supplied to the liquid ejection head unit 401 (ink circulation through carriage 200 and liquid ejection head unit 401 will be described later).

The tube connected to the top portion of the common liquid chamber of the liquid ejection head unit 401 to extract the bubbles which collect within the common liquid chamber is also connected to the joint portion (unillustrated), and the joint portion is connected to the pressure generating means 73 with the use of the suction tube 78 which vertically extends downward from the rubber joints L.

The pressure generating means 73 drives a pump to generate negative pressure to make negative the internal pressure of the common liquid chamber of the liquid ejection head unit 401 so that ink is drawn out of the main container 501 on the upstream side in terms of the ink flow direction to be supplied to the liquid ejection head unit 401. The configuration of the pressure generating means 73 will be described later.

The rear side (discharge side) of the pressure generating means 73 is connected to the full state detection chamber 72. Counting as an inlet, the opening connected to the pressure generating means 73, the full state detection chamber 72 has three outlets: the first is the outlet connected to the head pressure difference generation chamber 71 through a liquid flow valve 83, and the second is the air venting valve 84 through which the full state detection chamber 72 is allowed to breathe. As the liquid flow valve 83 and air venting valve 84 are opened, a certain amount of difference in head pressure is generated between the nozzle equipped surface 401*a* of the liquid ejection head unit 401 and the liquid surface at the sub-container unit 12. The third outlet is a gas-liquid exchange valve 85 which is connected to a return tube 79 which extends to the second hollow needle 52B which is connected to the main container 501. The second hollow needle 52B mainly allows air to flow through it; it is used as a means for replacing the liquid within the main container 501 with air.

There are a plurality of sub-container units 12, which are independently connected to the plurality of main containers 501 for supplying ink to the plurality of liquid ejection head units 401, one for one.

(Pressure Generating Portion)

Figure 53:
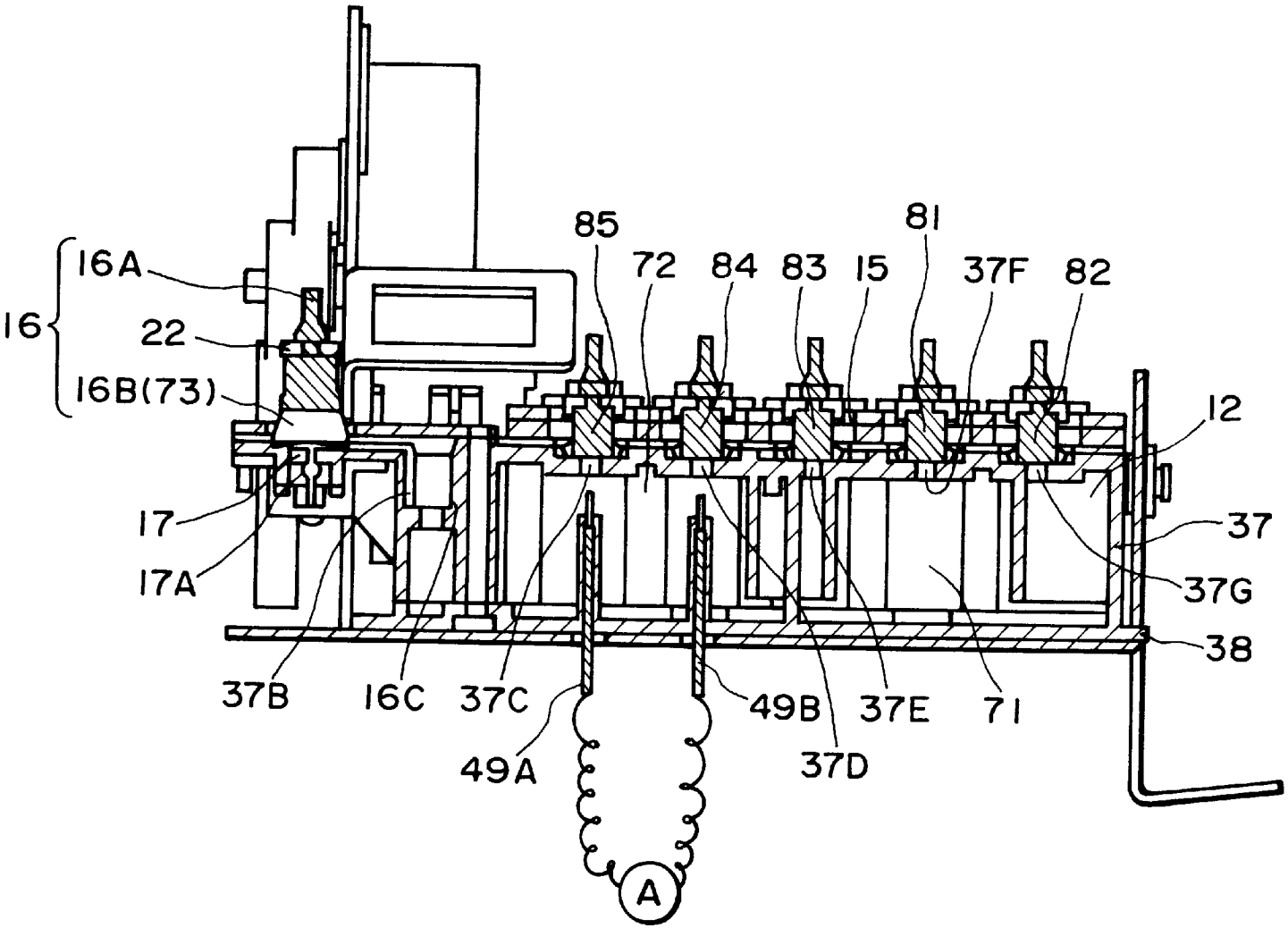
FIG. 53 is a sectional view of a sub-container structure in an ink supplying system used in a printing apparatus according to an embodiment of the present invention.
Figure 54:
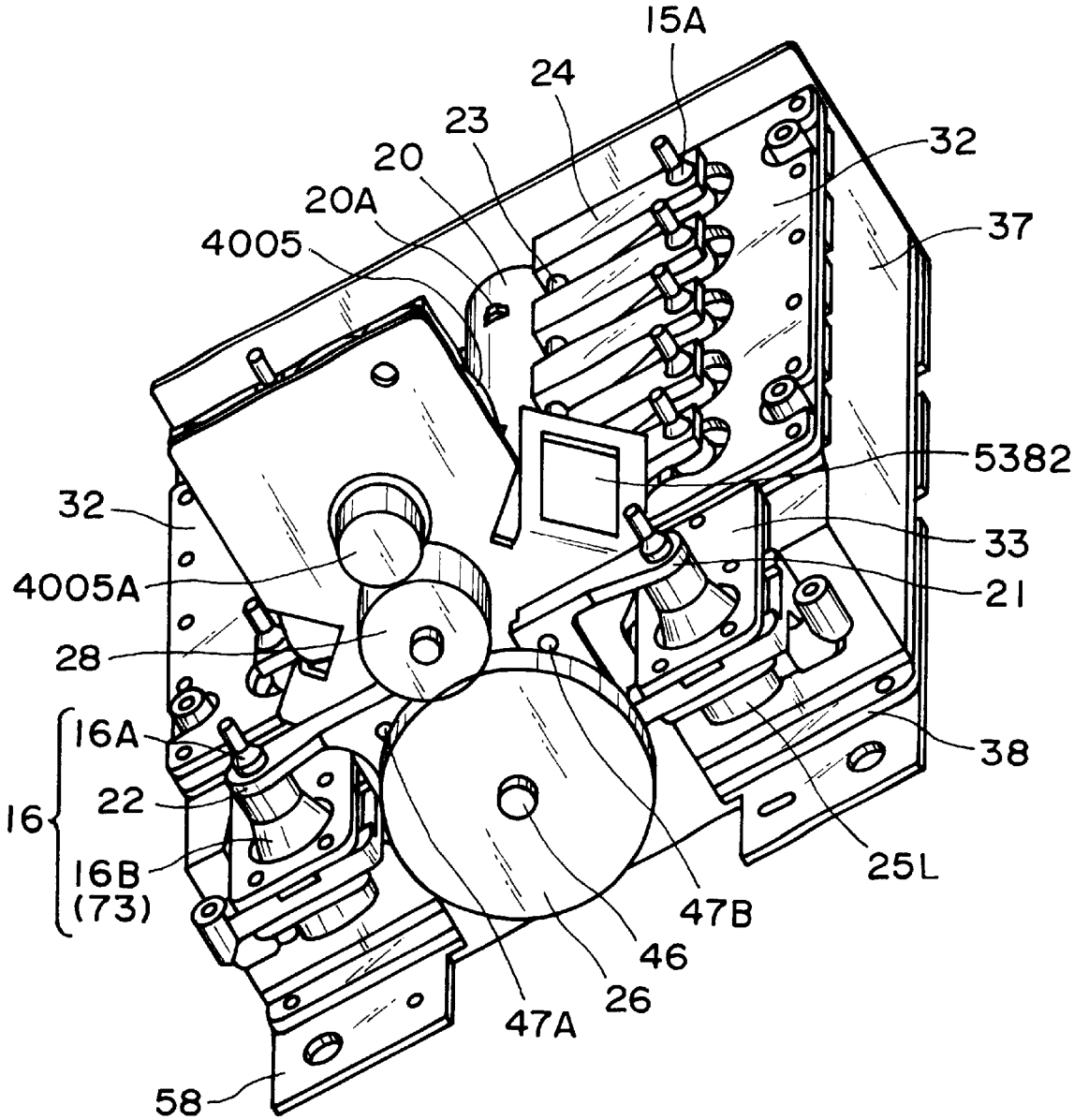
FIG. 54 is a perspective view of a sub-container structure in an ink supplying system used in a printing apparatus according to an embodiment of the present invention.

Next, referring to FIGS. 53 and 54, the aforementioned pressure generating means will be described.

A referential code 4005 stands for a supply motor screwed to the sub-container holder 58. The forward rotation of the supply motor is transmitted to a grooved eccentric cam within the pump cam 26, to rotate it, while being reduced in steps in the number of revolutions through a gear train comprising a pinion gear 4005A, an idler gear 28, and the peripheral teeth of the pump cam 26.

There are pump levels L22 and R21, which are symmetrically positioned with respect to the aforementioned gear train. They are pivotable about pump lever shafts 47A and 47B, which are put through the holes provided in the approximate centers of the pump lever shafts 47A and 47B and fixed to the sub-container holder 58 by crimping. One end of each of the pump levels L and R is enabled to slide in the grooved eccentric cam through a roller (unillustrated). A single full rotation of the pump cam 26 causes the other end of each of the pump levels L and R to shuttle once.

The other end of each of the pump levels L and R is tapered, and holds the round knob 16A of a pump rubber 16, with its groove. The pump rubber 16 comprises the round knob 16A located in the center, a bowl-shaped cylinder portion 16B with a thin wall, and a cylinder portion 16C with a closed end. The bowl-shaped cylinder portion 16B is fitted in the round counter sink (unillustrated) of the sub-container base 37, and constitutes a pressure generating chamber. The center hole of the round counter sink is covered with the semispherically projecting side of an umbrella-shaped valve 17 held by a retainer 17A. An ink path opens as necessary around the step portion of the umbrella-shaped valve 17. There is a small chamber on the aforementioned opening side (side opposite to the umbrella portion). This chamber is formed by an L-joint 25 and is connected to the suction tube 78 extended from the liquid ejection head unit 401.

The round counter sink is provided with a groove 37B leading to the full state detection chamber 72. The periphery of the thin, bottomed closed cylindrical portion 16C of the pump rubber 16 is sealed at the cylindrical entrance of the sub-container base 37, along with the end portion of the groove. The pump rubber 16 is sandwiched by a pump plate 33, sub-container base 37, and L-shaped joint 25, and therefore, it can be fixed to them by screwing them together so that the bowl-shaped cylinder portion 16B remains sealed.

As the pump cam 26 rotates half a turn by being driven by the supply motor 4005, and causes, through the round knob 16A, the pump levers L and R to move (forward) in the direction to reduce the internal volume of the bowl-shaped cylinder portion 16B, the increased internal pressure of the bowl-shaped cylinder portion 16B applies to the umbrella-shaped valve 17, and therefore, the path is not open from the opening below the umbrella portion to the atmosphere, causing the internal gas (air) to seek another outlet. Since the wall of the bottom closed cylinder portion 16C of the pump rubber 16, which plugs the end portion of the groove 37B, is thin, the wall gives inwardly due to the pressure difference: the external pressure on the bottom closed cylinder portion 16C is higher than the internal pressure of the bottom closed cylinder portion 16C. As a result, the compressed gas within the bowl-shaped cylinder 16B is exhausted into the full state detection chamber 72.

Next, as the pump cam 26 is rotated another half turn, or the rest of the aforementioned turn, and causes the bowl-shaped cylinder portion 16B to move (backward) in the direction to expand its internal volume (backward), the internal pressure of the bowl-shaped cylinder portion 16B becomes negative. The internal pressure of the bottom closed cylinder portion 16C of the pump rubber equals the atmospheric pressure, and the pressure at the groove 37B outside the cylinder portion 16C is negative. The end portion of the groove 37B is sealed. Thus, the negative internal pressure of the cylinder causes the umbrella-shaped valve 17 to open, in cooperation with the internal pressure of the small chamber of the L-joint 25, which equals the atmospheric pressure. As a result, the contents of the liquid ejection head unit 401 are suctioned in the direction of the common liquid chamber by the internal negative pressure of the cylinder.

Thus, continuous rotation of the pump cam 26 increases the internal pressure of the liquid ejection head unit 401.

(Flow Path Change)

In this embodiment, the liquid flow path of the ink supply system can be varied by activating the aforementioned five different valves in different combinations, to realize various operational modes.

The top portion of the sub-container base 37 is provided with five grooves, which constitute flow paths, and five holes 37C, 37D, 37E, 37F and 37G opening to the five grooves one for one. These holes can be opened or closed. Each groove is a highly elastic, single piece rubber member with sealing property, and has a covered portion which constitutes a flow path, and a dowel-like portion for plugging the correspondent hole, as well as a diaphragm portion which can be vertically flexible. The plurality of valves are opened or closed by a multi-valve rubber 15.

As for the material for the multi-valve rubber 15, butyl chloride rubber which is low in gas permeability and excellent in ink resistance is suitable.

Outside the flow path of the diaphragm with the central dowel-like portion for plugging the aforementioned holes, a club-shaped projection 15A for vertically moving the dowel-like portion is placed. The aforementioned projection is engaged with the one end of the pivotable valve lever 24 so that it can be moved along with the pivotable valve lever 24. The number of the valve levers 24 is the same as the number of the aforementioned holes. The valve levers 24 are arranged side by side in a manner to extend in parallel in the direction perpendicular to the direction in which the holes are aligned. The valve levers 24 are supported by a lever arm 23 which also functions as the fulcrum for the valve levers 24. The valve levers 24, sub-container cover 38, sub-container base 37, multi-valve rubber 15, lever arm 23, lever springs (unillustrated), are held to each other, and also to sub-container frame 32, with the use of a long threaded bolt put through them. The dowel-like portions of the multi-valve rubber 15 are shaped so that they can plug the holes, in their natural states. The lever springs (unillustrated) which are bolted together with the rest of the aforementioned components generate pressure in the direction to press the dowel-like portions to assure that the holes are tightly plugged.

As for the positions where the valve levers 24 are placed side by side, the valve levers 24 are arranged in symmetry in the space between the two sub-containers. All the valve levers 24 bend downward in an L-shape at the positions correspondent to their supportive fulcrums, and their downward ends (unillustrated) function as a slidable power application point. The line with respect to which the valve levers 24 are arranged in two rows coincides with the axial line of the aforementioned pump cam 26. The cam shaft 46 which moves with the pump cam 26 with the D-cut center hole is rotationally supported by the sub-container holder 58, in parallel to the two sub-container units 12. The cam shaft 46 is rotationally fitted with a timing drum 20 with a one way clutch. The timing drum 20 is provided with a plurality of projections 20A for pressing one for one the slidable pressure application points of the valve levers 24. The angular intervals among these projections 20A are set according to the rotational angles necessary to provide proper valve timing. As one of the projections 20A presses the slidable pressure application point of one of the valve levers 24 to which it is assigned, the other end of the valve lever 24 moves in the direction to open the correspondent hole of the sub-container base 37. Without a contact between the projection 20A and the slidable end of the valve lever 24, the hole remains closed.

The timing drum 20 is rotated by the reverse rotation of the supply motor 4005. The supply motor 4005 is a pulse motor, and can be stopped after it is rotated a required degree of angle. More specifically, the one way clutch contained in the timing drum 20 locks up only when the motor is rotated in reverse, and the pumping operation is carried on even during the operation for opening or closing the valves. Therefore, if the motor is caused to rotate forward as necessary after the timing drum 20 is rotated by a certain angle necessary to open the valves in a certain combination, the negative pressure generating operation is continued without changing the established flow path.

The timing drum 20 is also provided with a light shielding plate (unillustrated) for indicating the referential position (angle), which projects from the timing drum 20. The referential position is confirmed by a photosensor 5382 fixed to the sub-container holder 58, and the rotational angle of the timing drum 20 is measured from this position. The different flow paths are established by controlling the rotational angle of the timing drum 20 by controlling the number of pulses applied to rotate the motor.

(Patterns and Functions of Flow Path)

Next, the various flow path patterns, which can be realized by various combinations of the valves, and the functions of the various flow path patterns, will be described. There are five different modes: "supply 1", "supply 2", "print", "recirculation", and "exchange" modes.

It is assured that the component combination on the left side, as seen from the envelope conveyance side, corresponds to the "supply 1". This combination on the left side comprises the main container 501 (L), sub-container unit 12 (L), unit internal pressure generating portion 73 (L), liquid ejection head unit 401 (L), and valve now comprising valves 81–85 (L). The component combination on the right side corresponds to the "supply 2". This combination on the right side comprises the main container 501 (R), sub-container unit 12 (R), unit internal pressure generating portion 73 (R), liquid ejection head unit 401 (R), and valve row comprising valves 81–85 (R).

The valves opened to realize the "supply 1" mode corresponding to the first combination are vales 81 (L), 82 (L), 85 (L) and 85 (R), and the closed valves are 83 (L), 84 (L), 81 (R), 82 (R), 83 (R) and 84 (R). The negative pressure generated in the pressure generating portion 73L suctions ink into the common liquid chamber of the liquid ejection head unit 401 (L) on the upstream side, heat pressure generation chamber 71 (L), and main container 501 (L) in the order opposite to the listed order. In order to prevent the destruction of the meniscus formed at the nozzle equipped surface 401*a* of the liquid ejection head unit 401 (L), during this suctioning, a cap for sealing the nozzle equipped surface 401*a* is necessary, which is obvious. After reaching the pressure generating portion 73 (L), the ink from the main container 501 (L) is caused to reach the full state detection chamber 72 (L) which contains the full state detecting means, by the exhausting force of the cylinder.

The full state detecting means flows electrical current between the two electrodes 49A and 49B which project from the sub-container cover, and determines whether the full state detection chamber is completely filled with ink or not by measuring the electrical resistance value between the two electrodes. The positions of the two outlet valves, that is, the air venting valve 84 (L) and gas-liquid exchange valve 85, are higher than the positions of the electrodes 49A and 49B. As the full state is detected, the motor rotation is stopped to prevent ink from being auctioned any further. The liquid outlet valve 83 (L), that is, one of the rest of the valves, is a portion of the flow path leading to the head pressure generation chamber 71 (L), and the position of the entrance 83A of the liquid outlet valve 83 (L) is lower than the position of the exposed portions of the aforementioned electrodes.

It is obvious that as the valve 81 (R) is closed in this mode, ink is not supplied to the liquid ejection head unit 401 (R).

The valves to be opened to realize the "supply 2" mode are valves 85 (L), 81 (R), 82 (R) and 85 (R), and the valve to be closed to realize the "supply 2" are valves 81 (L), 82 (L), 83 (L), 84 (L), 83 (R) and 84 (R). In this mode, ink is supplied to the liquid ejection head unit 401 (R) in the same manner as described regarding the "supply 1" mode, but is not supplied to the liquid ejection head unit 401 (L).

The valves to be opened to realize the "print" mode are valves 82 (L), 83 (L), 84 (L), 82 (R), 83 (R) and 84 (R), and the valves to be closed to realize the "print" mode are valves 81 (L), 85 (L), 81 (R) and 85 (R). The "print" mode is a mode in which both liquid ejection head units 401 are activated, but the ink supply from the main container 501 to the sub-container is blocked. The air venting valves 84 (L) and 84 (R) are opened to make the sub-container unit open to the atmospheric air. When the liquid flow valve 84 (L) is open, the ink within the head pressure difference generation chamber and the ink within the full state detection chamber are continuous to each other, and when in the full state, the ink surface in the full state detection chamber is the referential level for the head pressure difference.

The valves opened to realize the "recirculation" mode are the valve 82 (L), 83 (L), 82 (R) and 83 (R), and the valves closed to realize the "recirculation" mode are the valves 81 (L), 84 (L), 85 (L), 81 (R), 84 (R) and 85 (R). The ink recirculation through the common liquid chamber of the liquid ejection head unit 401 and sub-container unit is carried out independently for each head unit 401. Also in this case, the nozzle equipped surface 401*a* is sealed with a cap to prevent the meniscus in the orifices from being destroyed.

In order to realize the "exchange" mode, no valve is opened; all valves are kept closed. In other words, when exchanging an ink container, all valves are kept closed to prevent ink from being drained out of catch tube by head pressure difference.

[Carriage]

Next, the structure of the carriage will be described in detail.

(Carriage Holding Frame)

Figure 6:
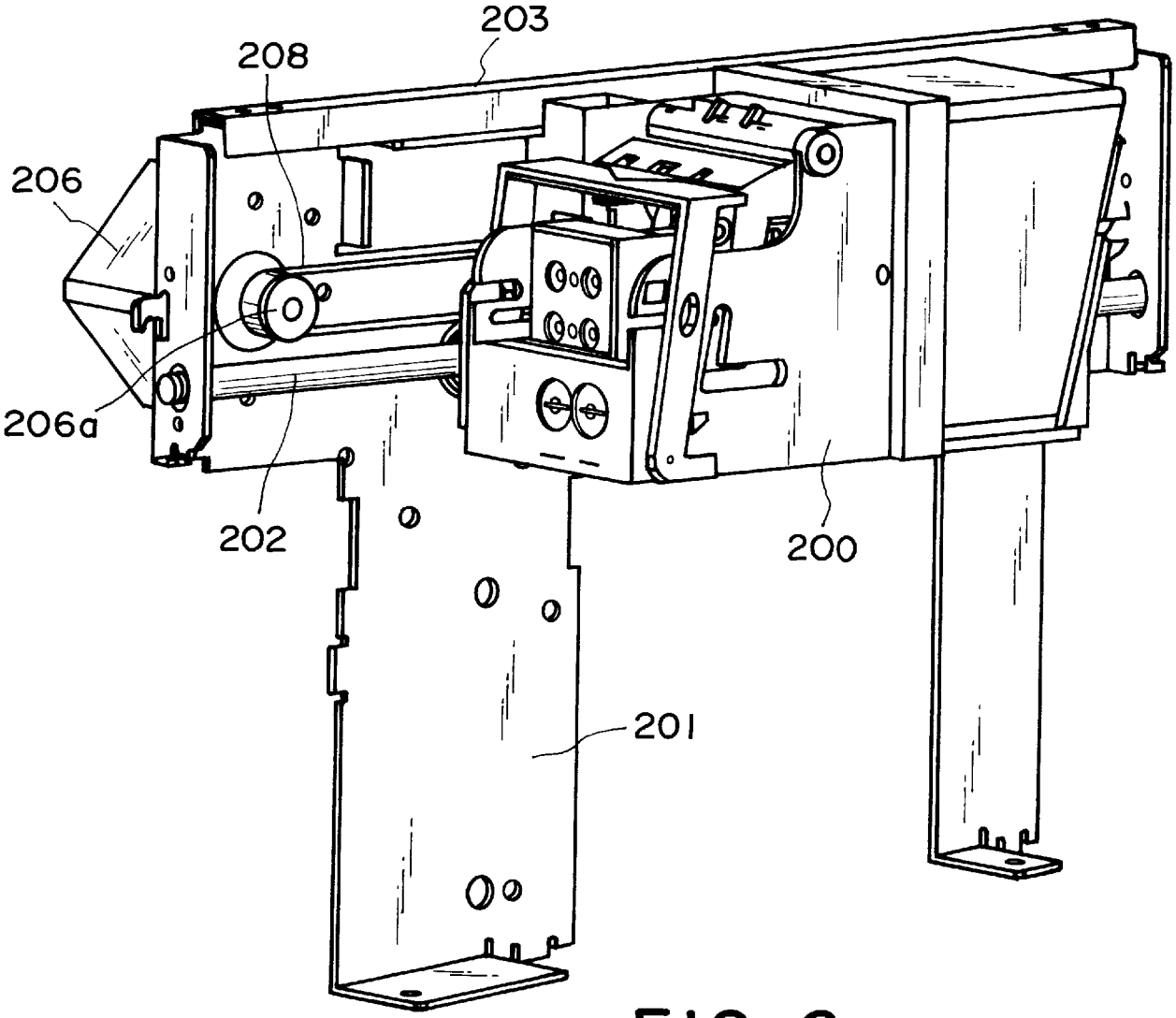
FIG. 6 is a perspective view of a carriage unit.
Figure 7:
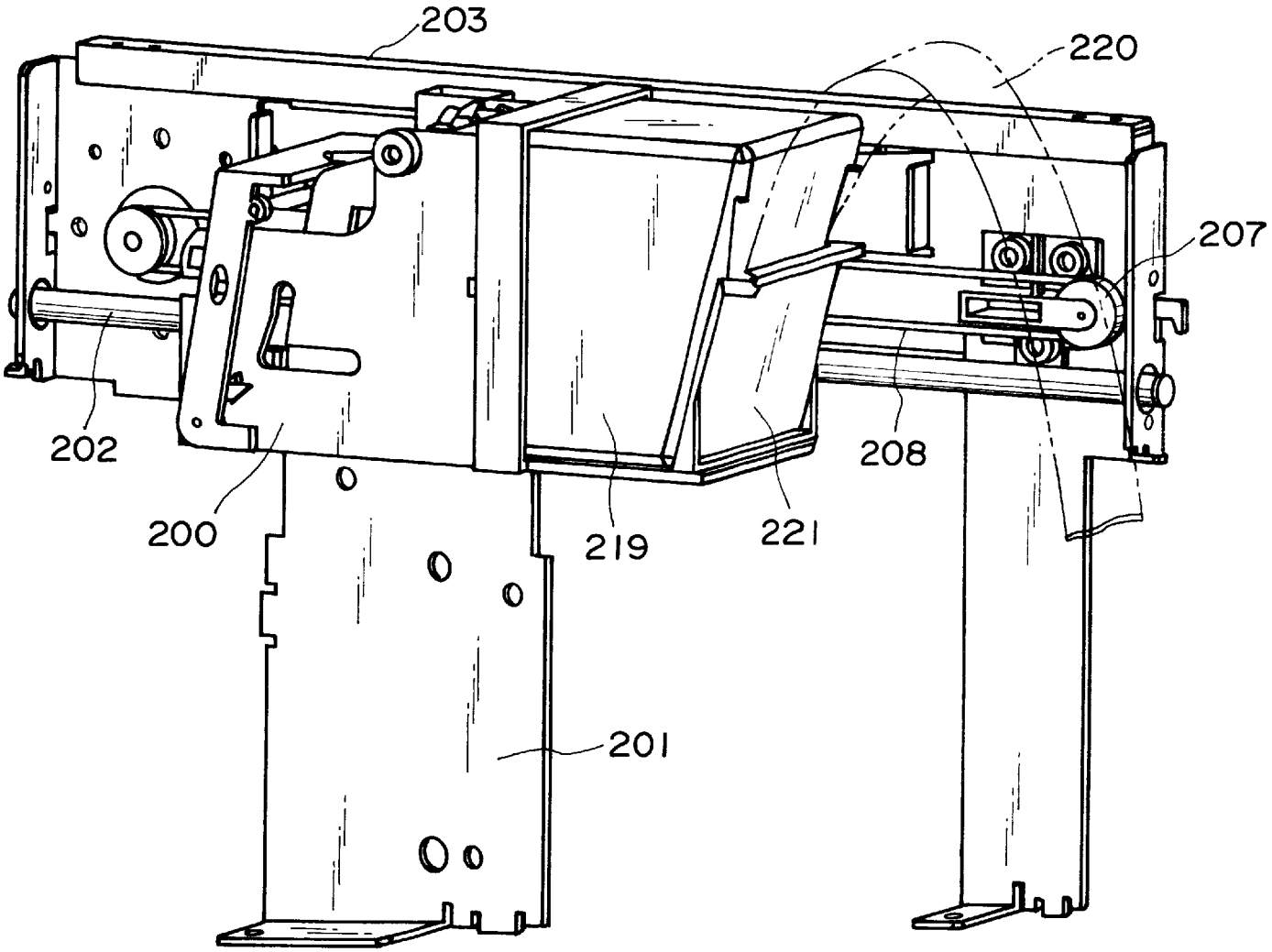
FIG. 7 is a perspective view of a carriage unit as seen in a direction different from FIG. 6.

This printing apparatus is provided with a carriage 200 which removably holds the liquid ejection head unit 401. Referring to FIGS. 6 and 7, the carriage 200 is supported by a CR shaft 202 and a guide rail 203 so that it can be slid in the direction perpendicular to the direction in which an envelope and continuous paper are conveyed, that is, the direction parallel to the nozzle rows of the liquid ejection head unit 401 mounted on the carriage 200. The CR shaft 202 and guide rail 203 are placed in parallel to each other, with their longitudinal ends fixed to the CR frame 201. Further, the carriage 200 in supported in such an attitude that when mounting the liquid ejection head unit 401 on the carriage 200, the nozzle equipped surface 401*a* of the liquid ejection head unit 401 becomes virtually parallel to the printing surface of the printing medium (envelope and continuous paper).

Figure 8:
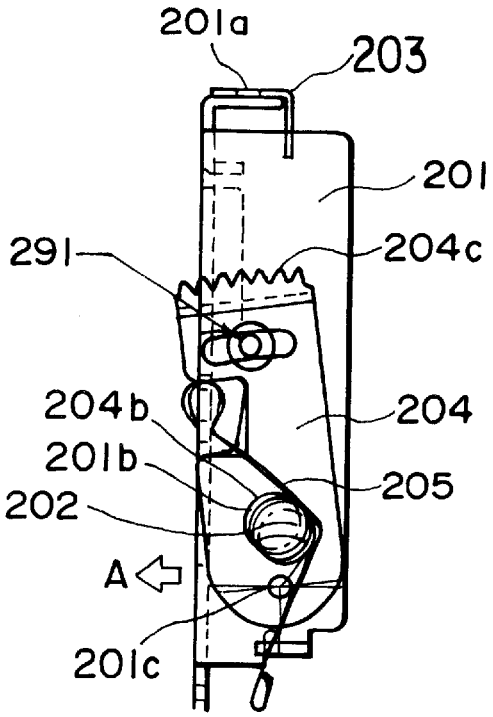

Referring to FIG. 8, the guide rail 203 is formed of thin metallic plate, and has an L-shaped cross section. It is attached to the top portion, that is, the bent portion, of the CR frame 201. It is precisely positioned relative to the CR frame 201 by two embossed portions 201*a* and two holes of the guide rail 203, and is fixed to the CR frame with two small screws.

The CR frame 201 is bent at both the front and rear ends, and has two elongated holes 201*b* for fixing the CR shaft 202. Further, referring to FIGS. 8 and 9, CR gap plates 202 for adjusting the vertical position (distance to sheet) of the CR shaft 202 are attached to the front and rear ends of the CR frame 201 one for one. They are made of metallic plate. Each gap plate 204 has a hole which fits around an emboss 201*c* of the CR frame 201, being enabled to pivot about the emboss 201*c*. Each CR gap plate 204 is attached by its top portion to the CR frame 201 with the use of a small screw. The CR gap plates 204 are provided with an elongated hole 204*b*, which is located approximately in the center portion of each CR gap plate 204. The CR shaft 202 is put through this elongated hole 204*b* and the elongated holes 201*b* of the CR frame, and therefore, the CR shaft 202 can be vertically moved by pivoting the CR gap plates 204. Further, the CR gap plates are provided with a set of gear teeth, which is located at the top edge of each CR gap plate. These teeth 204*c* are engaged with the teeth of an unillustrated jig. As the jig is operated, CR gap plates 204 pivot, causing the CR shaft 202 to vertically move so that the vertical position (distance to sheet) of the CR shaft 202 is adjusted.

The front and rear ends of the CR frame 201 are provided with an L-shaped portion, which is integral with the CR frame 201. Rod-like CR shaft locking spring 205 are hooked by these L-shaped portions. The position of the axis of the CR shaft 202 coincides with the center of each CR shaft lock spring 205, and the CR shaft 202 remains under the constant pressure generated in a given direction (indicated by an arrow mark A) by the CR shaft lock springs. Therefore, the CR shaft 202 remains held to the CR frame 201 without any play.

Figure 9:
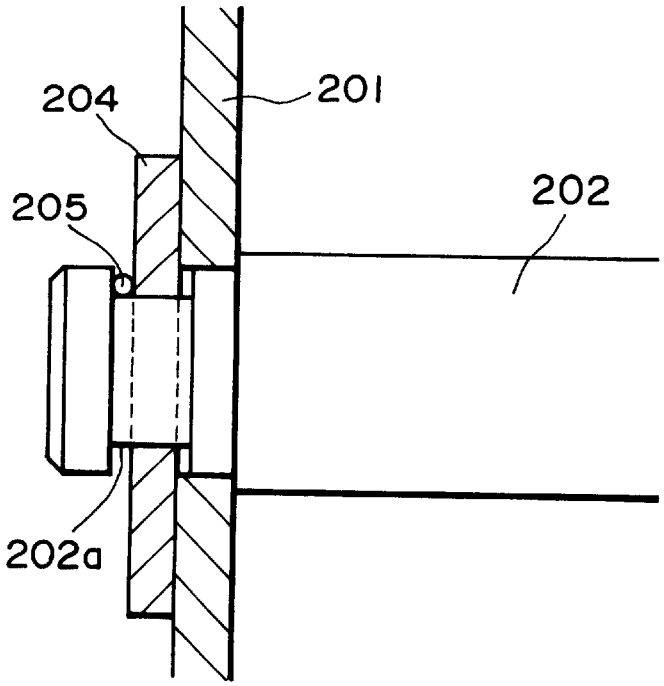

Referring to FIG. 9, one of the longitudinal ends of the CR shaft 202 is provided with a groove 202*a*, and the CR shaft lock spring 205 is fitted in the grooves 202*a* to prevent the CR shaft 202 from slipping out in the thrust direction (axial direction).

Referring to FIGS. 6 and 7, a CR belt 208 is stretched around a CR driver pulley 206*a* and an idler pulley 207, and the carriage 200 is connected to a portion of the CR belt 208. The CR driver pulley 206*a* is rotationally driven by a CR motor 206 fixed to the CR frame 201. The idler pulley 207 is rotationally attached to the CR frame 202 with the use of two small screws, and is enabled to freely side in the direction, parallel to the CR shaft 202. As the CR motor 206 is driven, the CR belt 208 is rotated, causing the carriage 200 to move back and forth in the direction parallel to the CR shaft 202 and guide rail 203.

Further, a recovery system unit 300 is attached to the CR frame 201 so that the distance between the liquid ejection head unit 401 on the carriage 200, and the recovery system unit 300, varies as little as possible. This subject will be separately discussed in the section regarding the recovery system unit 300.

(Carriage Stop Position)

Figure 10:
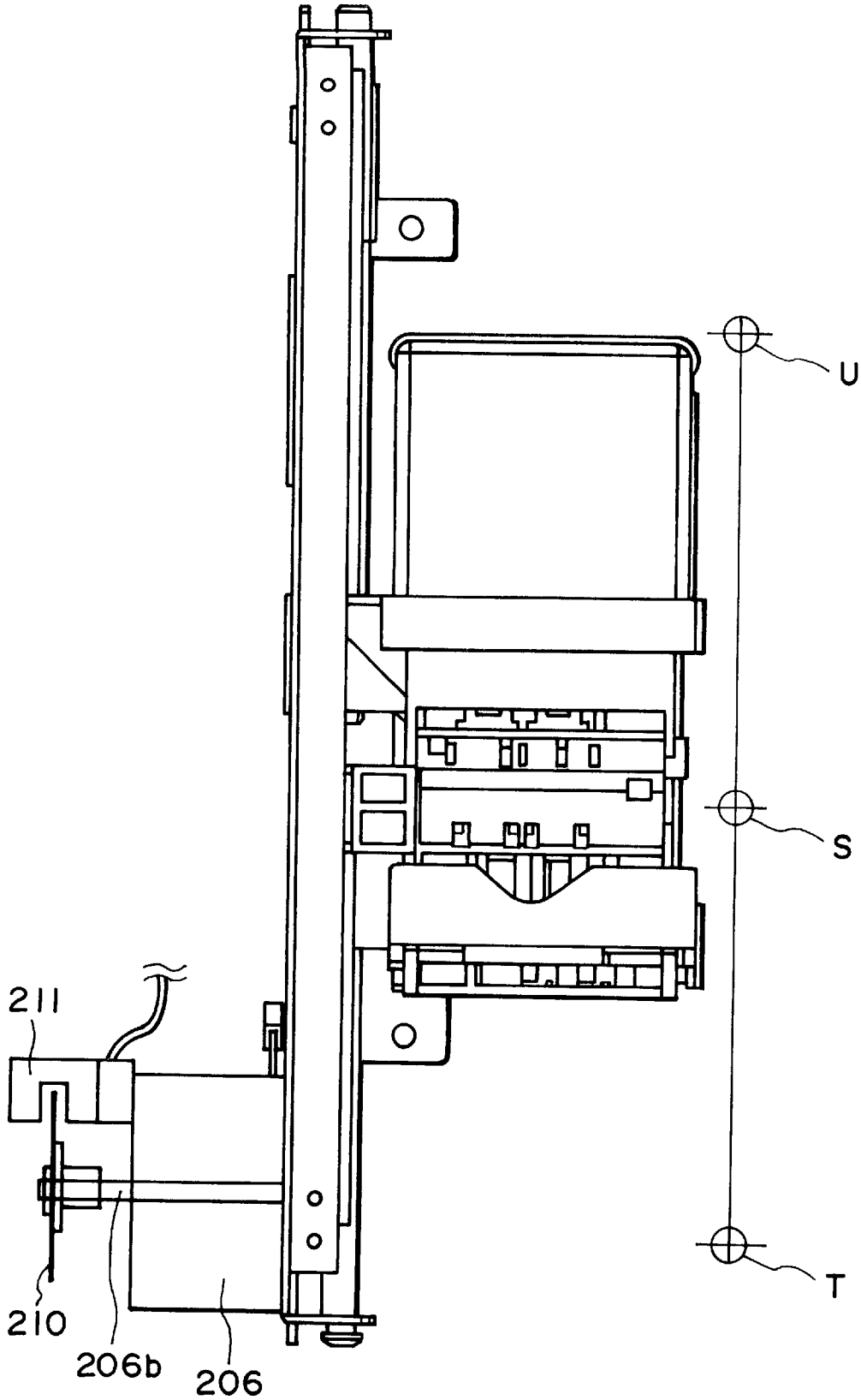
FIG. 10 is a top plan view illustrating a movable range of the carriage.

Referring to FIG. 10 this printing apparatus is provided with three positions at which the carriage 200 stops: a home position S, an envelope printing position T, and a continuous paper printing position U. The home position S is located at approximate center of the printing apparatus. The cap of the recovery system unit which will be described later vertically moves at this home position S to cover the nozzle portion of the liquid ejection head unit 401 mounted on the carriage 200. Two printing positions are located in a manner to sandwich the home position S from the front and rear, the printing position in front is the envelope printing position T and the printing position in the rear is the continuous paper printing position U.

(Carriage Control)

To the CR frame 201, an unillustrated home position sensor of a photoelectric type (hereinafter, "HP sensor" is attached. This HP sensor is located at the home position S, and can detect the carriage position by detecting the passage of the shield plate 200*a* (FIGS. 11 and 13) with which the carriage 200 is provided.

Also referring to FIG. 10, a shaft 206*b* perpendicularly extends from the CR frame 201 in the direction opposite to the CR driver pulley 206*a* of the CR motor 206, and an encoder disk 210 with slits is attached to this shaft 206*b*. As the CR motor 206 rotates, this encoder disk 210 synchronously rotates. The number of the slits cut in the encoder disk 210 are the same as the number of steps in which the CR motor 206 rotates once. The CR motor in this embodiment takes 200 steps for a single rotation, and therefore, the encoder disk 210 is provided with 200 slits. The photoelectric sensor 211 is attached in a manner to straddle this encoder disk 210. Since the encoder disk 210 rotates as the CR motor rotates, the amount of the rotational movement of the CR motor is sent to the control board by the photoelectric sensor 211. As described above, a single step of the CR motor 206 corresponds to a single slit of the encoder disk 210, and therefore, as the CR motor rotates by a single step (single step is equivalent to 1.8 degree because 200 steps corresponds to a signal full rotation), the photoelectric sensor 211 detects the passage of a single slit and sends a signal to the control board. In other words, by knowing the number of the slits of the encoder disk 210 which passed the sensing portion of the photoelectric sensor 211, the amount of the CR motor rotation, in other words, the distance the carriage 200 has moved, can be accurately fed back.

Figure 14A:
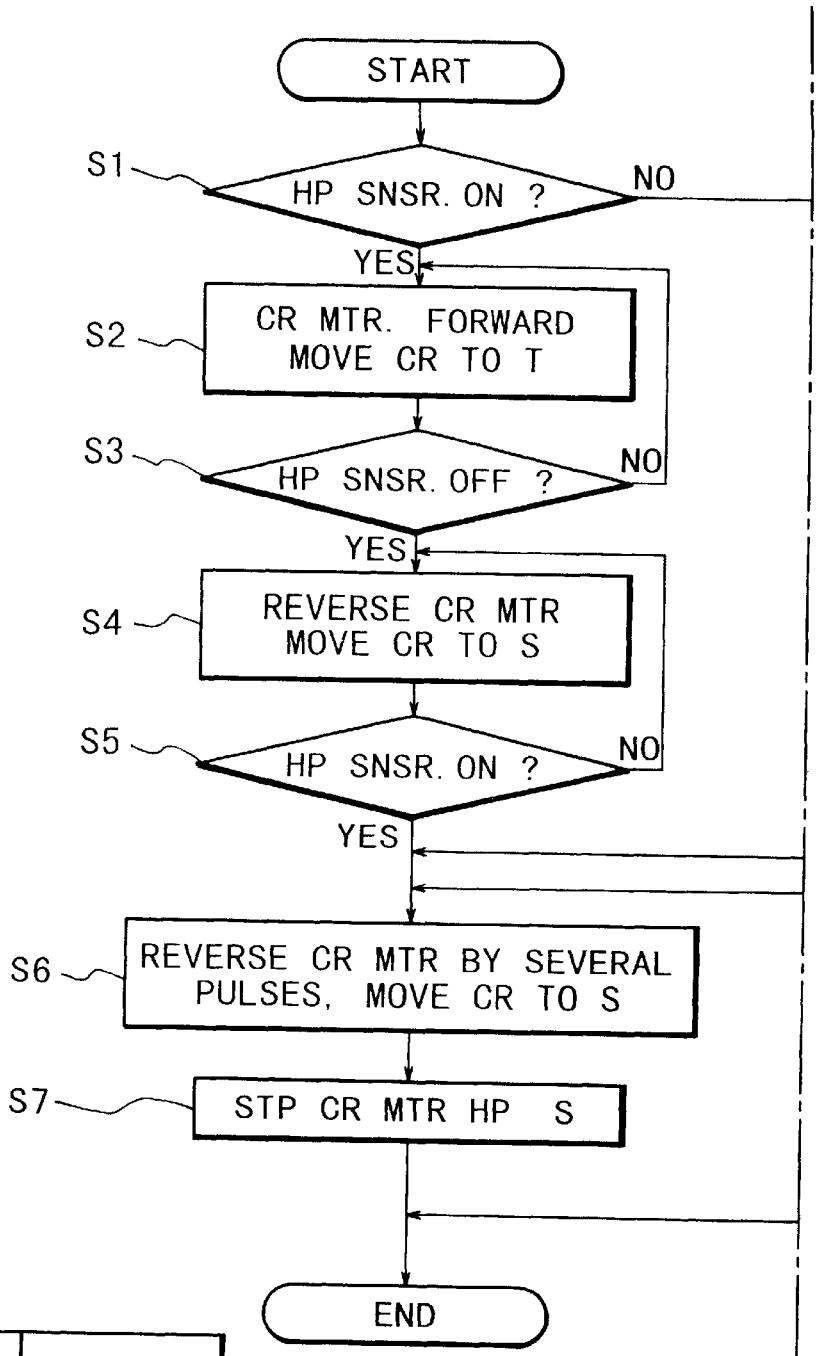
FIG. 14 is a flow chart showing movement of the carriage.
Figure 14:
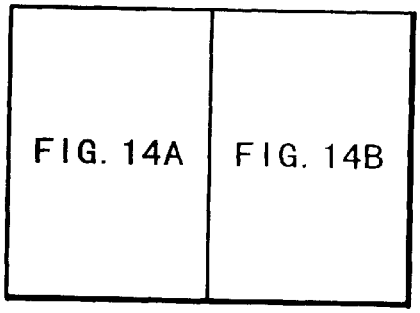
Figure 14B:
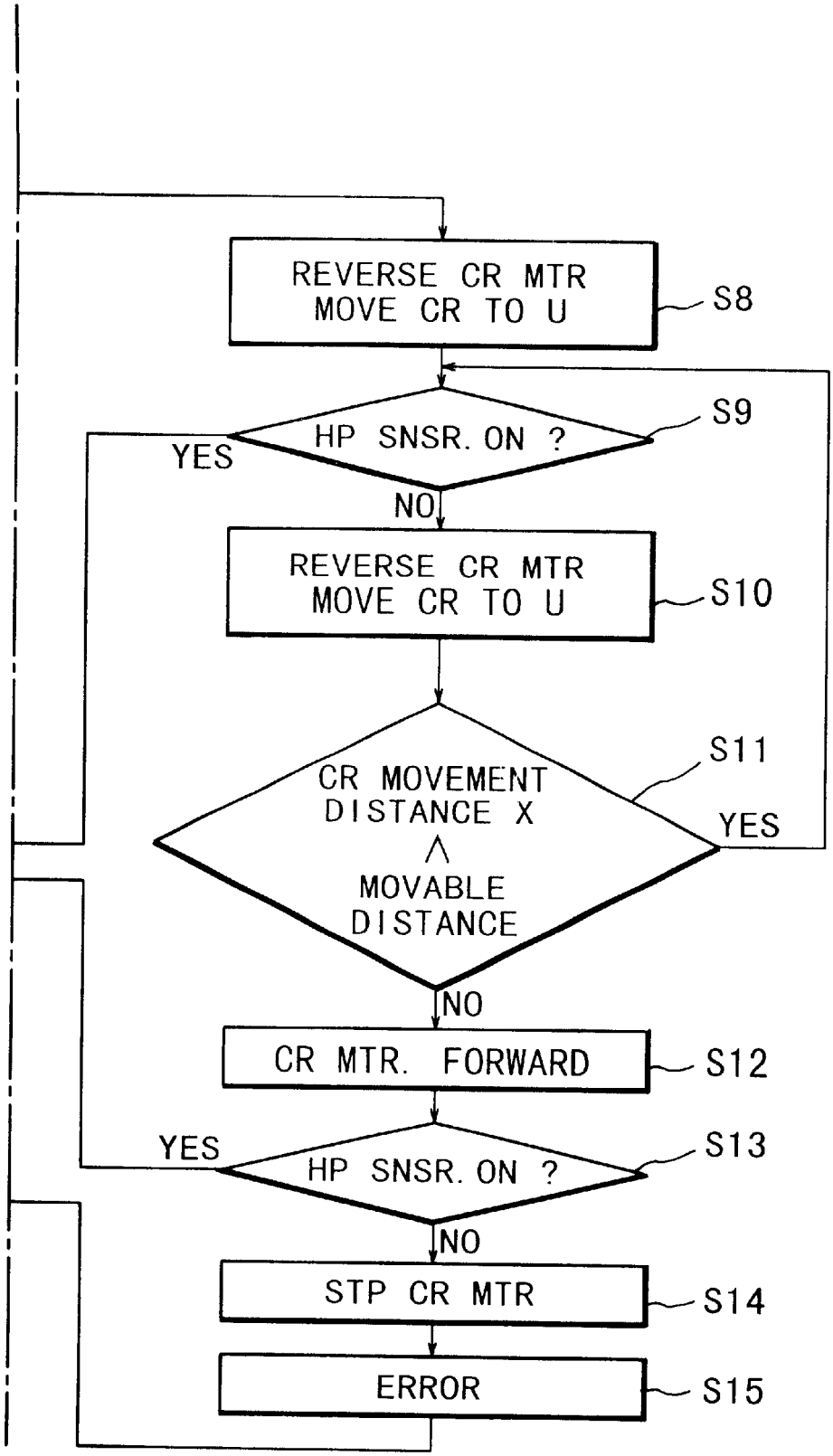

Thus, the movement of the carriage 200 will be more specifically described with reference to the flow chart in FIG. 14. As described above, the CR motor 206 is controlled by the combination of HP sensor, encoder disk 210 with slits, and photoelectric sensor 211.

At the beginning of a printing operation, when the HP sensor at the home position sensor S is sensing (ON state) the presence of the carriage 200 at the home position (Step S1), the CR motor 206 is rotated forward to move the carriage 200 toward the envelope printing position T (Step S2). Then, the moment the HP sensor has stopped sensing (OFF state) the carriage 200 (Step S3), the CR motor 206 begins to be rotated in reverse to move the carriage 200 toward the home position (Step S4). Then, from the moment the HP sensor is turned on (Step S5), that is, the moment the carriage 200 has moved to a position at which the edge of the shield plate 200*a* of the carriage 200 shields the HP sensor, the CR motor 206 is further driven by a predetermined number of pulses (Step S6) to place the carriage 200 at the home position S, and at this point, the CR motor is stopped (Step S7). This concludes the initializing operation. The number of the pulses given to the CR motor 206 in Step S6 is determined according to the distance from the edge of the shield plate 200*a* to the center of the carriage 200, and the positional relationship between the HP sensor and home position S.

On the other hand, when the HP sensor is not sensing (OFF stage) the carriage 200 (Step S1), the CR motor is rotated in reverse to move the carriage 200 (Step S8). After the HP sensor senses (ON state) the carriage 200 (Step S9), the above described step S6–S7 are carried out.

Incidentally, if it occurs that even if the carriage 200 is moved in Step S8, the HP sensor fails to sense the carriage 200 (Step S9), and pulses are supplied to the CR motor by the amount large enough to continue the carriage movement (Step S10) until a distance X the carriage 200 moves becomes equal to, or greater than, the movable range L of the carriage 200 (Step S11), the CR motor 206 is rotated forward (Step S12). Then, as the HP sensor senses the carriage 200 (Step S13), the aforementioned steps S6–S7 are carried out. However, if the HP sensor fails to sense the carriage 200 in Step S13, the CR motor 206 is stopped (Step S14), and an error message is displayed (Step S15).

Next, the movement from the home position S to the printing position (envelope printing position T or continuous paper printing position U) will be described.

First, the CR motor 206 is driven so that the carriage 200 moves from the home position S toward the printing position, and the number of the pulses applied to the CR motor 206 begins to be counted by the encoder disk 210 with slits and photoelectric sensor 211 from the moment the shield plate 200*a* of the carriage 200 stops shielding the HP sensor (moment at which HP sensor stopped sensing carriage 200, that is, movement at which HP sensor is turned off). As a predetermined number (equivalent to the distance to the envelope printing position or continuous paper printing position) of the pulses is counted, the CR motor 206 is stopped. With this control, it is assured that the carriage 200 reaches an intended printing position.

Should the CR become asynchronous, and/or the carriage 200 hangs up, the number of the counted pulses does not reach the predetermined number, and therefore, a user is warmed of the error.

In the movement from the printing position (envelope printing position T or continuous paper printing position U) to the home position S, first, the CR motor 206 is driven so that the carriage 200 moves toward the home position S. Then, starting from the point in time at which the shielding plate 200*a* of the carriage 200 reaches the position at which the shielding plate 200*a* begins to shield the HP sensor, the CR motor 206 is driven by a predetermined additional number of pulses to place the carriage 200 at the home position S, and the CR motor 206 is stopped.

(Carriage Structure: Bearings)

Figure 11:
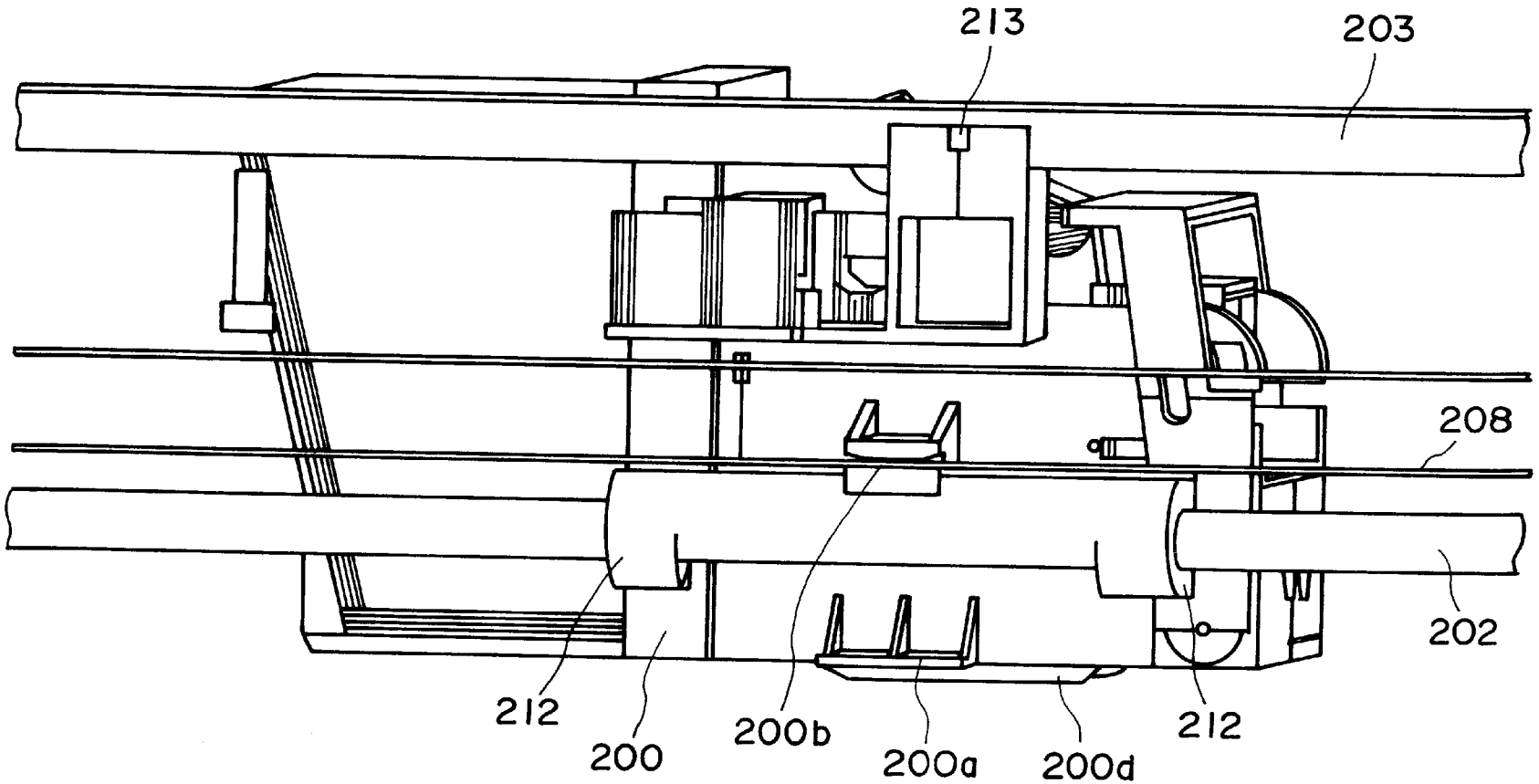
FIG. 11 is a side view illustrating a movement mechanism for the carriage.

Referring to FIG. 11, the carriage 200 slides in the direction, which is perpendicular to the direction in which an envelope and continuous printing paper are conveyed, and also in parallel to the nozzle rows of liquid ejection head unit 401. Therefore, the carriage 200 is provided with two CR bearings 212 in which the CR shaft 202 fits. These CR bearings 212 are fixed to the front and back portions of the left wall of the carriage 200.

The CR bearings 212 are formed of such material that does not require greasing, preventing paper dust and/or ink mist from sticking to the CR shaft 202 and CR bearings 212. Above the midpoint between the two CR bearings 212, a CR slider 213 with slippery property is fixed to the carriage 200 in a manner to grasp the guide rail 203.

As described above, the carriage 200 is supported at three points: two CR bearings 212 located on the bottom side, and one CR slider 313 located on the top side.

(Carriage Structure: HP Sensor Shielding Plate)

Figure 13:
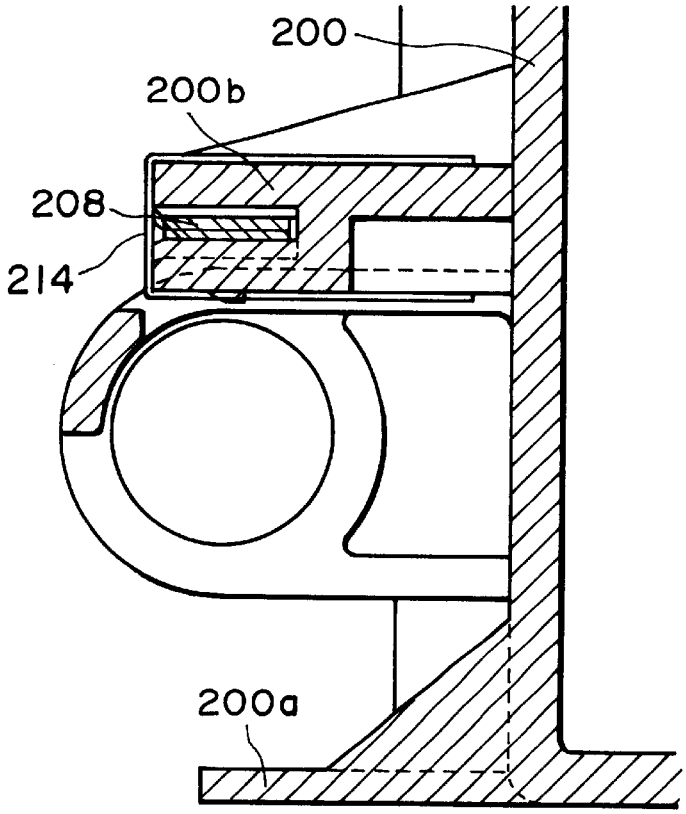
FIG. 13 is an enlarged front view illustrating fastening of the carriage to the carriage belt.

Referring to FIGS. 11 and 13, the HP sensor shielding plate 200*a* necessary for controlling the position of the carriage 200 is attached to the carriage 200. Its position is the center portion of the bottom left side of the carriage 200, and below the midpoint between the two CR bearings 212.

(Carriage Structure: CR Belt Anchoring Portion)

Figure 12:
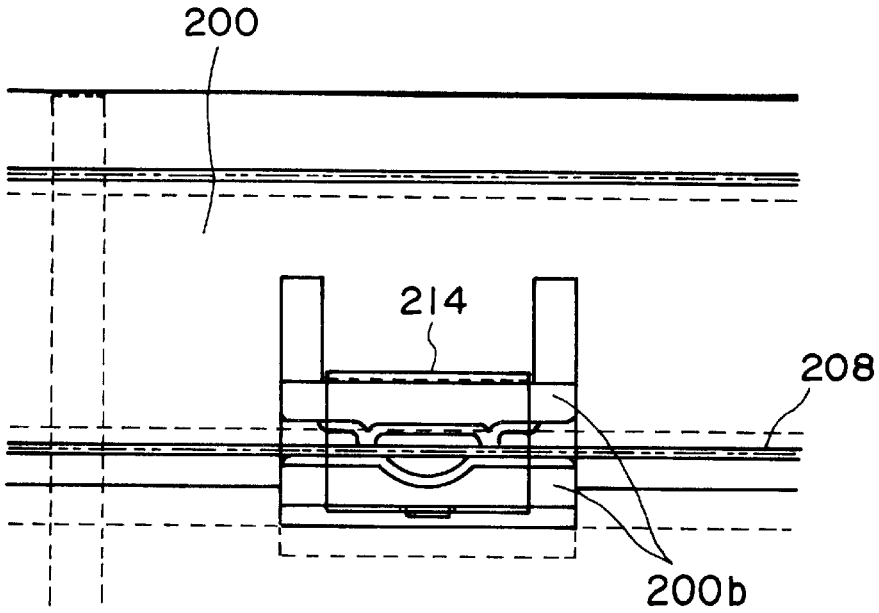
FIG. 12 is an enlargement side view illustrating the fixing between the carriage and the carriage belt.

Referring to FIGS. 12 and 13, the carriage 200 is provided with a portion 200*b* to which the CR belt 208 is anchored. The location of this CR belt anchoring portion is the approximate center of the left side of the carriage 200, and above the midpoint between the two CR bearings 212. The CR belt anchoring portion 200*b* is structured to pinch the CR belt 208, and the gap of this pinching portion in which the CR belt 208 is pinched is slightly less than the thickness of the CR belt 208, so that the CR belt 208 can be attached to the carriage 200 without play by pressing the CR belt 208 into this gap of the CR belt anchoring portion 200*b*. With the CR belt 208 fixed to the carriage 200 as described above, the carriage 200 can be moved by the CR motor 206.

Further, a CR belt stopper 214 with a U-shaped cross section, which is formed of metallic plate, is attached as a CR belt retainer to the CR belt anchoring portion 200*b* of the carriage 200 in a manner to grasp the CR belt anchoring portion 200*b*. The CR belt stopper 214 is anchored to the carriage 200 by projections of the carriage 200 into the hole of the CR belt stopper.

(Carriage Structure: Board Holding Portion)

Figure 15:
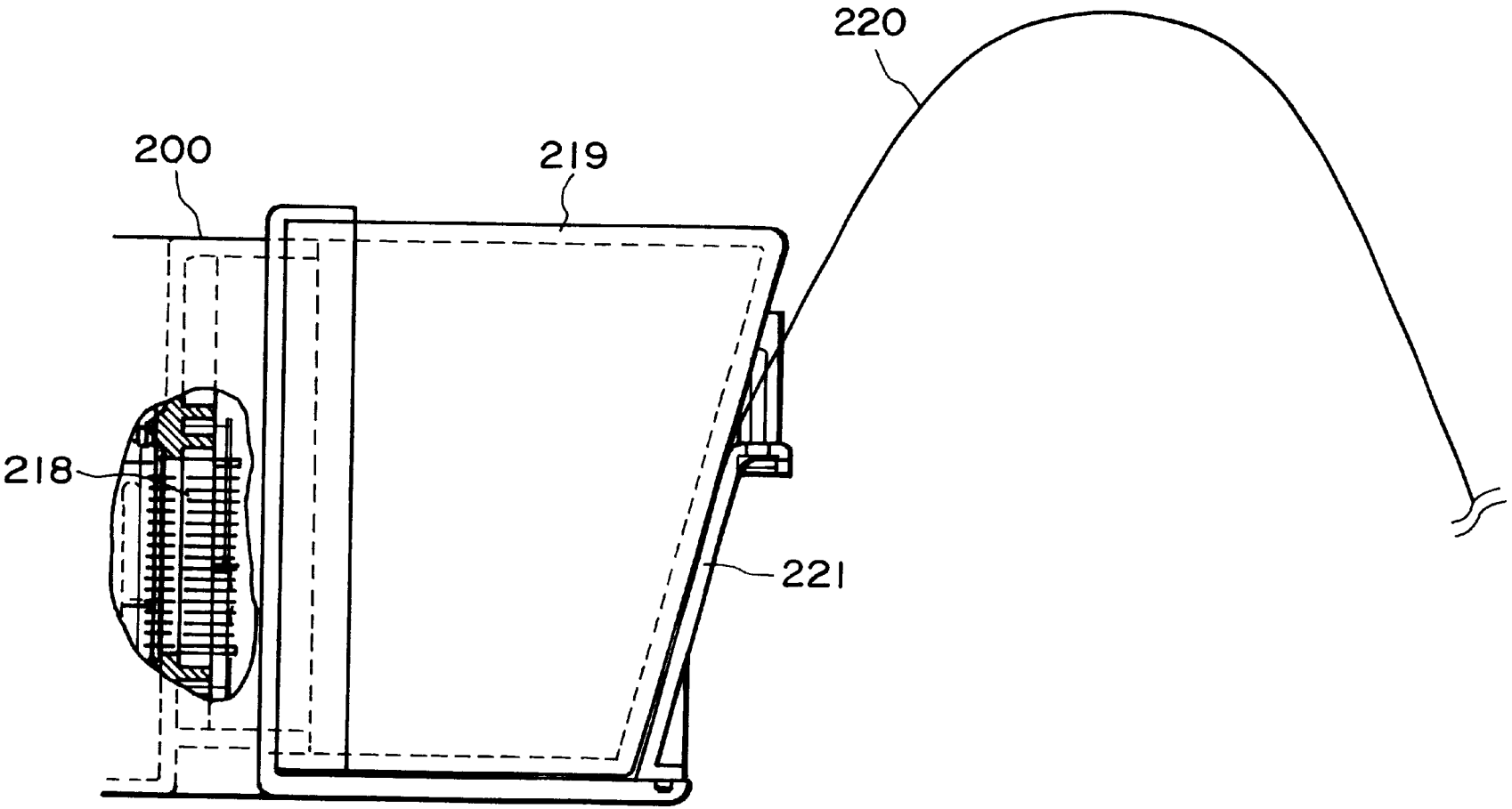
Figure 16:
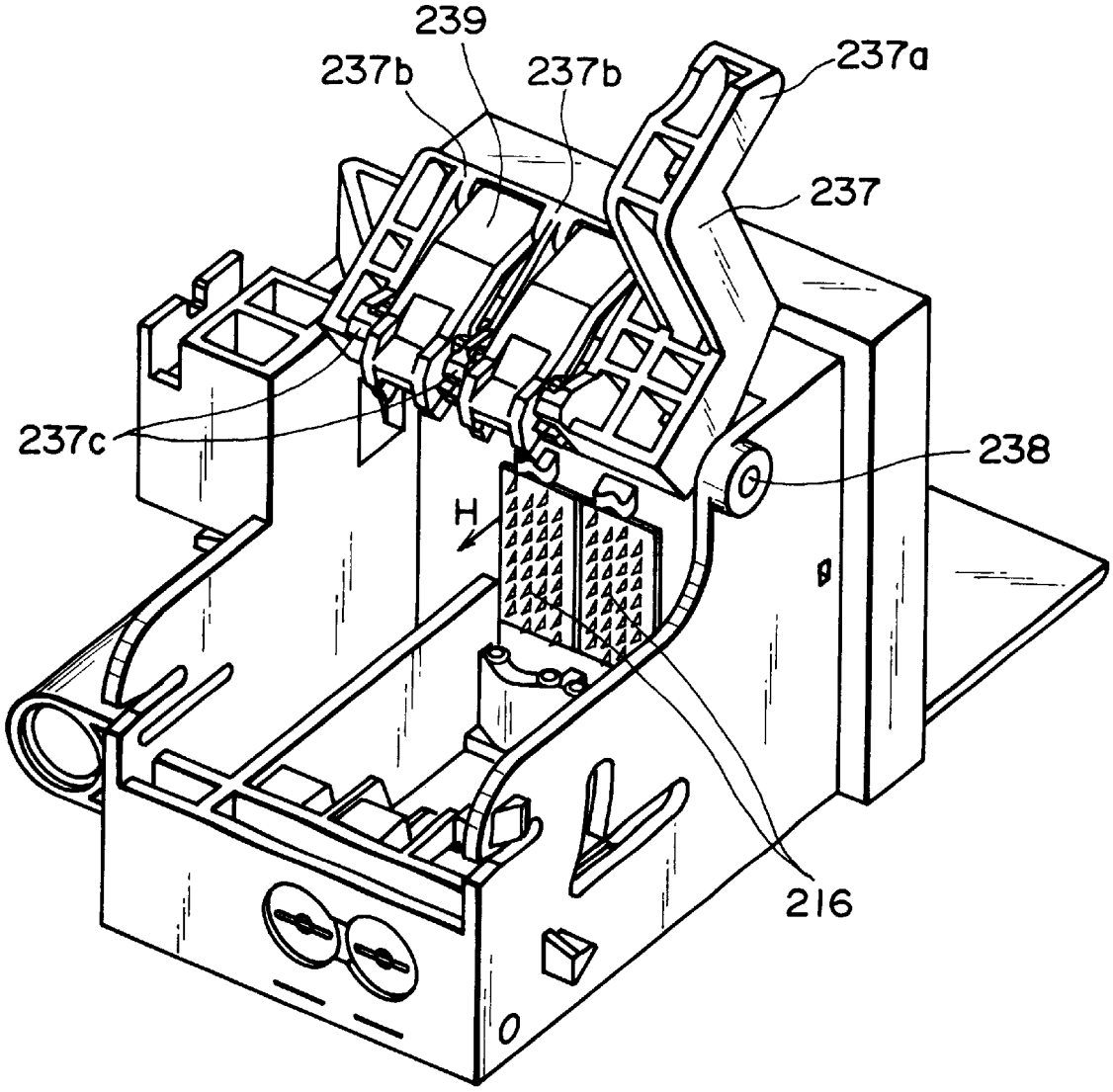
FIG. 16 is a perspective view illustrating a state image the liquid ejecting head unit is not mounted to the carriage.

Referring to FIGS. 15 and 16, on the carriage 200, circuit boards, for example, a CR printed circuit with two CR connectors 216 through which signals are exchanged between the liquid ejection head unit 401 and CR printed circuits, are mounted.

The CR connectors 216 are vertically fixed to the deep inside portion of the carriage 200 (behind the space in which the liquid ejection head unit 401 is mounted), in a manner to squarely face one of the surfaces of the liquid ejection head unit 401. The printed circuit board and the like are covered with a CR printed circuit board cover 219 as shown in FIG. 7.

To these printed circuit boards and the like, a flexible cable 200 (hereinafter, "FPC") is connected, through which electrical signals and electrical power are transmitted from a control board (unillustrated) located off the carriage 200. The FPC 220 is attached so that it extends outward of the carriage 200 through the gap between the carriage 200 and CR printed circuit board 219. It is retained by an FPC stopper 221 attached to the carriage 200 and the CR printed circuit board cover 219, being sandwiched by the CR printed circuit board cover 219 and FPC stopper 221. With this arrangement, the FPC 220 does not come out even if external force applies.

Although the FPC 220 is connected to the control board of the printing machine, as the carriage 200 moves, the distance between the carriage 200 and the control board of the print machine main assembly varies. As a result, the FPC 220 is given a sufficient length, being therefore allowed to sag. With the provision of this sagging, no matter which position the carriage 200 move to, the FPC 220 is never subjected to an excessive amount of stress.

(Carriage Structure: Recovery System Unit and Related Portions)

Figure 17:
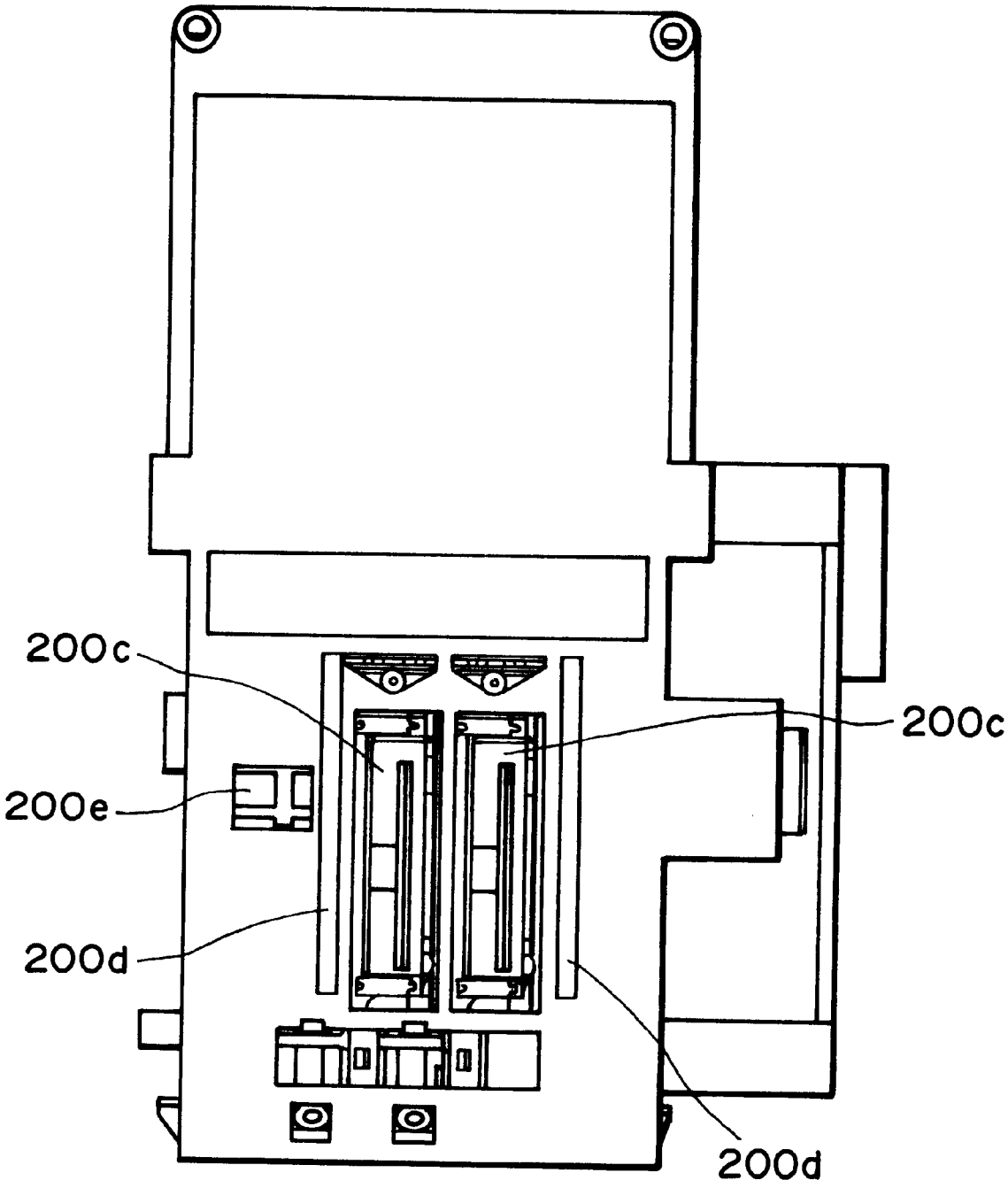
FIG. 17 is a bottom view of the carriage.
Figure 18:
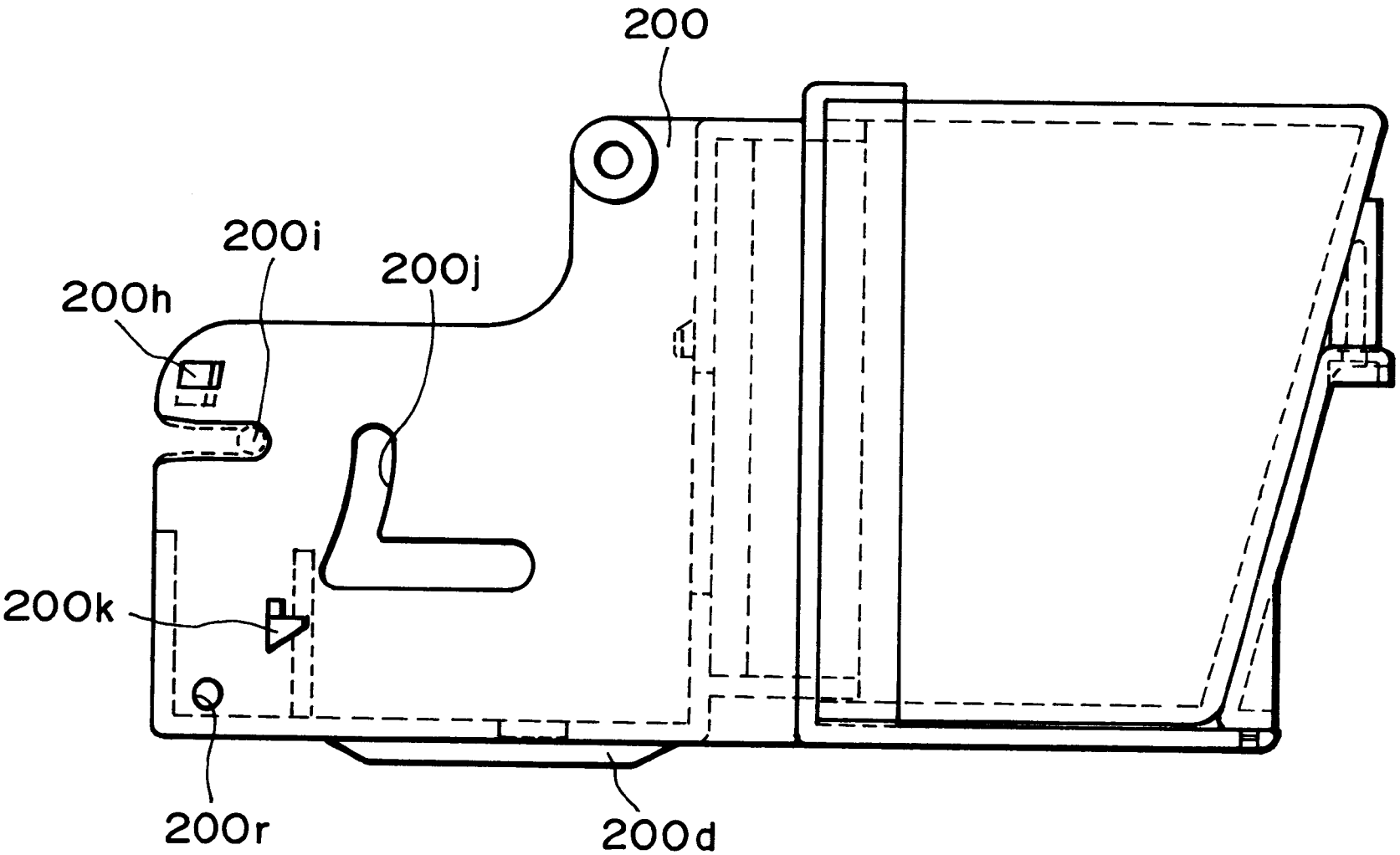
FIG. 18 is a front view of a carriage.
Figure 19:
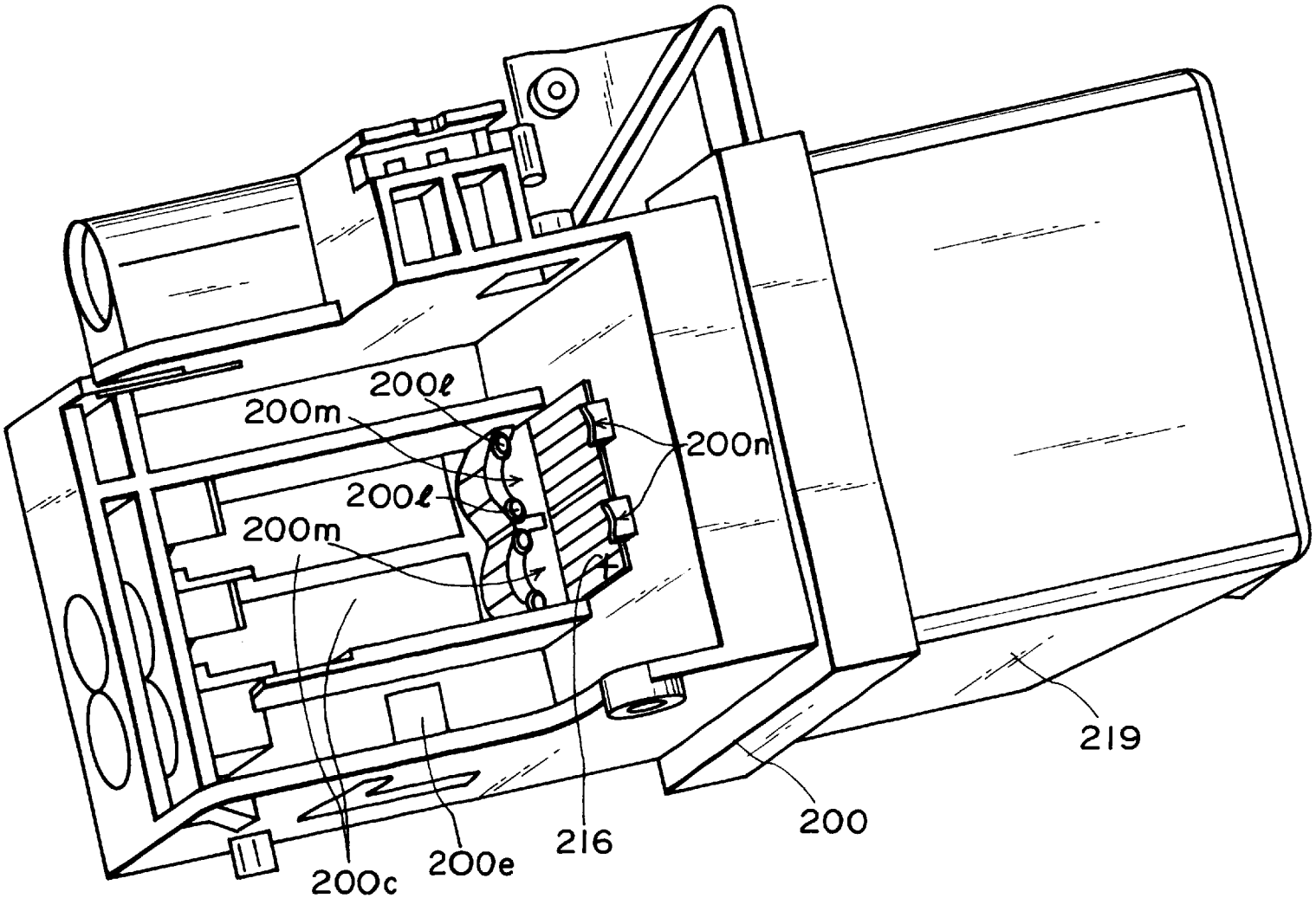
FIG. 19 is a perspective view of the carriage as seen from the top side.

Referring to FIGS. 17, 18 and 19, which are the bottom side view, and perspective views of the carriage 200, correspondingly, the bottom wall of the carriage 200 is provided with two holes 200*c* through which the nozzles of the liquid ejection head unit 401 are exposed. There are two CR blade ribs 200*d*, one being on the left side of the left hole 200*c* and the other being on the right side of the right hole 200*c*. They extend in the direction parallel to the moving direction of the carriage 200. The functions of the CR blade ribs 200*d* will be separately described in the section dedicated to the recovery system unit 300.

The bottom wall of the carriage 200 is also provided with a square hole 200*e*, which is on the right side of where the liquid ejection head unit 401 is mounted. This hole 200*e* is where the carriage lock arm 390 of the recovery system unit 300 is inserted to prevent the carriage 200 from moving due to the vibration of the entire printing machine or the like while the nozzles of the liquid ejection head unit 401 are covered with the cap 308 of the recovery system unit 300. The details of these arrangements will be separately described in the section dedicated to the recovery system unit.

(Carriage Structure: Ink Supplying Portion)

Figure 20:
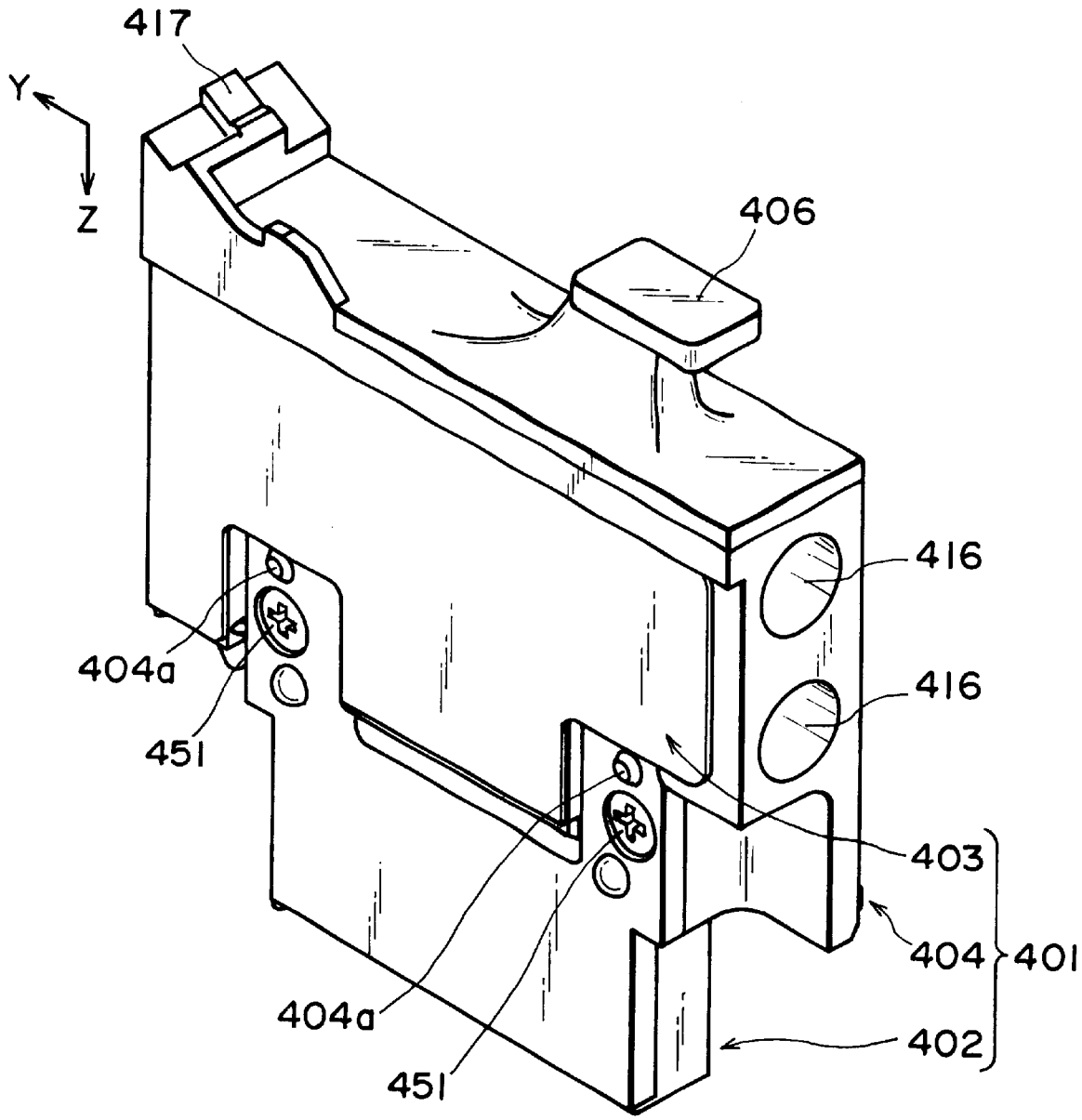
FIG. 20 is a perspective view of a liquid ejecting head unit.

Referring to FIG. 20, the front wall of the liquid ejection head unit 401 is provided with two joint rubbers 416. The tip of a CR needle 222 (FIG. 21) is inserted into the corresponding joint rubber 416, through the surface of the joint rubber 416 As the tip of the CR needle 222 penetrates into the container of the liquid ejection head unit 401, ink is supplied into the container of the liquid ejection head unit 401 from the supply system which is on the upstream side of the CR needle 222 and is connected to the CR needle 222 with the use of connecting means such as a CR rube 226.

Provided on the front side of where the liquid ejection head unit 401 is mounted on the carriage 200 is a mechanism for supplying ink to the liquid ejection head unit 401. Next, this mechanism will be described.

Figure 21:
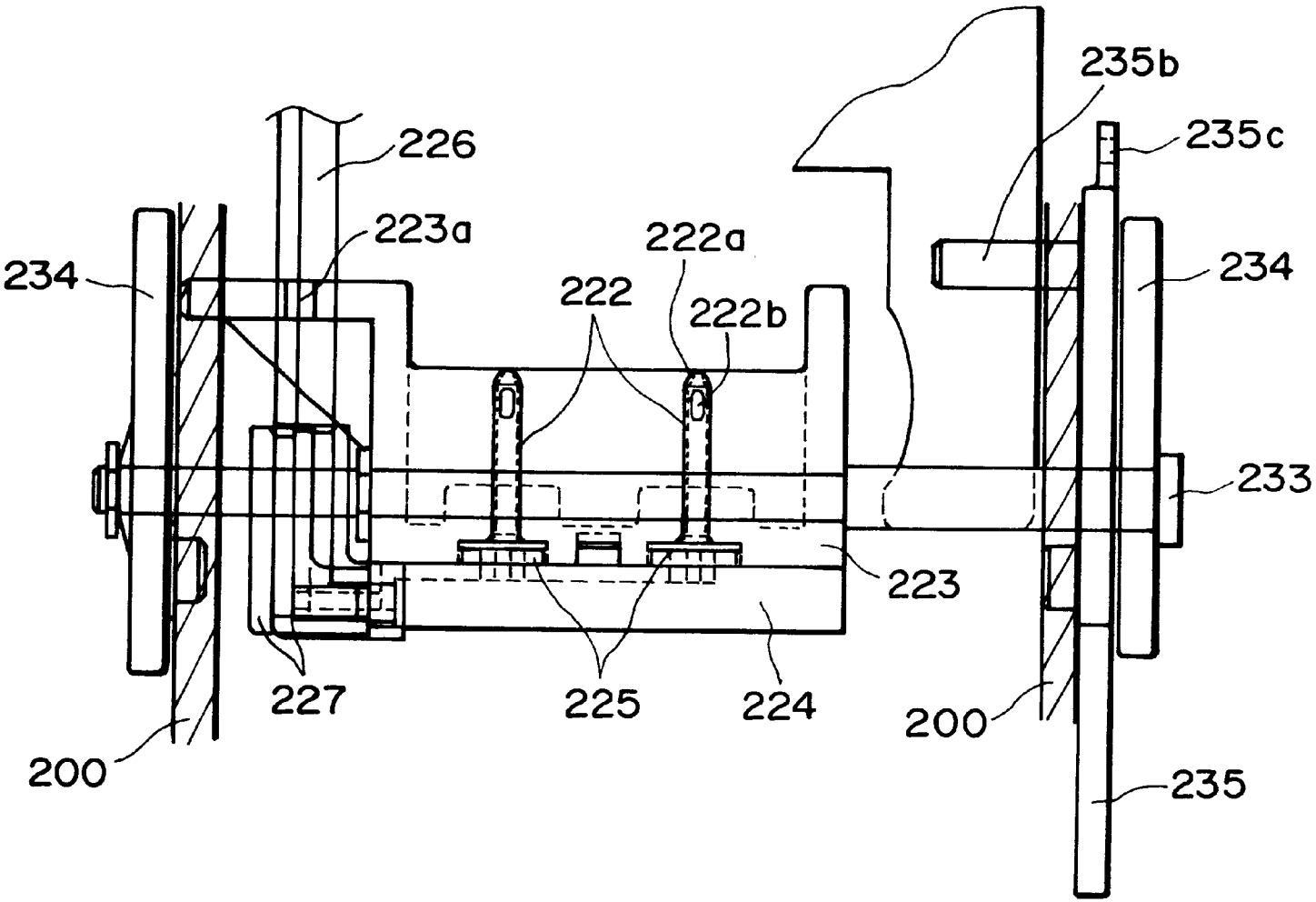
FIG. 21 is a front view of a carriage needle mounting portion.
Figure 22:
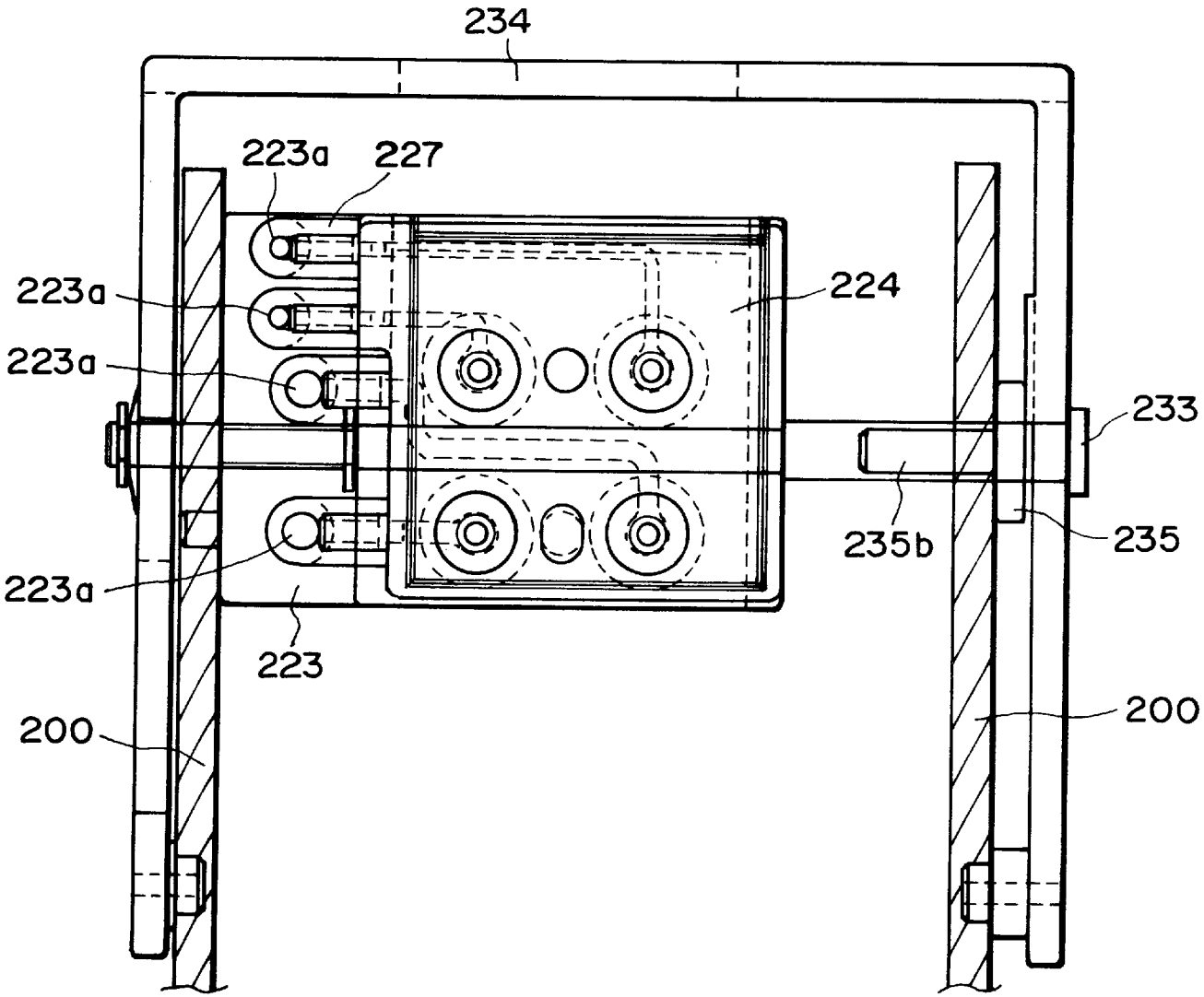
FIG. 22 is a top plan view of the carriage needle mounting portion.

First, referring to FIGS. 21 and 22, the CR needles 222 are fine hollow needles. There are four CR needles 222, being arranged in two rows in the direction from the front, or the operator side, to the front side of the liquid ejection head unit 401. The tip of each CR needle 222 constitutes a semispherical portion 222*a* which has no opening, and a virtually rectangular small hole 222*b*, which reaches from the hollow of the CR needle 222 to the surface of the CR needle 222, is located adjacent to the semispherical portion 222*a* or the tip portion of the CR needle 222. The CR needles 222 are fixed by a plastic CR joint support 223 and a plastic CR tube joint 224. The CR joint support 223 and CR tube joint 224 have been welded together, and a donut-shaped, thin CR needle seal 225 formed of rubber is inserted around the base portion of each CR needle 222 to prevent ink leakage. The CR joint support 223 and CR tube joint 224 are provided with ink flow paths, which lead to four CR needles 222 one for one, and are connected one for one to four pipe-like portions with which the CR tube joint 224 is provided.

Around each of the four pipe-like portions with which the CR tube joint 224, one end of the L-shaped, pipe-like CR joint rubber 227 is fitted, and to the other end of the CR joint rubber 27, the CR tube 226 is inserted. In other words, the CR joint rubbers 227 function as a means for connecting the CR tube joint 224 and CR tube 226.

The four CR tubes 226 are placed through the four holes 223*a* one for one provided in one of the lateral walls of the CR joint support 223: they are pressed through the holes. They are fixed so that even if the CR joint support 223, which will be described later, moves, the CR tubes 226 do not slip out of the CR joint rubber 227. Although not shown in the drawing, the four CR tubes 226 are slackened to afford the CR joint support 223 a certain amount of movement.

Further, the four CR tubes 226 are placed through the holes of an unillustrated CR tube rubber, and are fixed, along with the CR tube rubber, to the carriage 200 by being pinched between the carriage 200 and an unillustrated CR tube stopper. The four CR tubes 226 extend outward of the carriage 200. Although not illustrated, the four CR tubes 226 are combined in the form of a piece of belt, and the end of the belt, or the combined four CR tubes 226, is connected to a joint plug, with the rubber CR joint functioning as a connector. The joint plug is removably connected to the CR joint, and is also connected to the ink supply system unit.

The CR tubes 226 are slackened between the carriage 200 and ink supply system unit 10, to allow the carriage 200 to freely move. With the provision of this slack, no matter which position the carriage 200 moves to, the CR tubes are not subjected to an excessive amount of stress.

(Carriage Structure: Ink supply Joint Portions)

Next, referring to FIGS. 18 and 21–26, the mechanism for inserting or pulling the above described four CR needles 222 into or out of the liquid ejection head unit 401 will be described. In these drawings, the liquid ejection head unit 401 are not shown.

Referring to FIGS. 21 and 22, a CR joint shaft 233 is fixed to the integrally combined CR needles 222, CR joint support 223, and CR tube joint 224. Referring to FIGS. 18 and 23–26, the left and right walls of the carriage 200 are provided with a hole 200*r*, and a CR joint lever 234 pivots about the center of the hole 200*r*. The CR joint lever 234 is provided with an elongated hole 234*a*, which is located at the approximate center of the CR joint lever 234. The CR joint shaft 233 is placed through this elongated hole 234*a*, being retained so that it does not slip out of the hole 234*a*. Thus, as the CR joint lever 234 is pivoted, the CR joint shaft 233 moves frontward or rearward (between the front and rear sides) along with the CR joint lever 234, and in addition, the CR needles 222, CR joint support 223, and CR tube joint 224 move frontward and rearward (between the front and rear sides) along with the CR joint lever 234.

Figure 26:
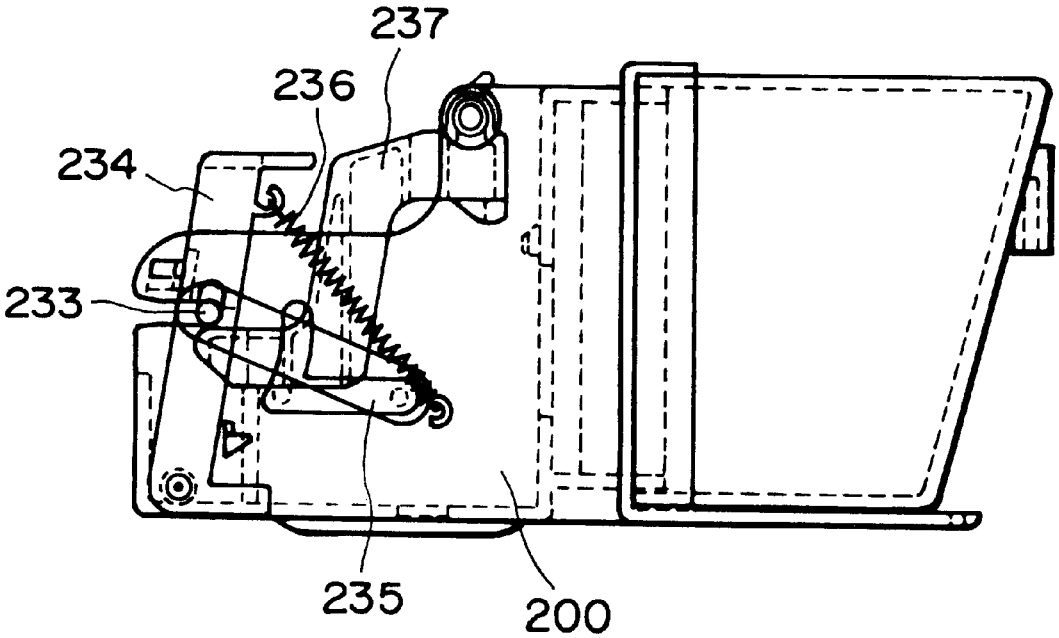
FIG. 26 is a side view illustrating a mounting process of the liquid ejecting head to the carriage.

With the above described arrangement, as the CR joint lever 234 is tiled rearward (direction indicated by an arrow mark E in FIG. 25), the CR needles 222 are inserted, one for one, into the two joint rubbers 416 provided in the front portion of the liquid ejection head unit 401. During this rearward rotation (tilting) of the CR joint lever 234, the CR joint lever 234 slides over the protrusion 200*h* of the carriage 200. Therefore, as the CR joint lever 234 is tilted rearward all the way as shown in FIG. 26, it is immovably locked there. Also during this movement of the CR joint lever 234, the CR joint shaft 233 fits into the groove 200*i* (FIG. 18) in the left wall of the carriage 200 and the groove 200*i* in the right wall of the carriage 200, being accurately positioned without any play.

As the CR joint lever 234 is tilted frontward (direction indicated by an arrow mark C in FIG. 24) over the protrusion 200*h* of the carriage 200, the CR needles 222 come out of the joint rubbers 416 provided in the operator side (front side) of the liquid ejection head unit 401. During this action, an L-shaped portion 234*c*, that is, the bottom end portion of the CR joint lever 234, makes contact with the rib 200*k* (FIG. 18) of the carriage 200, and therefore, the CR joint lever 234 stops pivoting, at this position.

Figure 23:
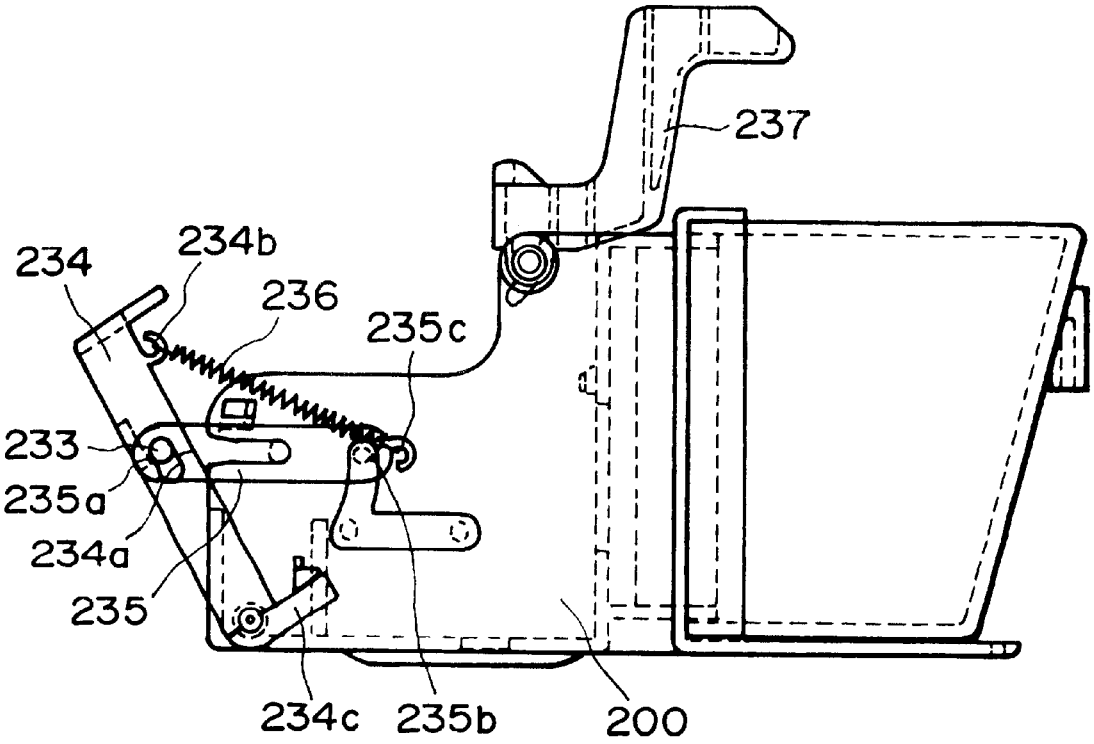
FIG. 23 is a side view illustrating a mounting process of the liquid ejecting head to the carriage.

Next, a CR joint lever stopper 235 will be described. Referring to FIG. 23, one of the longitudinal ends of the CR joint stopper 235 has a hole 235*a*. Since the CR joint shaft 233 is placed through this hole 235*a*, the CR joint lever stopper 235 moves with the CR joint lever 234. The other longitudinal end of the CR joint stopper 235 is provided with a shaft 235*b*. This shaft 235*b* is inserted into the carriage 200 through an L-shaped long hole 200*j*, which is in the right wall of the carriage 200. It is enabled to move following this L-shaped long hole 200*j*. Also, this longitudinal end of the CR joint stopper 235 is provided with a spring anchor portion 235*c*, and a CR joint lever spring 236, which is a tensional spring, is anchored to the spring anchor portion 235*c*, and also to a spring anchor portion 234*b* with which the top portion of the CR joint lever 234 is provided.

Next, a mechanism for preventing a CR lever 237 for securely holding the liquid ejection head unit 401 mounted on the carriage 200, and the CR joint lever 234 for moving the CR needles 222 to supply into ink to the liquid ejection head unit 401 on the carriage 200, from being operated in the incorrect order when the liquid ejection head unit 401 is mounted onto or dismounted from the carriage, will be described.

FIG. 23 shows the state of the carriage 200 before the mounting of the liquid ejection head unit 401. In this state, the CR lever 237, which will be described later, is in the "up" position. and the CR joint lever 234 is in the operator side position. Also in this state, the CR joint lever stopper 235 has been pulled up by the CR joint lever spring 236, and. the shaft 235*b* is in contact with the upper edge of the L-shaped long hole 200*j* of the carriage 200, preventing the CR joint leer 234 from moving. In other words, in the state in which the liquid ejection head unit 401 is not on the carriage 200, the CR needles 222 cannot be moved to where the liquid election head unit 401 is mounted, on the carriage 200.

Figure 24:
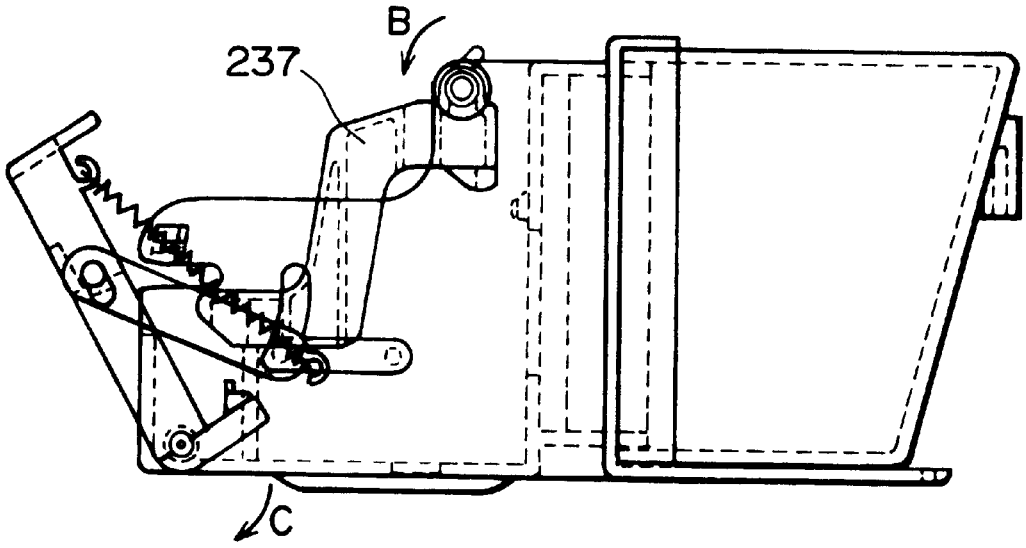
FIG. 24 is a side view illustrating a mounting process of the liquid ejecting head to the carriage.
Figure 25:
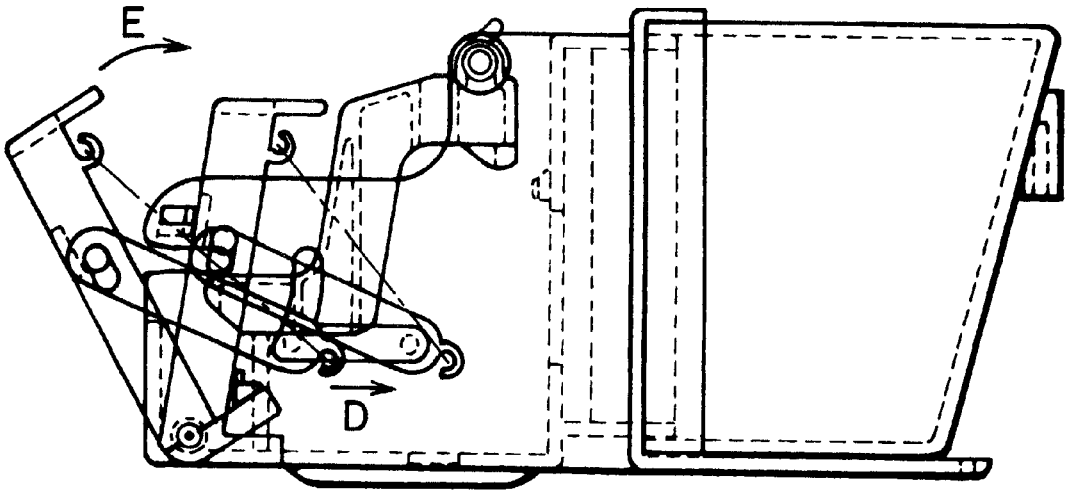
FIG. 25 is a side view illustrating a mounting process of the liquid ejecting head to the carriage.

Referring to FIG. 24, as the liquid ejection head unit 401 is installed by pivoting the CR lever 237 in the direction indicated by an arrow mark B, the shaft 235*b* of the CR joint lever stopper 235 comes into contact with the CR lever 237, and is pushed downward in the direction of the arrow mark C following the L-shaped long hole 200*j* of the carriage 200, against the force of the CR joint lever spring 236. As a result, the shaft 235*b* of the CR joint lever stopper 235 reaches the bend portion of the L-shaped hole 200*j*; being enabled to move in the direction indicated by an arrow mark D following the horizontal straight portion of the L-shaped long hole 200*j* of the carriage 200. Therefore, it becomes possible for the CR joint lever 234 to be tilted rearward (direction indicated by an arrow mark E) to insert the CR needles 222 into the liquid ejection head unit 401.

On the other hand, referring to FIG. 26, in the state in which the liquid ejection head unit 401 is securely held on the carriage 200, the CR joint lever 234 is tilting rearward, and the CR joint shaft 233 is on top of the lever portion 237*a* of the CR lever 237. Therefore, an operator is prevented from touching the lever portion 237*a*; an operator cannot operate the CR lever 237. In other words, in the state in which the liquid ejection head unit 401 is securely held on the carriage 200, and the CR needles 222 are in the liquid ejection head unit 401, the liquid ejection head unit 401 cannot be pulled.

(Carriage Structure: Liquid Ejection Head Unit Securing Portion)

Referring to FIG. 16, the rear wall of the carriage 200 is provided with a square hole, in which two CR connectors 216, through which the liquid ejection head unit 401 receives or sends signals, are fitted side by side. The CR connectors 216 are provided with a plurality of contact points which are individually movable frontward or rearward. With this structural arrangement, when the liquid ejection head unit 401 is mounted on the carriage 200, as the contact portion of the liquid ejection head unit 401 comes into contact with the contact pad 421 (for details, the latter section dedicated to the liquid ejection head unit 401 should be referenced), the contact points of the CR connectors 216 retract while generating reactive force which works in the direction indicated by an arrow mark H to push back the contact portion of the liquid ejection head unit 401.

The CR lever 237 is rotationally supported by the CR lever shaft 238, which is supported by the top portion of the left wall of the carriage 200 and the top portion of the right wall of the carriage 200. This CR lever 237 is provided with the lever portion 237*a* for rotationally moving the CR lever 237.

Figure 55:
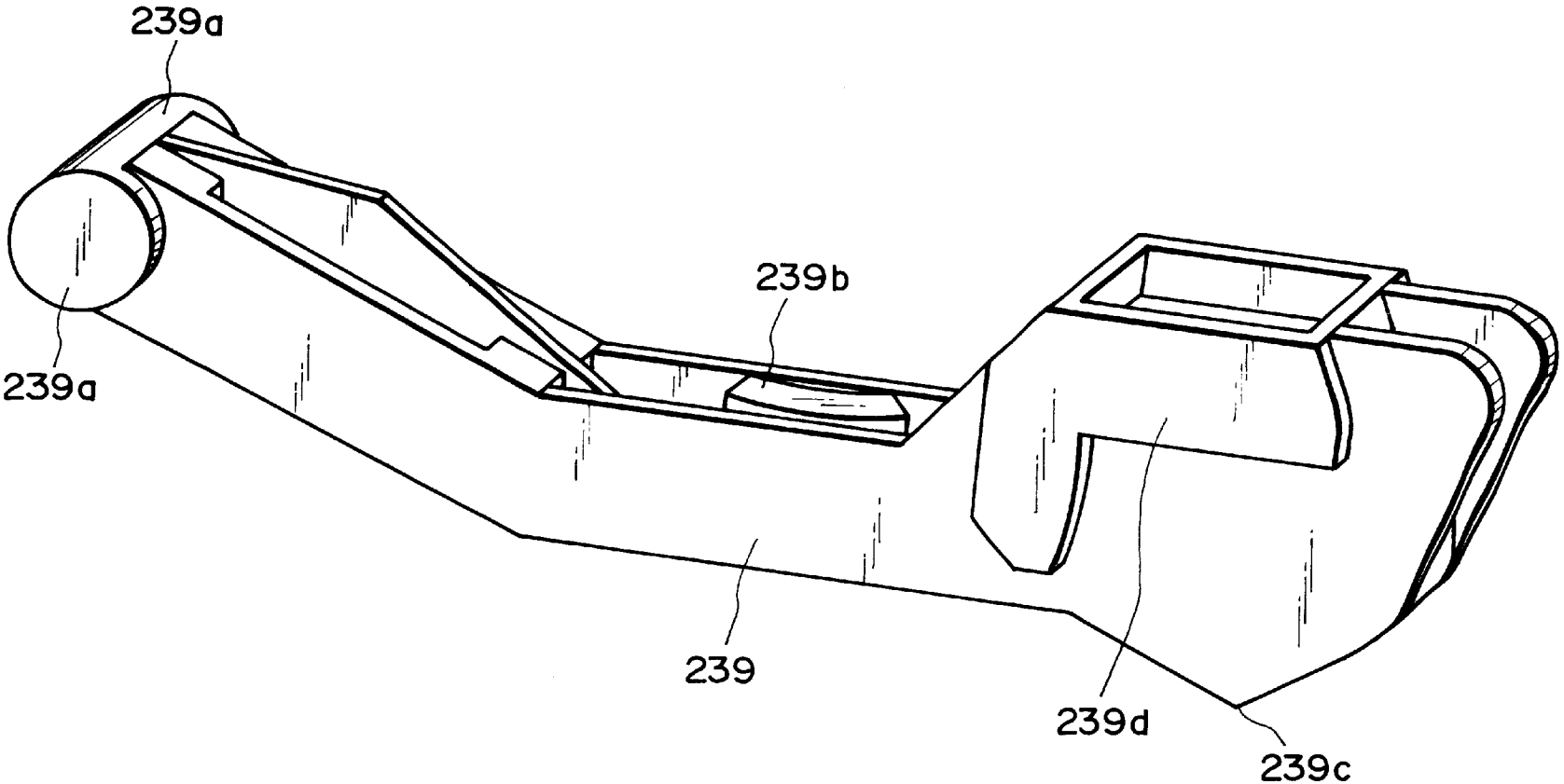
FIG. 55 is an enlarged view of a head set plate.

Held at the center portion of the carriage 200 are two head set plats 239 such as the one illustrated in FIG. 55. One head set plate 239 is provided for each liquid ejection head unit 401. Since this carriage 200 is structured to carry two liquid ejection head units 401, it is provided with two head set plates 239. The numbers of the liquid ejection head units 401 and head set plats 239 may be varied as necessary according to the design.

Each head set plate 239 is provided with a shaft 239*a*, which extends in the left to right direction from the rear portion of the head set plate 239. The shaft 239*a* fits in the U-shaped catch to allow the head set plate 239 to rotationally move about the shaft 239*a*. Further, the center portion of the head set plate 239 is provided with a spring anchor portion 239*b*, and an unillustrated CR set plate spring 240, which is a compression spring, is set between this spring anchor portion 239*b*, and an unillustrated spring anchor portion located on the back side of the CR lever 237. With the function of this CR set plate spring 240, when the CR lever 237 is in the set position, force is applied to the head set plate 239 in the direction to rotate the head set plate 239 down- and rear-ward about the shaft 239*a* extending in the left and right direction from the rear portion of the head set plate 239. Therefore, in the state in which the liquid ejection head unit 401 is securely set, the liquid ejection head unit 401 is kept pressed down- and rear-ward by the head set plate 239. However, in order to prevent the head set plate 239 from becoming disengaged from the cR lever 237 when the liquid ejection head unit 401 is not set, the CR lever 237 is provided with a portion 237*c* for catching the ribs 239*d*, which are located on the left and right sides of the end portion of the head set plate 239.

Referring to FIG. 19, the bottom surface of the carriage 200 is provided with a total of four bosses 2001, that is, two for each liquid ejection head unit 401. These bosses 2001 are structured so that when each liquid ejection head unit 401 is in the carriage 200, a set of two bosses (for details, the latter section dedicated to the liquid ejection head unit 401 should be referenced) on the bottom surface of the liquid ejection head unit 401 makes contact with the these bosses 2001 one for one. This arrangement determines the vertical position of the liquid ejection head unit 401 in the carriage 200 Further, the bottom surface of the carriage 200 is provided with a total of two U-shaped rib-like portions 200*m*, that is, one for each liquid ejection head unit 401. These U-shaped rib-like portions 200*m* are structured so that when each liquid ejection head unit 401 is in the carriage 200, the side surface of the boss on the bottom surface of the liquid ejection head unit 401 remains in contact with the rib-like portion 200*m*.

Figure 56:
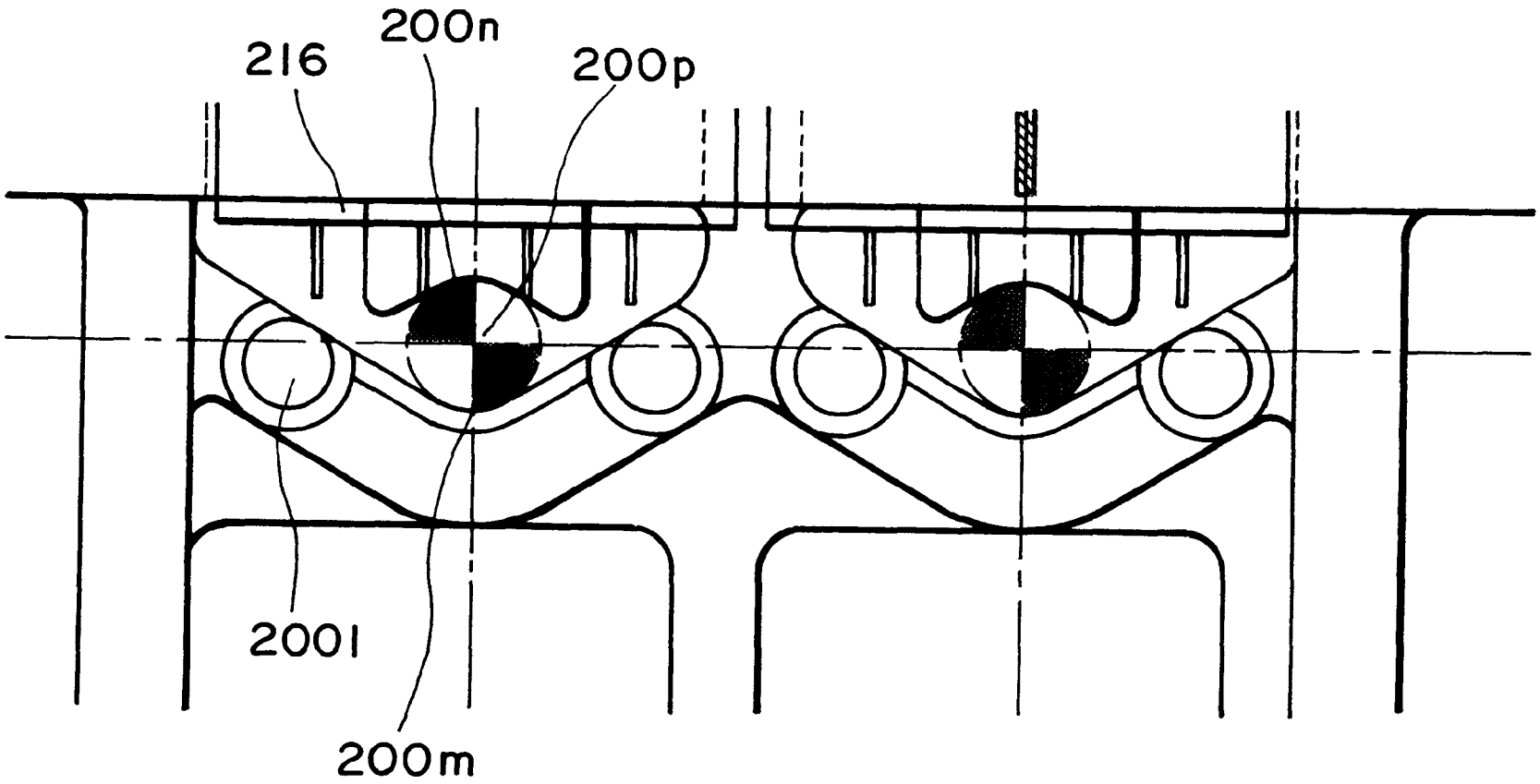
FIG. 56 is a top plan view illustrating a rib of a carriage connector.

The carriage 200 is also provided with a set of U-shaped rib-like portions 200*n*, which are different from the aforementioned U-shaped rib-like portion 200*m*. These U-shaped rib-like portions 200*n* are on the vertical surface of the carriage 200, behind the CR connectors 216, and squarely face the U-shaped rib-like portions 200*m* one for one. Being seen from above the carriage 200, these portions and their adjacencies are structured as illustrated in FIG. 56. In other words, a virtual cylindrical space 200*p* is formed between the U-shaped rib-like portion 200*m* on the bottom surface of the carriage 200, and the U-shaped rib-like portion 200*n* on the vertical wall of the carriage 200. When the liquid ejection head unit 401 is in the carriage 200, the semispherical projection (for details, the latter section dedicated to the liquid ejection head unit 401 should be referenced) on the top portion of the contact pad 421 of the liquid ejection head unit 401, which is on the rear side of the liquid ejection head unit 401, remains in contact with the this U-shaped rib-like portion 200*n* on the vertical surface of the carriage 200.

Figure 57:
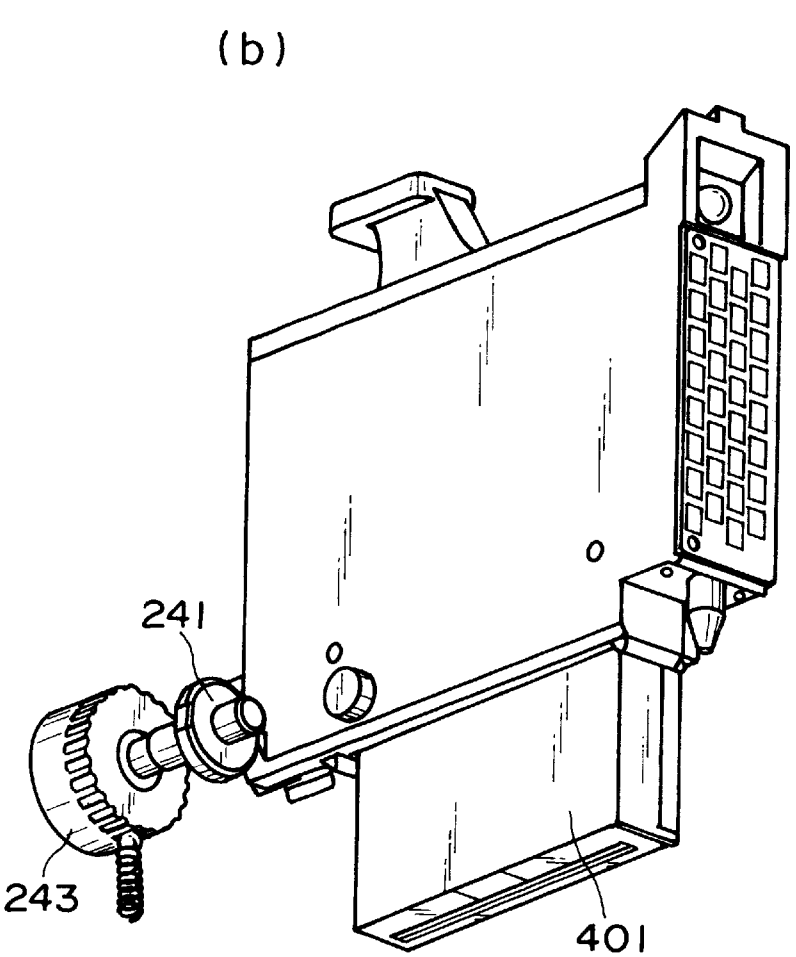
FIG. 57 is a perspective view of a rotational direction adjusting mechanism for a liquid ejecting head.
Figure 57:
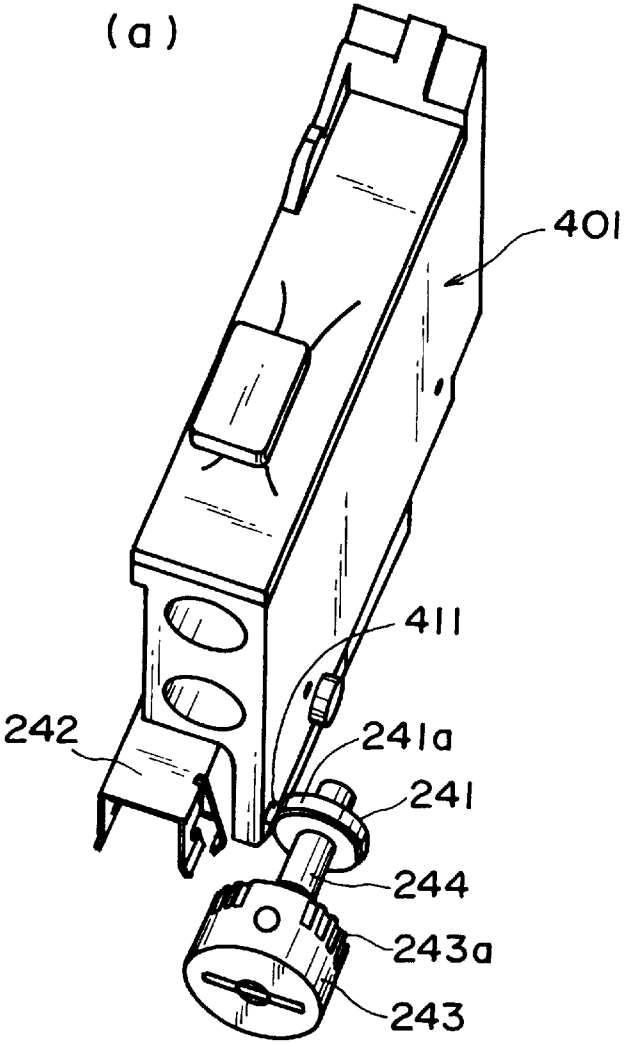

Referring to FIG. 57, there is a mechanism for adjusting the rotational angle (angles of nozzle rows of the liquid ejection head) of the liquid ejection head unit 401 (for details, the latter section dedicated to the liquid ejection head unit 401 should be referenced), on the operator side of the carriage 200. This mechanism comprises a CR head spring 242, which is a leaf spring, and a CR head cam 241. The CR head cam 241 is structured so that the position of the contact point of the left side of the peripheral surface 241*a* can be minutely adjusted by rotating the CR head cam 241. With this arrangement, the rotational angle of the liquid ejection head unit 401 is adjusted. The CR head spring 242 is set up so that it pushes the surface of the liquid ejection head unit 401, which is on the opposite side of the surface of the liquid ejection head unit 401 with which the left side of the peripheral surface 241*a* of the CR head cam 241 makes contact, toward the CR head cam 241. The portion of the liquid ejection head unit 401, with which the left side of the peripheral surface 241*a* of the head cam 241 makes contact, is provided with a trapezoidal projection 411. This portion determines the position of the liquid ejection head unit 401 in terms of its rotational angle (angles of the nozzles of the head).

Figure 61:
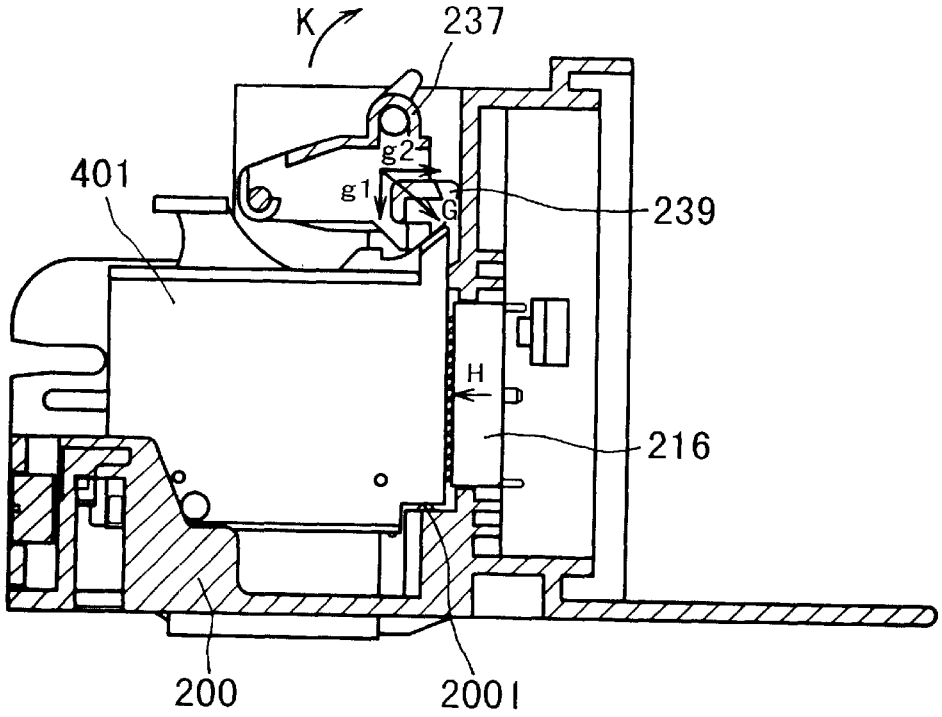
FIG. 61 illustrates a mounting-and-demounting operation of a head to a carriage.
Figure 62:
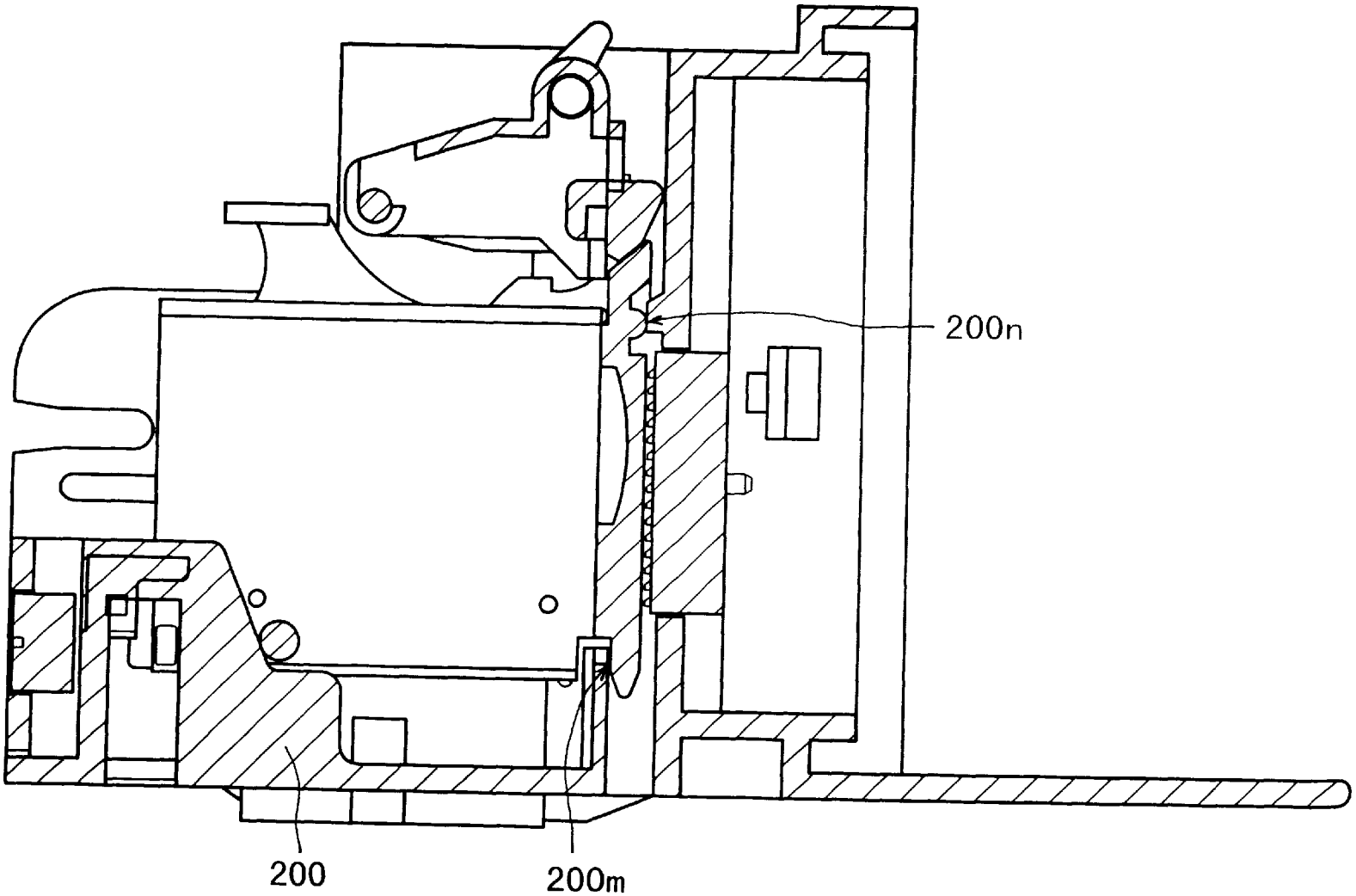
FIG. 62 is a sectional view of a carriage to which the head is mounted.

With the provision of the above described structure, the vertical position of the liquid ejection head unit 401 in the carriage 200 is determined by the downward component g1 of the force from the head set plate 239, and the contact between the two trapezoidal bosses 2001 with a flat top surface on the bottom surface of the carriage 200, and the two bosses on the bottom surface of the liquid ejection head unit 401, as shown in FIGS. 61 and 62.

The liquid ejection head unit 401 position in terms of the front-rear direction and the left-right direction is determined by the contact between the U-shaped rib-like portions 200*m* on the bottom surface of the carriage 200 and the contact portion on the lateral surface of the boss on the liquid ejection head unit 401, contact between the U-shaped rib-like portions 200*n* on the vertical wall of the carriage 200 on the rear side and the semispherical contact portion of the liquid ejection head unit 401 above the contact portion of the liquid ejection head unit 401 on the rear side, and the balance between the reactive force II generated by the CR connectors 216 toward the operator side and the down- and rearward force g2 applied to the head set plate 239 by the CR set plate spring 240 anchored to the CR lever 237. In other words, in this embodiment, the liquid ejection head unit 401 position in terms of the front-rear direction and left-right direction is fixed with respect to the center of the virtual cylindrical space created by the mutually facing two sets of the U-shaped rib-like portions 200*m* and 200*n* on the bottom surface aid vertical rear wall, respectively, of the carriage 200 as shown in FIG. 56.

As described above, the liquid ejection head unit 401 is enabled to rotate about the center of the virtual cylindrical space 200*p* created by the mutually facing two sets of U-shaped rib-like portions 200*m* and 200*n* on the bottom surface and rear wall, respectively, of the carriage 200, and the liquid ejection head unit 401 position in terms of its rotational direction (angle of the nozzles of the head) is fixed as the trapezoidal projection 411 on the bottom and operator side of the liquid ejection head unit 401 is inserted between the left side of the peripheral surface 241*a* of the CR head cam 241 on the operator side portion of the carriage 200 and the CR head spring 242.

(Carriage Structure: Mechanism for Adjusting Rotational Angle of Liquid Projection Head Unit)

Referring to FIG. 57, the mechanism for adjusting the angle of the liquid ejection head unit 401, which is on the operator side portion of the carriage 200, and which was described in the section dedicated to the aforementioned portion for securing the liquid ejection head unit 401, will be further described in detail.

The mechanism for adjusting the angle of the liquid ejection head unit 401 is rotationally supported by the two pairs of bearing-shaped portions on the operator side portion of the carriage 200. This head unit angle adjusting mechanism comprises the CR head cam 241, a CR head dial 243 for rotating the CR head cam 241, and a CR head shaft 244. The CR head cam 241 has a D-shaped hole in the center. The CR head dial 243 has a plurality of grooves 243*a*, which are placed with equal intervals on the peripheral surface. It also has a D-shaped hole in the center. The CR head shaft 244 connects the CR head cam 241 and CR head dial 243, and is D-shaped in cross section. Although not illustrated, this mechanism is provided with a spring loaded small steel ball, which is positioned to engage into one of the grooves 243*a* on the peripheral surface of the CR head dial 243. With this structural arrangement, the small steel ball clicks into the next groove each time the CR head dial is rotated a given degree of angle, so that the CR head dial 243 can be secured at a predetermined rotational angle.

With the provision of the above described structure, as the CR head dial 243 is rotated, clicking at a given angular interval, the CR head cam 241 is rotated through the CR head shaft 244, causing the position of the left side of the peripheral surface 241*a* of the CR head cam 241 to moves minutely. During this movement, the trapezoidal projection 411 on the bottom and operator side portion of the head unit 401 is in contact with the left side of the peripheral surface 241*a* of the CR head cam 241, being pressed thereupon by the CR head spring 242 on the carriage 200, which is a leaf spring.

As the left side of the peripheral surface 241*a* of the CR head cam 241 is minutely moved by the rotation of the CR head cam 241, the trapezoidal projection 411 on the operator side of the bottom portion of the liquid ejection head unit 401 moves by the amount correspondent to the amount of the rotation of the CR head cam 241, causing the liquid ejection head unit 401 to pivot about the center of the virtual cylindrical space 200*p* created by the U-shaped rib-like portions 200*m* and 200*n* on the bottom surface and vertical rear wall, respectively, of the carriage 200. Thus, the angle of the liquid ejection head unit 401 (angles of the nozzles of the head, from which ink is ejected) can be adjusted as necessary by adjusting the amount by which the CR head dial 243 is rotated. In this embodiment, this adjustment mechanism is provided on each liquid ejection head unit 401, allowing the angle of the set of ink ejecting nozzles of the each liquid ejection head unit 401 to be minutely adjusted independently from the other head unit 401.

(Carriage Structure: Order of Liquid Ejection Head Unit Installation Steps)

Next, referring to FIGS. 58–62, the order of liquid ejection head unit installation steps will be described.

Figure 58:
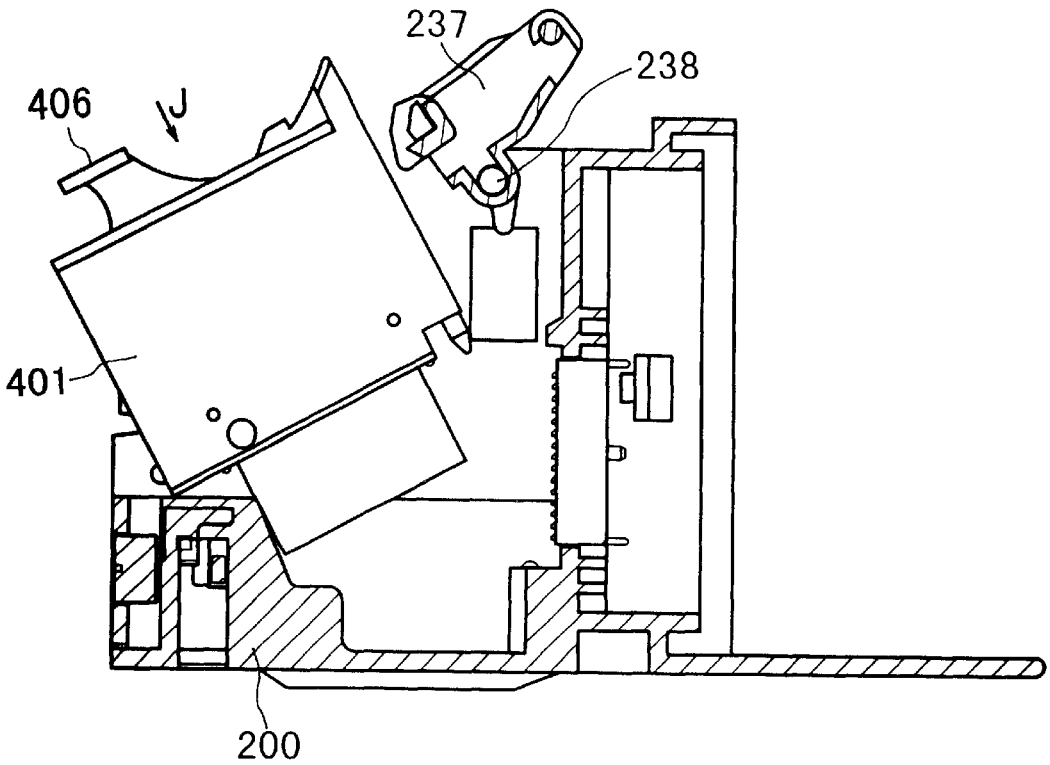
FIG. 58 illustrates a mounting-and-demounting operation of a head to a carriage.

First, referring to FIGS. 58, the carriage 200 is to be prepared for liquid ejection head unit insertion, by rotating the CR lever 237 about the CR lever shaft 238 supported by the left and right plates of the carriage 200. In this state, the liquid ejection head unit 401 is inserted into the carriage 200 from the operator side of the carriage 200, in the direction indicated by an arrow mark J, by grasping the knob 406 on the top surface of the liquid ejection head unit 401 so that the nozzles face diagonally downward.

Figure 59:
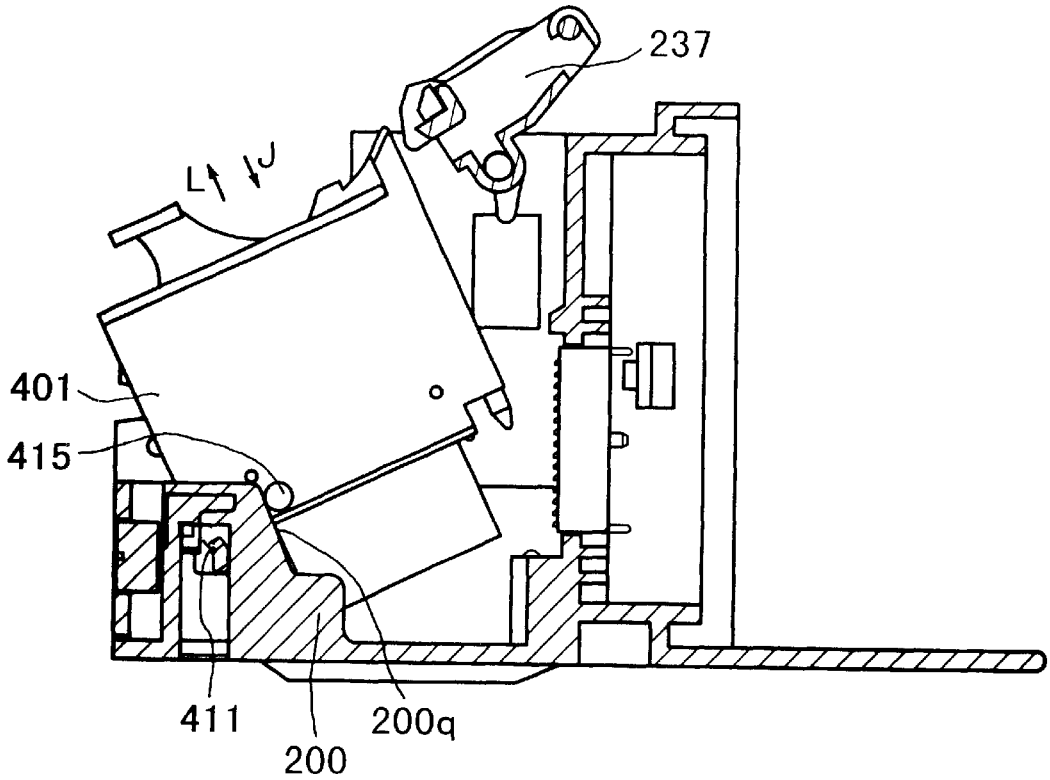
FIG. 59 illustrates a mounting-and-demounting operation of a head to a carriage.

Referring to FIG. 59, as the liquid ejection head unit 401 is inserted, the side wall of the columnar projection 415 on the right surface of the liquid ejection head unit 401 makes contact with the guide portion 200*q* for guiding the head unit insertion, which is on the carriage wall on the right side of the head unit installation space. As the liquid ejection head unit 401 is further inserted, it settles into the head unit installation space in the carriage 200, with the columnar projection 415 being guided by the guide portion 200*q*, and the trapezoidal projection 411 on the operator side of the bottom portion of the liquid ejection head unit 401 is inserted between the CR head cam 241 (FIG. 57, (*a*)) and CR head spring 242 (FIG. 57, (*a*)).

Figure 60:
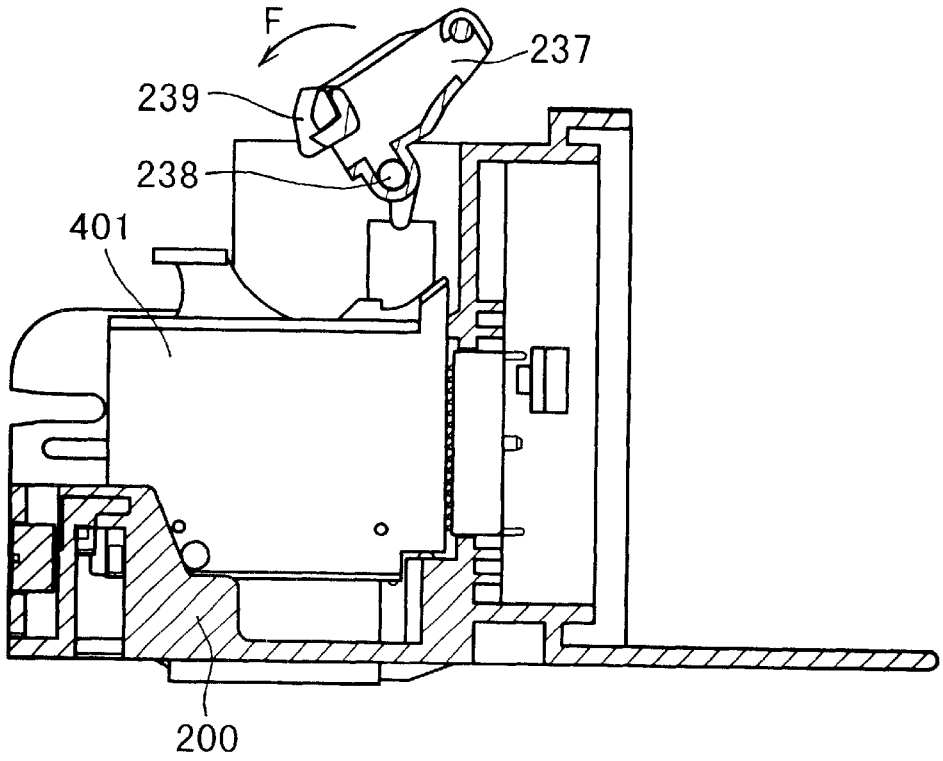
FIG. 60 illustrates a mounting-and-demounting operation of a head to a carriage.

After the liquid ejection head unit 401 settles in the head unit installation space of the carriage 200, the CR lever 237 is rotated about the CR lever shaft 238 in the direction indicated by an arrow mark F as shown in FIG. 60. This action causes the tip portion 239*c* (FIG. 55) of the head set plate 239 held by the CR lever 237 to press the liquid ejection head unit 401 diagonally downward toward the rear.

With this action, the liquid ejection head unit 401 is secured in the head unit installation space in the carriage 200, as shown in FIGS. 61 and 62, completing the attachment of the liquid ejection head unit 401 into the carriage 200.

(Carriage Structure: Order of Liquid Ejection Head Unit Removal Steps)

The order of the steps for removing the liquid ejection head unit 401 from the carriage 200 is reverse to the above described order of the liquid ejection head unit installation steps.

First, in the state illustrated in FIGS. 61 and 62, in which the liquid ejection head unit 401 is securely held in the head unit installation space in the carriage 200, an operator is to rotate the CR lever 237 in the direction indicated by an arrow mark K about the CR lever shaft 238 to remove the pressure applied to the liquid ejection head unit 401 by the tip portion 239*c* of the head set plate 239.

As the pressure is removed, the liquid ejection head unit 401 is pressed toward the operator by the reactive force H from the CR connectors 216 on the carriage 200, which is directed toward the operator. As a result, the lateral surface of the columnar projection 415 of the liquid ejection head unit 401 comes into contact with the guide portion 200*q* of the carriage 200, causing the liquid ejection head unit 401 to tilt as shown in FIG. 59.

In this state, the operator is to pull the liquid ejection head unit 401 in the direction indicated by an arrow mark L in FIG. 59, by grasping the knob 405 of the liquid ejection head unit 401. With this action, the liquid ejection head unit 401 completely comes out of the carriage 200.

[Recovery Unit]

Next, the recovery unit 300 will be described. The recovery unit 300 is provided to solve a problem of ejection failure, or aiming error (ink droplets are ejected in abnormal directions and land off target), which occurs as the dust adheres to the adjacencies of the nozzles of the liquid ejection head unit 401, or the ink increases its viscosity by drying after adhering to the interiors of the nozzles or the nozzle equipped surface 401*a*.

Essentially, there are three ejection performance recovery means, which the recovery system unit 300 in this embodiment possesses.

One of the three means is a secondary ejection means, which causes the liquid ejection head unit 401 to eject ink through all nozzles to discharge the aforementioned ink with increased viscosity in the nozzles or in the adjacencies of the nozzles. It is also used to discharge foreign inks, that is, the wrong ink which enter the nozzles if a printing apparatus is enabled to eject inks of different types. It is activated during a non-printing period to cause the liquid ejection head unit 401 to eject ink into a predetermined portion provided in the recovery system unit 300. The discharged ink is sent to a waste ink container.

Another of the three means is a wiping means, which is provided to remove ink or ink mist, which adheres to the liquid ejection head unit surface in which the nozzles are located. As for the ink mist which adheres to the nozzle equipped surface, there are mist which are ejected together with the main ink drops elected for printing, and mist which is created as the main ink droplets land on printing medium. The wiping means works in coordination with a suction based recovery means which will be described later. It comprises a blade 303 and the like, formed of elastic material such as rubber.

The last means is a suction based recovery means, which comprises a cap 308 formed of elastic material such as rubber, a pumping means, and the like. In operation, the cap 308 is tightly fitted over the nozzle equipped surface 401*a* of the liquid ejection head unit 401, and the internal pressure of the cap 308 is reduced below the atmospheric pressure by the pumping means, to force the ink to be discharged through the nozzles, so that elements such as the dust, dried ink, bubbles, and the like, which are lodging in the nozzles, are discharged by the ink flow. The ink which was suctioned out is set to the waste ink container to be processed.

Next, the structure of the recovery system unit 300 in this embodiment will be described detail.

Figure 27:
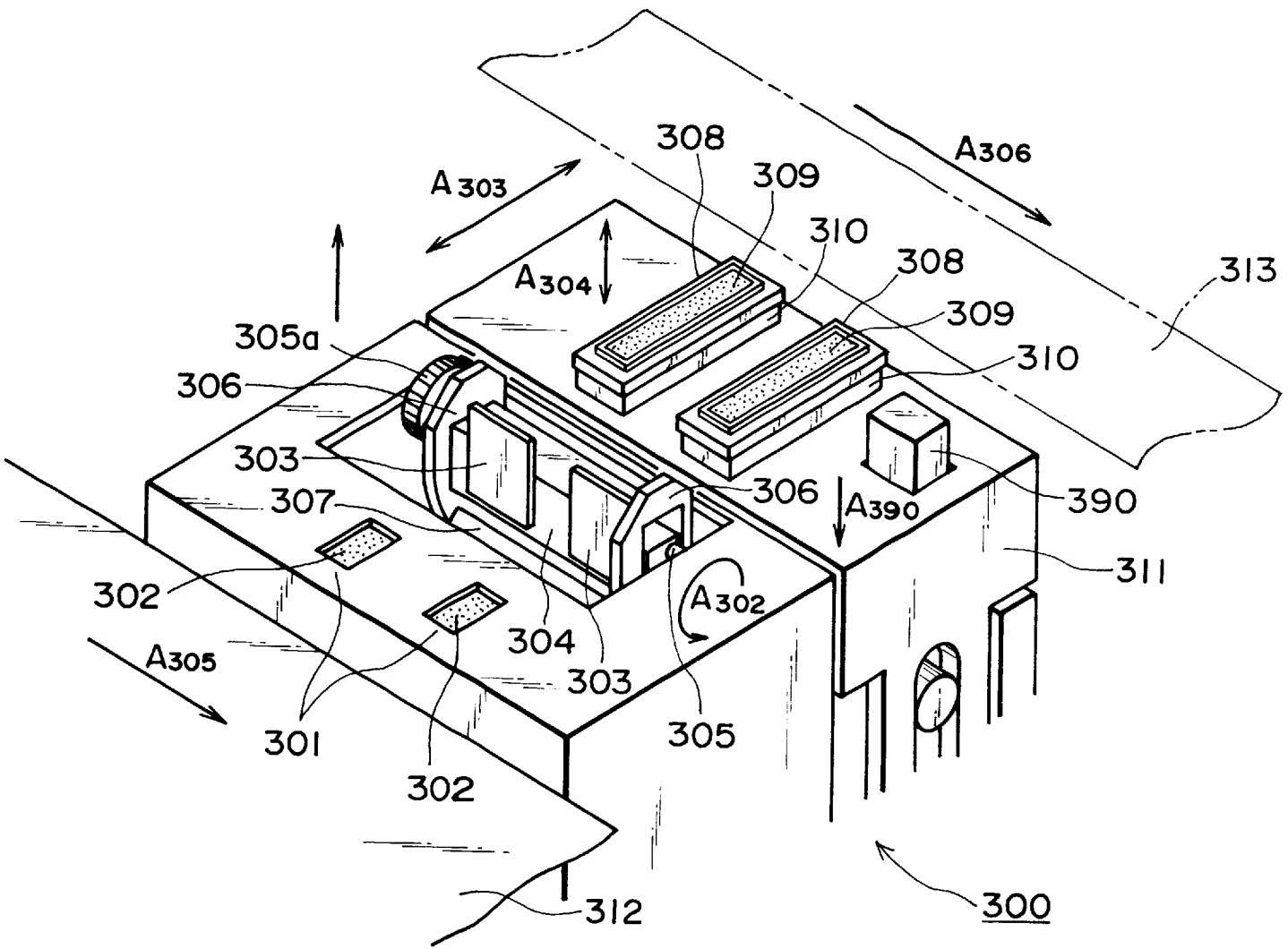
FIG. 27 is a perspective view of a refreshing system unit.

FIG. 27 is an external perspective view of the recovery system unit 300. The recovery system unit 300 is fixed to the CR frame 201, to which members such as the CR shaft 202 placed through the carriage to guide the scanning movement of the carriage 200 are also attached. Thus, it is assured that the recovery system unit 300 is precisely positioned relative to the carriage 200 and liquid ejection head unit 401.

The dimension of the secondary ejection openings 301 (second ejection catching opening) in terms of the nozzle row direction of the liquid ejection head unit 401 is smaller than the overall length of the nozzle row of the liquid ejection head unit 401. Thus, in a secondary ejection operation, it does not occur that all nozzles are caused to eject ink at the same time. Instead, the nozzles are divided into a plurality of small groups, which are activated in order. This arrangement is made to reduce the size of the recovery system unit 300. In addition, in this embodiment, in order to prevent the time for secondary ejection from being increased by making the nozzles eject ink in a small group, a so-called scanning secondary ejection method is employed: secondary ejection is carried out while moving the carriage 200 in a scanning manner. More specifically, a total of 616 nozzles with which the liquid ejection head unit 401 is provided are divided into a total of, for example, ten blocks: nine blocks, each of which comprises 62 nozzles, and another block, which comprises 58 nozzles. It is assumed that the number of the secondary ejections of each nozzle is 200; ejection frequency is 8 kHz, and nozzle pitch is 600 dpi. If ink is ejected in order, starting from the most upstream nozzle block in terms of the carriage advancement direction, while moving the carriage 200 at a constant velocity of 105 mm/sec, ink lands within a range exactly twice the range required to place 62 nozzles, that is, a distance of approximately 5.25 mm. Thus, in this embodiment, the length of the secondary ejection opening 301 was set at 8 mm which is slightly longer than the aforementioned ink landing range. In other words, the length of the secondary ejection opening 301 is no more than ⅓ of the length of the nozzle row, which is approximately 26 mm. There is provided an absorbing member 302, a porous resinous member, for absorbing the ink ejected for a recovery operation, in the secondary ejection opening 301, to hold the ink ejected for a recovery operation, so that the ejected ink is completely recovered through the secondary ejection opening suctioning process, which will be described later.

It is not necessary for the carriage 200 to be always in constant scanning motion during the aforementioned scanning secondary ejection. For example, in order to reduce processing time, the secondary ejection may be carried out while the carriage 200 is within the ramp-up or ramp-down regions of the carriage 200.

Further, instead of continuously ejecting ink while moving the carriage 200 in a scanning manner as described above, the secondary ejection may be intermittently carried out while the carriage 200 is standing still: the carriage 200 is intermittently moved so that each time the carriage 200 stops, each nozzle block sequentially stops exactly above the secondary ejection opening 301, and ink is ejected a predetermined number of times from the nozzle block above the secondary ejection opening 301.

The blade 303 is a piece of flat plate formed of elastic material such as rubber. One blade 303 is provided for each of the two liquid ejection head units 401. This double blade structure is effective for preventing the problem caused by the difference in the position of the nozzle equipped surface 401*a* between the two liquid ejection head units 401, and/or the problem which might occur if the ink ejected from one of the two liquid ejection head units 401 is different from the ink ejected from the other, and the two inks mix. The blades 303 are fixed to a blade holder 304, which is kept under the pressure generated by a blade spring in the upward direction (direction indicated by an arrow mark $A_{301}$) with respect to the blade shaft 305 integral with a blade gear 305*a*. The blade spring will be described later. The blade shaft 305 is rotatable in the direction of an arrow mark $A_{302}$ by a blade driving means, which will be described later. Therefore, the blade cam 303 connected to the blade shaft 305 is also rotatable in the same direction. In addition, the blade holder 304 is provided with a blade cam 306 which is integral with the blade holder 304. During a wiping operation, as the carriage 200 moves over the wiping means in the direction of an arrow mark $A_{303}$ in a manner to scan the wiping means, the blade 303 is pressed downward upon the blade ribs (unillustrated) on the carriage 200, and therefore, the amount of the overlap (hereinafter, "amount of blade entry") between the blade 303 and nozzle equipped surface 401*a* can be precisely maintained while the nozzle equipped surface 401*a* is wiped. In other words, with the provision of the above described structure arrangement, it is assured that the amount of the blade entry is precisely maintained regardless of the error in the position of the recovery system unit 300 relative to the liquid ejection head unit 401 in terms of the vertical direction, making it possible for the nozzle equipped surface 401*a* to be always satisfactorily perfectly wiped.

Also, the recovery system unit 300 in this embodiment is provided with a blade cleaner 307, which will be described later, a cap 308 formed of elastic material such as rubber, an absorbent member 309, which is formed of porous material and is placed in the cap 308, a cap holder 310 for holding the cap 308, and a cap lever 311, which keeps the cap holder 310 under the pressure generated in the direction of the arrow mark $A_{304}$ by an unillustrated cap spring, and is enabled to vertically move to open or close the cap through a cap lever cam, which also will be described later. The directions in which an envelope 312 and a continuous paper 313 (tape), that is, printing media, are conveyed are the directions of arrow marks $A_{305}$ and $A_{306}$, respectively. The carriage lock arm 390 is such a member that engages into a hole (unillustrated) of the carriage 200 to lock the carriage 200 to prevent the positional relationship between the liquid ejection head unit 401 and cap 308 from being disturbed by a shock or the like when the nozzle equipped surface 401*a* is capped, that is, when the cap lever 311 rises. The carriage lock arm 390 is attached to the cap lever 311 with the interposition of an unillustrated lock spring, being enabled to come down in the direction of an arrow mark $A_{390}$ while being forgivingly resisted the elasticity of the lock spring. Therefore, even if the carriage lock arm 390 strikes the adjacencies of the hole, it does not damage the recovery system unit 300 and carriage 200.

As described above, in this embodiment, an envelope conveyance space, the secondary ejection opening, the wiping means, the capping means, and a continuous paper conveyance space, are positioned in the listed order, and it will be described next why they are positioned in this order.

First, the cap 308 will be described. The cap 308 is for preventing the ink within the nozzles from drying, and also suctioning ink out of the nozzles by the suctioning means, which will be described later. However, foreign substances, dry ink, and the like, tend to adhere to, and accumulation on, the contact surface (usually, the top surface of the rib placed on the nozzle facing surface of the cap 303 in a manner to surround the nozzles) of the cap 308, which is placed in contact with the nozzle equipped surface 401*a*. If this occurs, problems such as ink leakage occur. The largest portion of the foreign substance in this printing apparatus is fibrous material called paper dust, the origin of which is printing medium in conveyance. However, in the case of this embodiment, virtually no paper dust is generated from a continuous paper, although a large amount of paper dust is generated from envelopes. As for ink mist, a certain amount of ink mist flies out of the printing position, but the amount of the ink mist which is created as ink is splashed away by the blade while the nozzle equipped surface 401*a* is wiped is far greater. In consideration of the above listed facts, in order to minimize the amount of the paper dust and ink which fly into the cap, the cap 308 is placed at a location which is farthest from the envelope printing position, and to which the ink splashed by the blade 303 during the wiping does not fly.

Also in consideration of the fact that the blade 303 splashes ink during the wiping as described above, the blade 303 of the wiping means must be placed away from the printing positions by no less than a predetermined distance not only to prevent the cap 308 from being soiled, but also to prevent the printing medium from being soiled. Thus, the secondary openings are positioned between the envelope conveyance space and wiping means, so that a sufficient amount of distance is provided between the printing position (envelope conveyance space) and wiping means.

Figure 28:
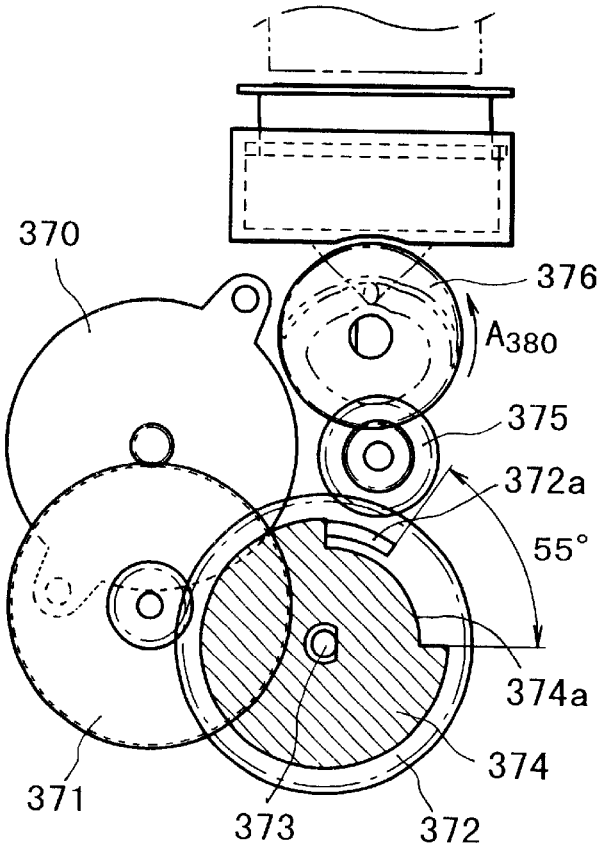
FIG. 28 is a schematic view of a driving system for the refreshing system unit.

FIG. 28 shows the structure of the driving system of this recovery system unit 300.

It is not necessary for the carriage 200 to be always in constant scanning motion during the aforementioned scanning secondary ejection. For example, in order to reduce processing time, the secondary ejection may be carried out while the carriage 200 is within the ramp-up or ramp-down regions of the carriage 200.

Further, instead of continuously ejecting ink while moving the carriage 200 in a scanning manner as described above, the secondary ejection may be intermittently carried out while the carriage 200 is standing still: the carriage 200 is intermittently moved so that each time the carriage 200 stops, each nozzle block sequentially stops exactly above the secondary ejection opening 301, and ink is ejected a predetermined number of times from the nozzle block above the secondary ejection opening 301.

The blade 303 is a piece of flat plate formed of elastic material such as rubber. One blade 303 is provided for each of the two liquid ejection head units 401. This double blade structure is effective for preventing the problem caused by the difference in the position of the nozzle equipped surface 401*a* between the two liquid ejection head units 401, and/or the problem which might occur if the ink ejected from one of the two liquid ejection head units 401 is different from the ink ejected from the other, and the two inks mix. The blades 303 are fixed to a blade holder 304, which is kept under the pressure generated by a blade spring in the upward direction (direction indicated by an arrow mark $A_{301}$) with respect to the blade shaft 305 integral with a blade gear 305*a*. The blade spring will be described later. The blade shaft 305 is rotatable in the direction of an arrow mark $A_{302}$ by a blade driving means, which will be described later. Therefore, the blade cam 303 connected to the blade shaft 305 is also rotatable in the same direction. In addition, the blade holder

304 is provided with a blade cam 306 which is integral with the blade holder 304. During a wiping operation, as the carriage 200 moves over the wiping means in the direction of an arrow mark $A_{303}$ in a manner to scan the wiping means, the blade 303 is pressed downward upon the blade ribs (unillustrated) on the carriage 200, and therefore, the amount of the overlap (hereinafter, "amount of blade entry") between the blade 303 and nozzle equipped surface 401*a* can be precisely maintained while the nozzle equipped surface 401*a* is wiped. In other words, with the provision of the above described structural arrangement, it is assured that the amount of the blade entry is precisely maintained regardless of the error in the position of the recovery system unit 300 relative to the liquid ejection head unit 401 in terms of the vertical direction, making it possible for the nozzle equipped surface 401*a* to be always satisfactorily perfectly wiped.

Also, the recovery system unit 300 in this embodiment is provided with a blade cleaner 307, which will be described later, a cap 308 formed of elastic material such as rubber, an absorbent member 309, which is formed of porous material and is placed in the cap 308, a cap holder 310 for holding the cap 308, and a cap lever 311, which keeps the cap holder 310 under the pressure generated in the direction of the arrow mark $A_{304}$ by an unillustrated cap spring, and is enabled to vertically move to open or close the cap through a cap lever cam, which also will be described later. The directions in which an envelope 312 and a continuous paper 313 (tape), that is, printing media, are conveyed are the directions of arrow marks $A_{305}$ and $A_{306}$, respectively. The carriage lock arm 390 is such a member that engages into a hole (unillustrated) of the carriage 200 to lock the carriage 200 to prevent the positional relationship between the liquid ejection head unit 401 and cap 308 from being disturbed by a shock or the like when the nozzle equipped surface 401*a* is capped, that is, when the cap lever 311 rises. The carriage lock arm 390 is attached to the cap lever 311 with the interposition of an unillustrated lock spring, being enabled to come down in the direction of an arrow mark $A_{390}$ while being forgivingly resisted the elasticity of the lock spring. Therefore, even if the carriage lock arm 390 strikes the adjacencies of the hole, it does not damage the recovery system unit 300 and carriage 200.

As described above, in this embodiment, an envelope conveyance space, the secondary ejection opening, the wiping means, the capping means, and a continuous paper conveyance space, are positioned in the listed order, and it will be described next why they are positioned in this order.

First, the cap 308 will be described. The cap 308 is for preventing the ink within the nozzles from drying, and also suctioning ink out of the nozzles by the suctioning means, which will be described later. However, foreign substances, dry ink, and the like, tend to adhere to, and accumulate on, the contact surface (usually, the top surface of the rib placed on the nozzle facing surface of the cap 303 in a manner to surround the nozzles) of the cap 308, which is placed in contact with the nozzle equipped surface 401*a*. If this occurs, problems such as ink leakage occur. The largest portion of the foreign substance in this printing apparatus is fibrous material called paper dust, the origin of which is printing medium in conveyance. However, in the case of this embodiment, virtually no paper dust is generated from a continuous paper, although a large amount of paper dust is generated from envelopes. As for ink mist, a certain amount of ink mist flies out of the printing position, but the amount of the ink mist which is created as ink is splashed away by the blade while the nozzle equipped surface 401*a* is wiped is far greater. In consideration of the above listed facts, in order to minimize the amount of the paper dust and ink which fly into the cap, the cap 308 is placed at a location which is farthest from the envelope printing position, and to which the ink splashed by the blade 303 during the wiping does not fly.

Also in consideration of the fact that the blade 303 splashes ink during the wiping as described above, the blade 303 of the wiping means must be placed away from the printing positions by no less than a predetermined distance not only to prevent the cap 308 from being soiled, but also to prevent the printing medium from being soiled. Thus, the secondary openings are positioned between the envelope conveyance space and wiping means, so that a sufficient amount of distance is provided between the printing position (envelope conveyance space) and wiping means.

FIG. 28 shows the structure of the driving system of this recovery system unit 300.

The driving system of the recovery system unit 300 comprises: a motor 370, which is dedicated for driving the recovery system, and to the rotational shaft of which a gear is fixed; a first double gear 371, or the second gear for the motor, for velocity reduction; an idler gear 372, which engages with the first double gear, and is rotatable about a pump shaft 373 to which a roller guide, which will be described later, is fixed; and a pump cam 374 (illustrated by hatching), which is fixed to the pump shaft 373, and a gap 374*a* into which a rib 372*a* of the idler gear 372 engagages. The driving system is provided with a certain amount of play, which is equivalent to 55 degrees in rotational angle, between the dimensions of the rib 372*a* and gap 374*a* in terms of the rotational direction of the idler gear 372. The driving system also comprises a second double gear which engages with the idler gear 372, and a one-way clutch 376, which is integral with a gear, and generates torque in the direction to lock onto the cam shaft, which serves as rotational axis, only when the double gear is rotated in the direction of an arrow mark $A_{380}$.

Figure 29:
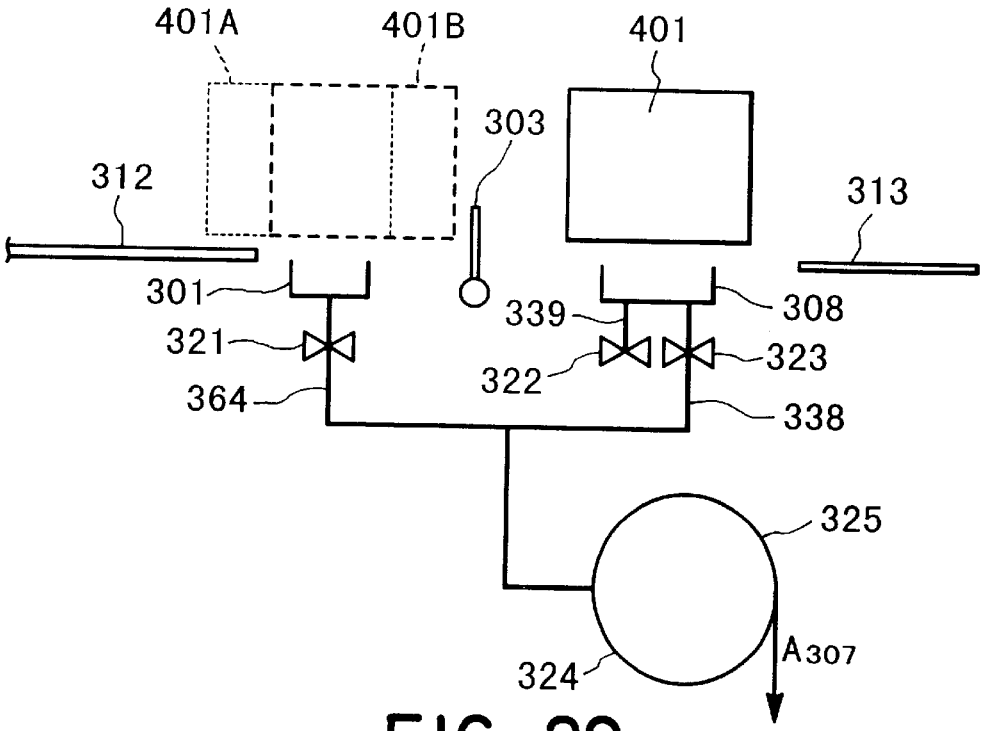
FIG. 29 illustrates a relation between a flow path of the refreshing system unit and a valve.

FIG. 29 shows the structures of the ink flow paths and valves of the recovery system unit 300. The recovery system unit 300 in this embodiment possesses two sets of flow paths leading to the two liquid ejection head units 401. For the simplification of description, FIG. 29 shows only one set of liquid paths leading to one of the liquid ejection head units 401.

In this embodiment, a secondary ejection valve 321, an air vent valve 322, a suction valve 323, and a negative pressure generating means (tube pump in this embodiment) for generating negative pressure when restoring the performance of the liquid ejection head unit 401 by suction, are provided for each liquid ejection head unit 401.

First, the state of the valves while the no-load secondary ejection process for recovering the ink ejected by the secondary ejection will be described. The no-load secondary ejection is carried out while the liquid ejection head unit 401 moves from a position 401A to a position 401B. Thereafter, negative pressure is generated in the tube by driving the tube pump 324 by the driving system, with only the secondary ejection valve 321 opened, and with the other two valves 322 and 323 closed. As a result, the ink which has collected in the secondary ejection opening 301 is discharged in the direction of an arrow mark $A_{307}$ through the pump tube 325, into an unillustrated waste ink processing means.

Next, the states of the valves while the performance of the liquid ejection head unit 401 is restored by suction will be described. FIG. 29 shows some distance between the cap 308 and liquid ejection head unit 401, but in an actual operation, the suction based recovery process is carried out with the nozzle rows covered with the cap 308: the cap lever 311 is raised to apply pressure to the cap 303, so that the cap 308 is placed in contact with the nozzle equipped surface 401*a* of the liquid ejection head unit 401, tightly and yet flexibly. The tube pump 324 is activated with the secondary ejection valve, air vent valve 322, and suction valve 323 closed. Thereafter, only the suction valve 323 is opened to instantly reduce the internal pressure of the cap 308*n* to suction the ink within the cap 308. In order to recover the ink within the cap 308, cap tube 338, pump tube 325, and the like, by the no-load suction, the tube pump 324 is activated after the air vent valve 322 and suction valve 323 are opened while the cap 308 is kept tightly in contact with the liquid ejection head unit 401 to take in the atmospheric air.

Next, referring to FIGS. 30 and 31, the mechanism of the tube pump 324 will be described.

There are two rollers 326 rotationally supported in a roller guide 327, The two rollers 326 are rendered different in phase by 180 degrees. They have two shaft portions 326*a* which extend one for one from both of their side walls. The roller guide 327 is provided with a set of two grooves 327*a* into which the shaft portions 326*a* of the rollers 326 fit. The rollers 326 are enabled to move following these grooves 327*a*, and also to squash and squeeze the silicon pump tube 325 while rolling. A roller dumper 328 is formed of elastic material such as rubber.

Figure 30:
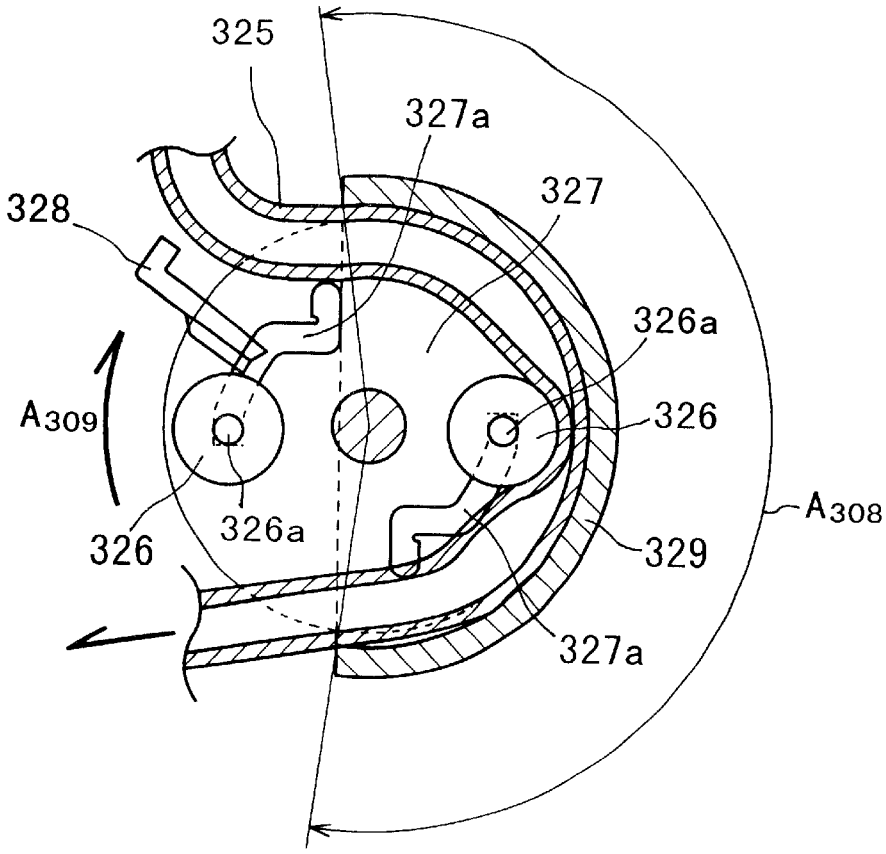
FIG. 30 is a schematic view illustrating negative pressure production of a tube pump.

FIG. 30 shows the state the tube pump 324, in which the tube pump 324 is operating and generating negative pressure, and each roller 326 which has been moved to one of the ends of the correspondent groove 327*a*, that is, the position closest to the internal wall of the tube guide 329, rolls while squashing and squeezing the pump tube 325. The roller dumper 328 moves each roller 326 back to the same end, or the starting end, of the groove 327*a*, outside the range $A_{308}$ in which the pump tube 325 is squashed an squeezed. Further, the two rollers 326 are different in rotational phase by 180 degrees, and also the tube guide 329 is configured so that it covers the peripheral surface of the roller guide 327 by no less than 180 degrees in terms of the circumferential direction as indicated by an arrow mark $A_{308}$. Therefore, while the roller guide 327 is rotating in the direction of an arrow mark $A_{309}$, the tube pump 325 keeps on generating negative pressure.

Figure 31:
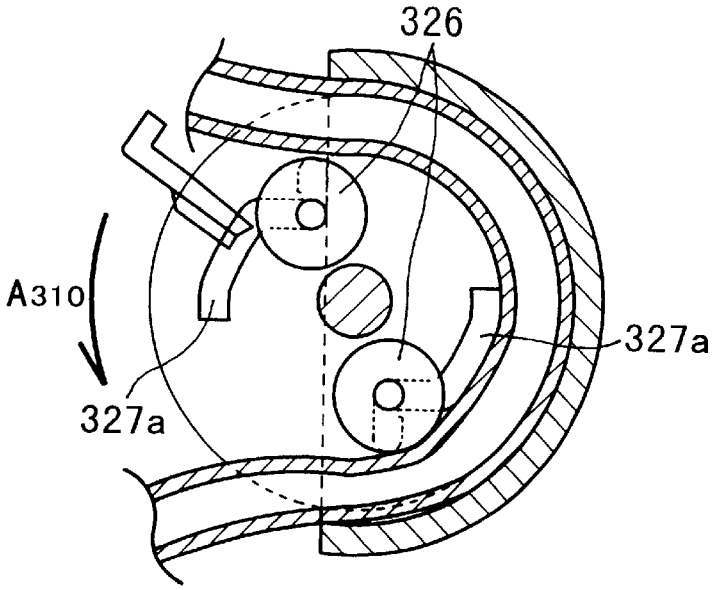
FIG. 31 is a schematic view illustrating non-generation of the negative pressure in the tube pump.

FIG. 31 shows the operation of the tube pump 324, in which the roller guide 327 is rotated in the direction opposite (direction of an arrow mark $A_{310}$) to the direction indicated in FIG. 30. In this case, each roller 326 is moved toward the other end of the groove 327*a*, that is, the end opposite to the end referred to in FIG. 30, by the lead created as the roller 326 interacts with the pump tube 325 and roller dumper 328. As a result, the roller 326 is moved toward the rotational center of the roller guide 327, and is rotated about the rotational axis of the roller guide 327 without squashing the pump tube; in other words, it is virtually idled. Therefore, a state in which negative pressure is not generated, and the rollers 326 do not creep while squashing the pump tube 325, is created. Thus, when it is expected that printing wall be halted for an extended length of time, for example, after the power source is turned off or while the printing apparatus is kept on standby, it is desired that the tube pump 324 be kept in this state. In this embodiment, in order to assure that the state of the tube pump 324 switches from the state illustrated in FIG. 30 to the state illustrated in FIG. 31, a rotational angle of no less than 40 degrees is necessary.

Next, referring to FIGS. 32–34, the structure of the valve mechanism will be described.

First, referring to FIG. 32, the secondary ejection valve 321 will be described. In this embodiment, the valve mechanism comprises: a secondary ejection valve cam 330 for controlling the opening and closing of the secondary ejection valve 321; a valve holder 331 in which all the valves are held; a secondary ejection valve rubber 332, which is a diaphragm type valve formed of elastic material such as rubber; a valve shaft 333*a* engaged with the secondary ejection valve rubber 332, or a suction valve rubber 342 which will be described later, a first valve arm 334*a* engaged with the valve shaft; a cam follower 335*a* which makes contact with the first valve arm 334*a*, and either the secondary ejection valve cam 330, or a suction valve cam 341 which will be described later; a first valve arm spring 336*a* which keeps the first valve arm 334*a* pressed toward the secondary valve cam 332 or suction valve cam 341; and a valve tube 337 which constitutes the ink flow path from the secondary ejection valve 321, to the suction valve 323 which will be described later.

Figure 32:
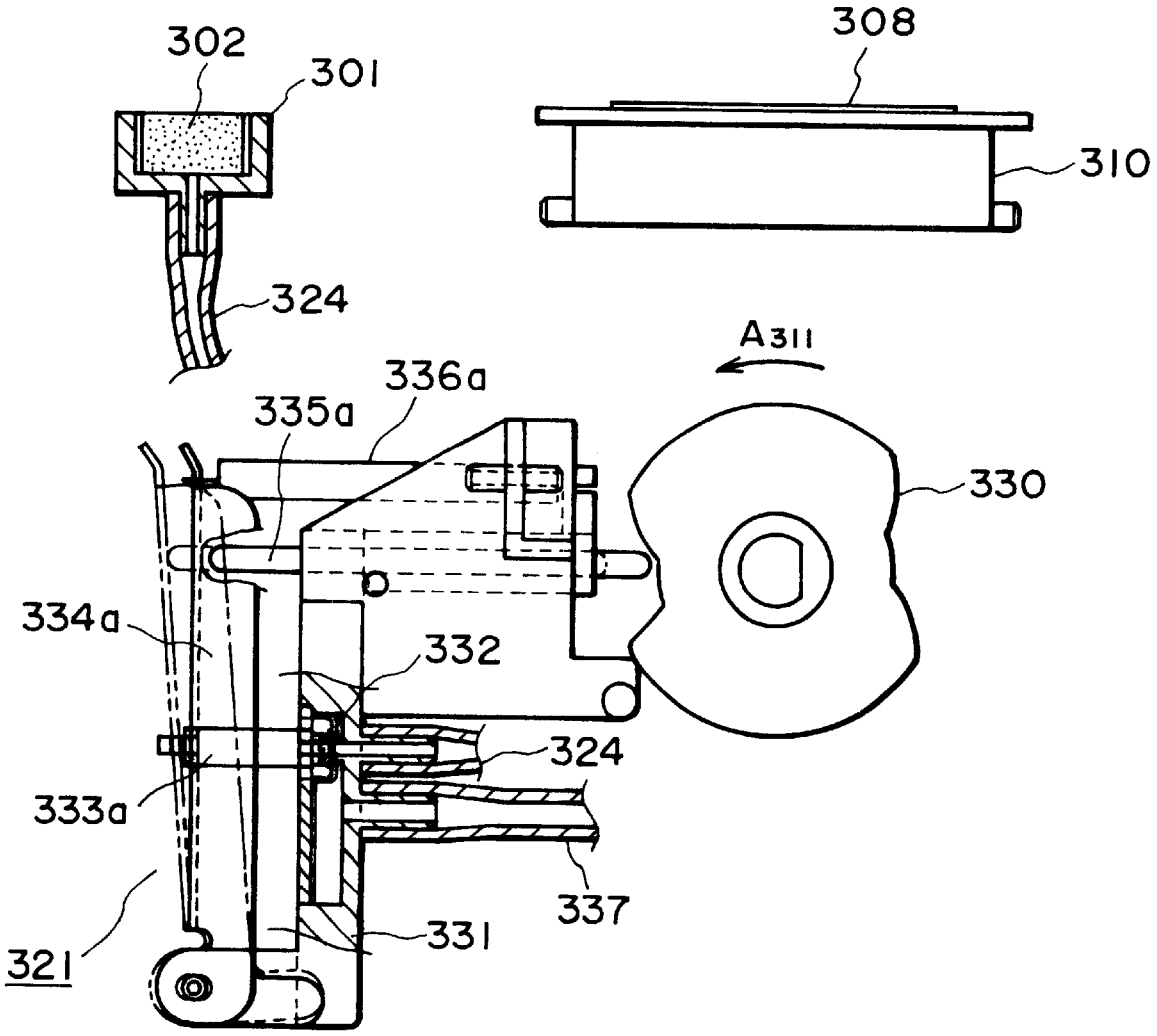
FIG. 32 is a schematic view illustrating an operation of a preliminary ejection valve.

In FIG. 32, the secondary ejection valve rubber 332 is within the valve holder 331, and the state in which the flow path connecting between the secondary ejection tube 364 and valve tube 337 is closed is shown by a solid line. As the secondary ejection valve cam 330 rotates in the direction of an arrow mark $A_{311}$ from this state, and the first valve arm 334*a* rotates to the position illustrated by a double dot chain line, the valve shaft 333*a* moves to the position illustrated by the double dot chain line, causing the secondary ejection valve 321 to open to allow liquid flow between the secondary ejection tube 364 and valve tube 337.

If the last letter of a referential code assigned to a component illustrated in FIG. 32 is a letter "a", this means that the component belongs to the secondary ejection valve mechanism. If a referential numeral assigned to a component illustrated in FIG. 33 is suffixed with a letter "b", this means that the component belongs to the suction valve mechanism. These components illustrated in FIG. 33 are different from those illustrated in FIG. 32 only in the positions at which they are placed, being the same in function and shape. Therefore, their description will be omitted.

Figure 33:
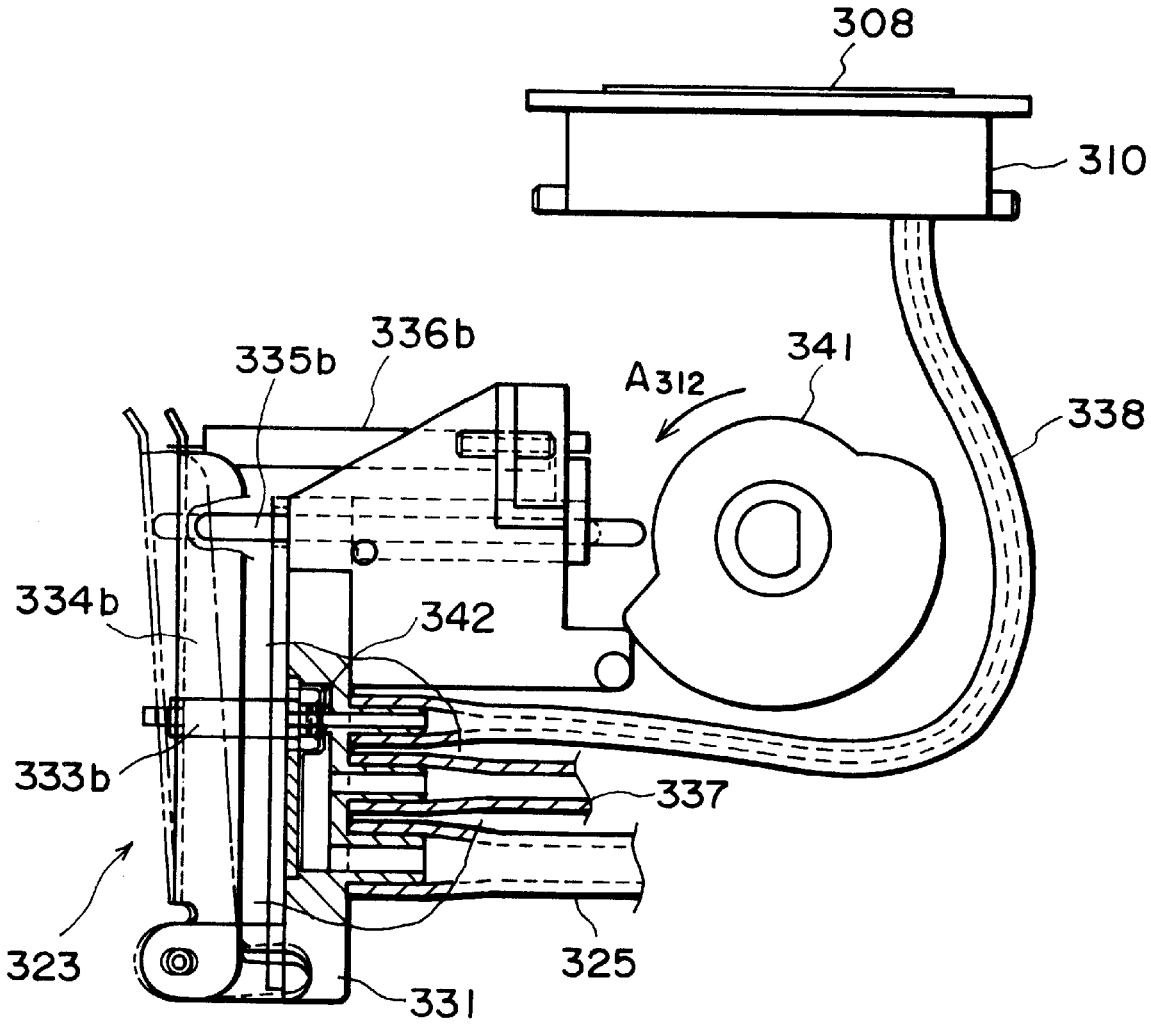
FIG. 33 is a schematic view of an operation of a suction valve.

FIG. 33 shows the movement of the suction valve 323. The suction mechanism in this embodiment comprises: the suction valve 323; the suction valve cam 341 for controlling the suction valve 323; the suction valve rubber 342, which is a diaphragm type valve formed of elastic material such as rubber; and the cap tube 338 which constitutes the ink flow path from the cap 308 to the valve holder 331.

In FIG. 33, the state in which the suction valve 323 is closed is represented by a solid line. In this state, the joint between the cap tube 338 and valve tube 337 is closed by the structure similar to the aforementioned secondary ejection valve 321. As the suction valve cam 341 rotates in the direction of an arrow mark $A_{312}$ and the first valve arm 334*b* rotates to the position represented by the double dot chain line, the valve shaft 333*b* moves to the position represented by the double dot chain line, causing the suction valve 323 to open to allow ink flow between the cap tube 338 and valve tube 337.

Figure 34:
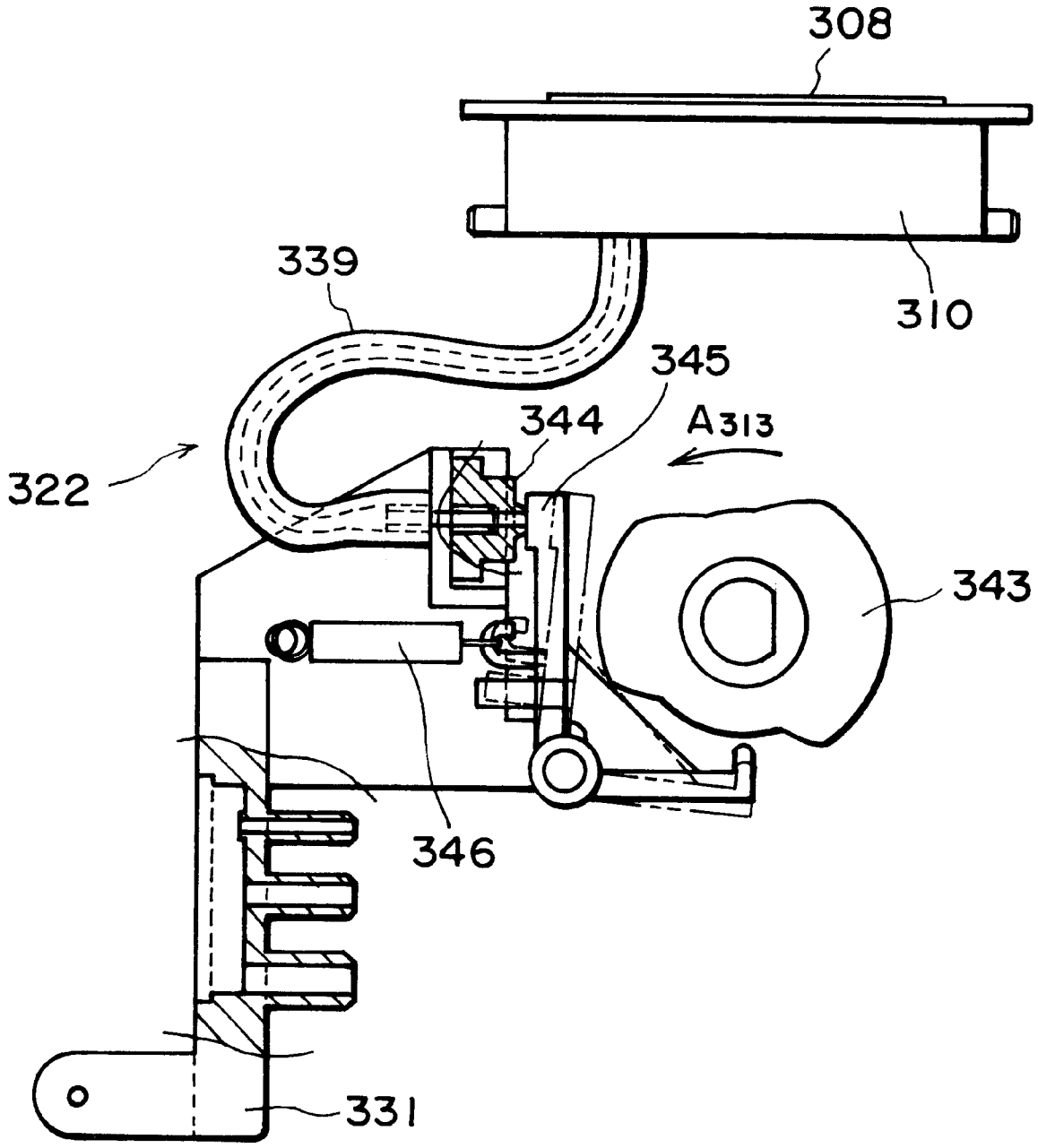
FIG. 34 is a schematic view of an operation of an air venting valve.

FIG. 34 shows the movement of the air vent valve 322. The air venting mechanism in this embodiment comprises: the air venting valve 322; the air vent valve cam 343 for controlling the movement of the air vent valve 322; the air vent valve rubber 344 formed of elastic material such as rubber; the second valve arm 345, and the second valve arm spring 346 for keeping the second valve arm 345 pressed toward the air vent valve 322.

In FIG. 34, the state in which the air vent valve 322 is closed is represented by a solid line. As the air vent valve cam 343 rotates in the direction of an arrow mark $A_{313}$ and the second valve arm 345 rotates to the position represented by the double dot chain line, the air vent tube 339 becomes open to the atmospheric air.

The air vent valve 322 is different from the aforementioned secondary ejection valve 321 or suction valve 323 in that the air vent tubes 339 leading from the two systems of ink flow paths, in other words, leading from the two caps 308, combine into a single tube through an unillustrated joint member, and this tube is connected to the air vent valve rubber 344. Therefore, only one valve mechanism needs to be provided for the two caps 308.

Figure 35:
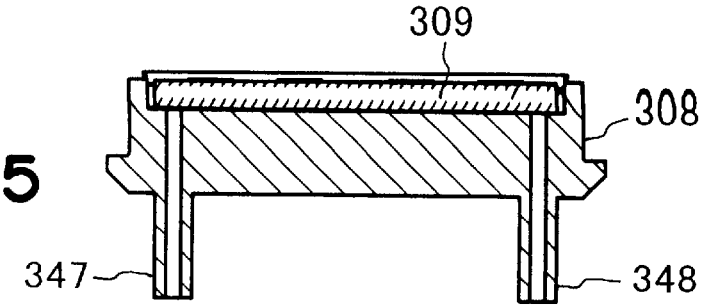
FIG. 35 is a sectional view of a cap.

FIG. 35 is a cross sectional view of the cap 308. Each cap 308 is provided with a connective portion 339 to which the air vent tube 339 is connected, and a connective portion 348 to which the cap tube 338 is connected.

Figure 36:
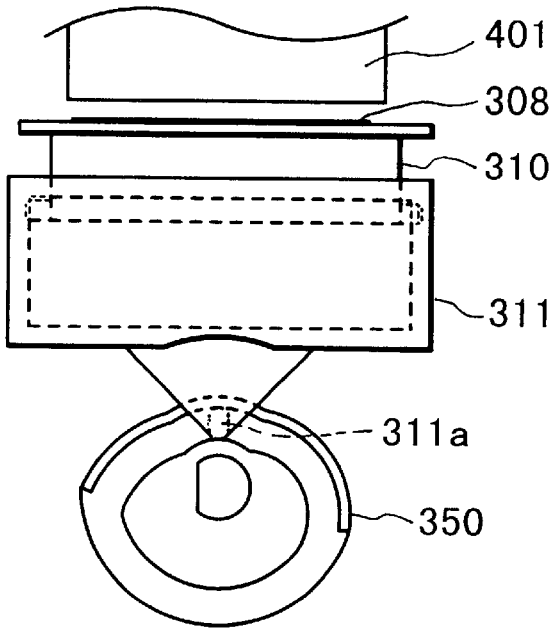
FIG. 36 is a schematic view illustrating cap open state.
Figure 37:
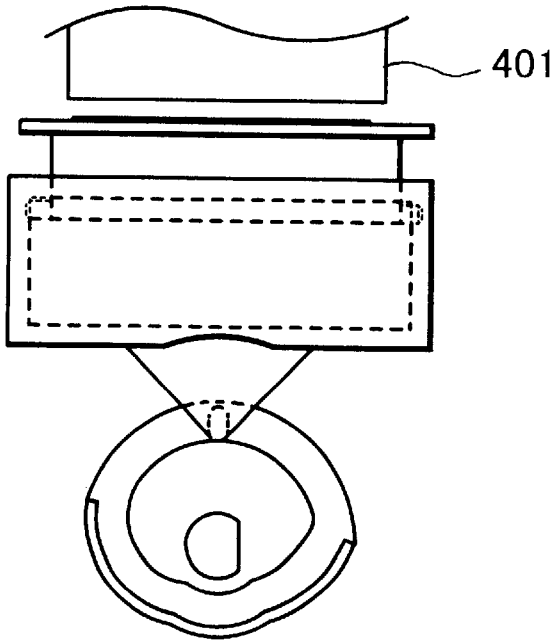
FIG. 37 is a schematic view of a cap closing state.

FIGS. 36 and 37 show the vertical movement of the cap 308. FIG. 36 shows the state in which the cap is open, in other words, the cap is at its lowest position, and FIG. 37 shows the state in which the cap is closed, in other words, the cap 308 is at its highest position.

In this embodiment, the cap lever cam 350, and a cam follower 311*a* which is integral with the cap lever 311, and follows the cap lever cam 350, are provided. As is evident from FIGS. 36 and 37, the cap 308 can be placed in contact with the nozzle equipped surface 401*a*, or separated therefrom, by rotating the cap lever cap 350 by a predetermined rotational angle. The cap spring stretched between the cap holder 310 and cap lever 311 is not shown in these drawings. Not only are the cap lever cam 350, and the cam follower 311*a* of the cap lever 311, shaped so that they slide against each other, but also they are structured so that even when the cap 308 and liquid ejection head unit 401 stick to each other due to the solidification of ink or the like causes, the cap 308 and liquid ejection head unit 401 can be pulled apart.

Next, referring to FIGS. 38 and 39, the movement of the wiping means will be described. The wiping means comprises: a blade gear 351 (hereinafter, "teeth missing gear"), the teeth of which are placed in sets of two, at regular intervals of a predetermined length, and which engages with the blade gear 305; a blade trigger gear 352 which engages with the teeth missing blade gear 351; a blade cleaner 307; and a blade spring 353. The wiping means also comprises the blade ribs, which are on the carriage 200.

Figure 38:
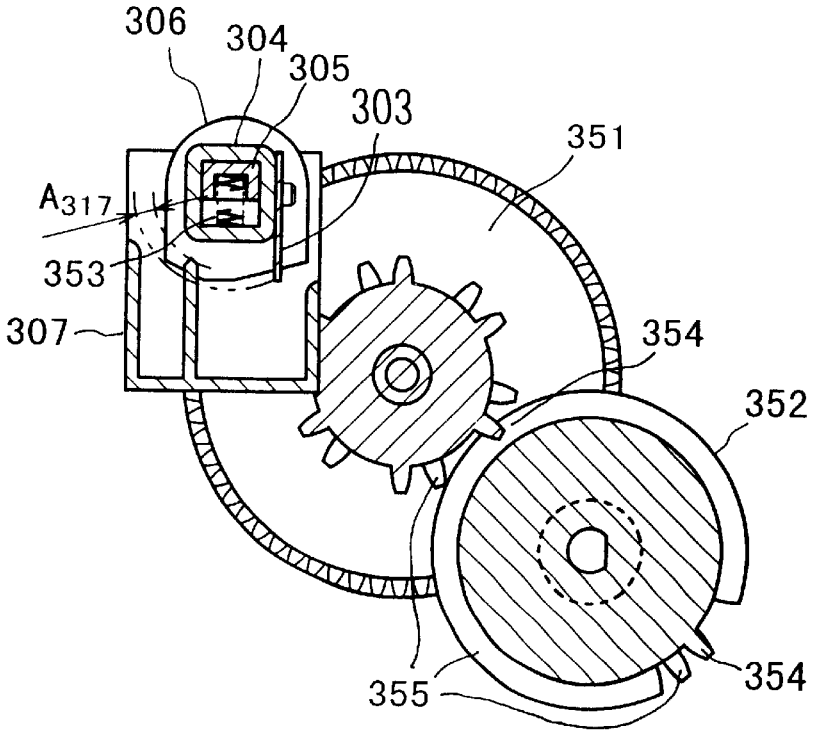
FIG. 38 is a schematic view illustrating a non-wiping state of wiping means.
Figure 39:
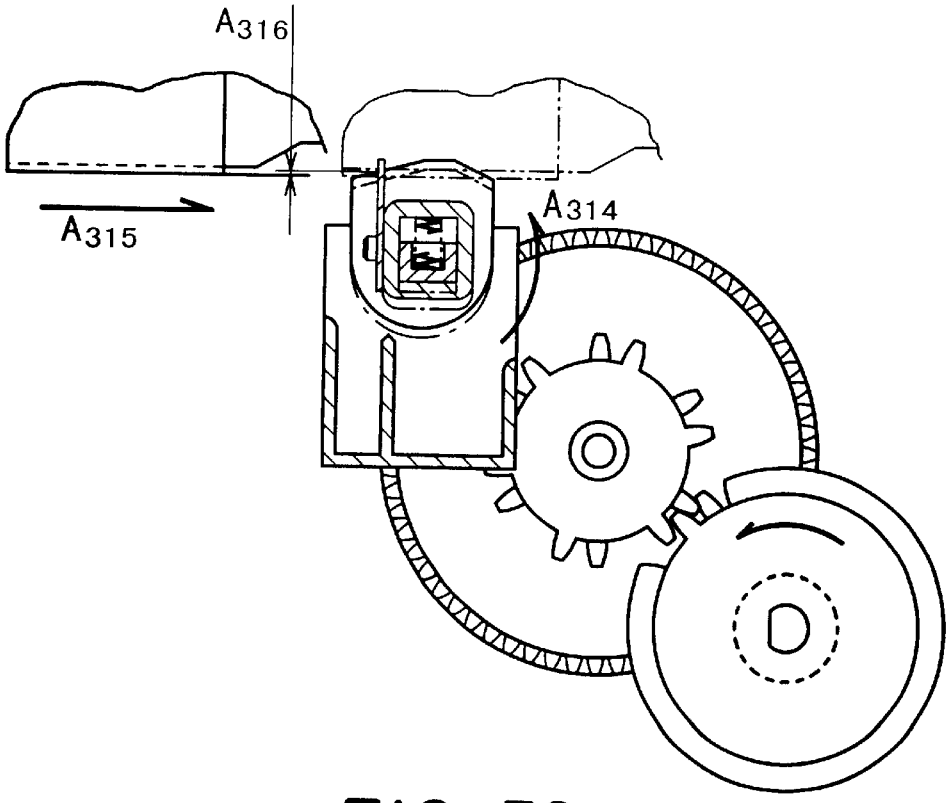
FIG. 39 is a schematic view illustrating a wiping state of wiping means.
Figure 40:
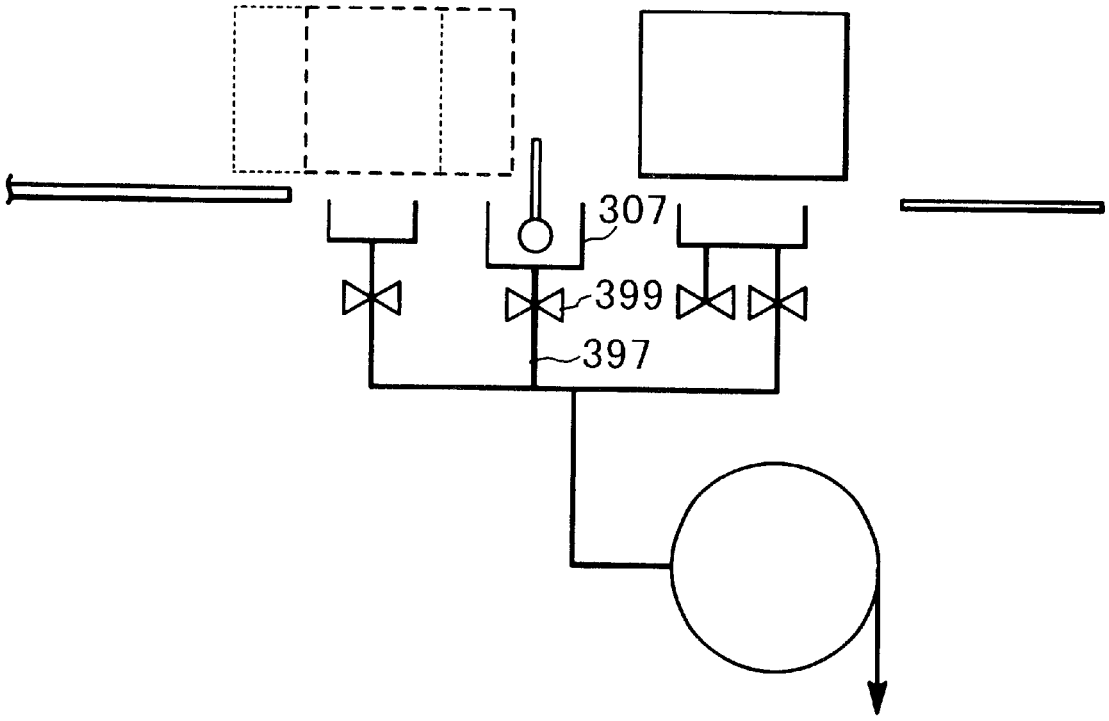
FIG. 40 is a scholastic view of a structure absorbing residual ink from a cleaner blade.
Figure 41:
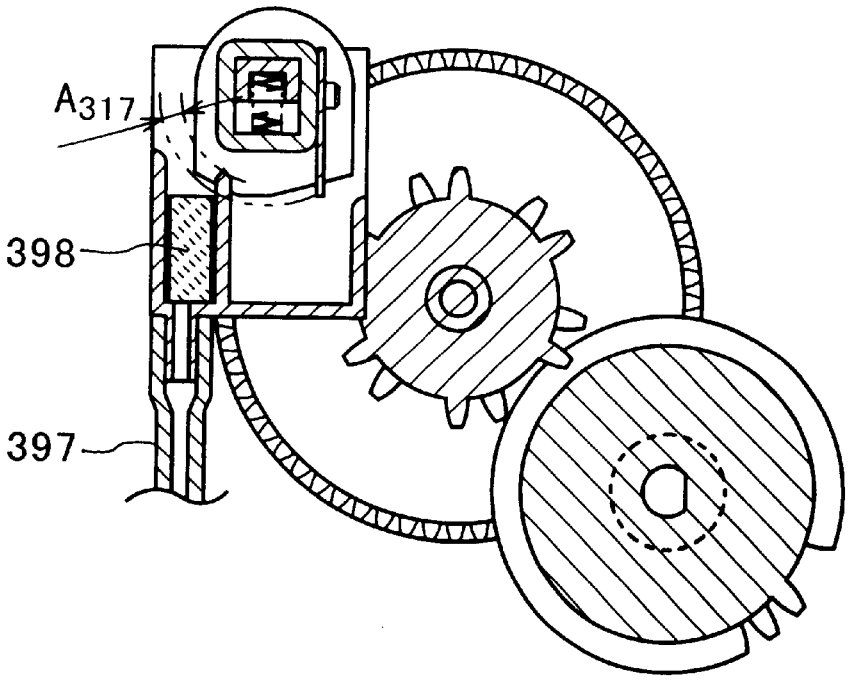
FIG. 41 is a schematic view of a structure absorbing residual ink from the cleaner blade.

When wiping, as the carriage 200 comes to the position drawn in solid line in FIG. 39 from the position, or the blade parking position, illustrated in FIG. 38, the blade cam 306 is rotated in the direction of an arrow mark $A_{314}$ to the position in FIG. 39 so that the tip of the blade 303 is faced upward for wiping. Next, the carriage is moved in the direction of an arrow mark $A_{315}$ at a predetermined velocity, causing the blade 303 to wipe. Meanwhile, the blade cam 306 is pressed downward by the blade ribs on the carriage 200, and therefore, the wiping means descends to the position illustrated in a double dot chain line in FIG. 39. As the blade holder 304 and blade 303 are lowered, upward pressure is applied to them by the blade spring 353, and the blade 303 is caused to take the wiping action as the blade cam 306 slides on the blade ribs. The above described structural arrangement assures that the blade is precisely positioned in terms of the amount of entry, to satisfactorily wipe the nozzle equipped surface 401*a*. As the nozzle equipped surface 401*a* of the liquid ejection head unit 401 separates from the blade 303, the wiping ends. Then, the wiping mean again begins to rotate, so that the blade 303 is parked at the position illustrated in FIG. 38 after the ink adhering to the blade 303 is scraped away by the blade cleaner 307. The amount of the interfacing between the blade cleaner 307 and blade 303 during the scraping of the latter by the former is rendered greater than the aforementioned amount $A_{316}$ of the blade entry, to assure that the ink adhering to the blade 303 is completely removed.

The position of the blade cleaner 307 is such that the ink splashed away from the blade 303 by the blade cleaner 307 during the blade cleaning does not reach the components such as the cap 308, the ink adhesion to which is not desirable. For example, the blade cleaner 307 in this embodiment is located below the blade 303. Further, the blade cleaner 307 doubles as a container for storing the ink scraped away, and is structured so that it can be easily replaced as necessary. Thus, even during wet wiping or the like, the ink which drips from the blade 303 can be recovered without being allowed to migrate into the other areas of the apparatus. Wet wiping is a process in which wiping is carried out while ejecting ink. It is carried out for re-dissolving the dry ink adhering to the blade 303, and also is carried out when high viscosity ink, mainly, pigment based ink, is in use.

Sometimes, it becomes difficult to deal with the waste ink by the replacement of the blade cleaner 307, for example, when the amount of the ink which collects in the blade cleaner 307 is too large. In order to deal with such situations, a cleaner tube 397 connected to the pump tube 325 may be connected to the bottom wall of the container portion of the blade cleaner 307, so that the ink, which has been absorbed into, and is retained in, the absorbent member placed in the blade cleaner 307, can be recovered as necessary, into the waste ink processing means by suction. Such an arrangement can rid a user of the annoyance of being required to deal with the ink which collects in the blade cleaner, throughout the service life of an apparatus. Although the detailed description of the valve mechanism of such an arrangement will be not given here, the structure of the valve mechanism is the same as the one shown in FIG. 32. In other words, it is structured so that the ink within the blade cleaner 307 can be recovered by activating the pump, with the suction valve 323 and secondary ejection valve 321 closed, and the cleaner valve 399 opened.

Next, the driving system of the wiping means will be described. Referring to FIG. 38, the hatched teeth 354 among the teeth of the tooth missing blade gear 351 engage with only the hatched tooth 354 of the blade trigger gear 352. The unhatched teeth 355 of the teeth missing blade gear 351 engage with only the unhatched tooth 355 of the blade trigger gear 352.

Thus, while the toothless portion, or the major portion, of the peripheral portion of the blade trigger gear 352, is in engagement with the teeth missing blade gear 351, the teeth missing blade gear 351 remains still, and therefore, the wiping means remains still, with its blade 303 facing downward. As the blade trigger gear 352 rotates further and the teeth on both gears mesh, the wiping means is rotated in the direction of the arrow mark $A_{314}$ in FIG. 39 to be restored to the state illustrated in FIG. 38.

In this embodiment, the blade trigger gear 352, secondary ejection valve cam 330, suction valve cam 341, and cap lever cam 350 are fixed to the same shaft (hereinafter, "cam shaft"). While the blade trigger gear 352 rotates 360 degrees, the teeth missing blade gear 351 rotates during only the period correspondent to the rotational angle of 45 degrees in terms of the rotational phase. Thus, the peripheral velocity of the blade gear is eight times that of the blade trigger gear 352. In other words, while the cam shaft rotates 360 degrees, the blade trigger gear 352 rotates only 45 degrees during the period correspondent to a given rotational phase. During this period, the wiping means continuously rotates 360 degrees. During the period in which the cam shaft shaft rotates the remaining 315 degrees, the wiping means remains still, with the tip of the blade 303 facing downward. As described above, the wiping means always remains still, with the wiping surface (wiping surface facing the nozzle equipped surface) facing opposite to the envelope conveyance space and secondary ejection region, and therefore, the adhesion of flying paper dust and/or ink mist, as well as other debris is minimized.

As described previously, the gear train of the driving mechanism in this recovery system unit 300 is provided with play which is equivalent to 55 degrees in terms of the phase angle of the roller guide 327, so that as the rotational direction of the driving mechanism is reversed, the roller guide 327 begins to rotate with a delay equivalent to 55 degrees in phase angle. Further, with the provision of the one-way clutch in the gear train, the force for driving the cam shaft is not transmitted to the cam shaft while the tube pump 324 is driven in the direction to generate negative pressure.

Next, referring to FIG. 42, which is a cam chart, and FIGS. 43–47, which are flow charts, the operational sequences of the recovery system unit 300 will be described. In the following description, parenthesized numbers correspond to the cam positions indicated in FIG. 42.

First, the movement of the recovery system unit 300 during a printing operation will be described. As a print command is issued in Step S301, the motor begins to rotate in the counterclockwise direction in FIG. 28, in Step S302, and rotates the cam shaft, opening the cap 308 to create the state correspondent to a cam position (1).

Figure 44:
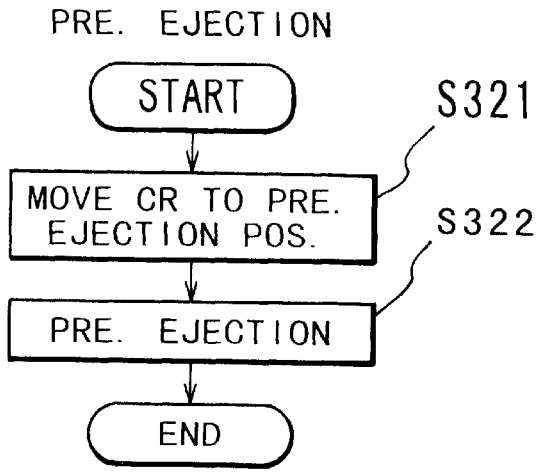
FIG. 44 is a flow chart of preliminary ejection process.

Next, the secondary ejection process shown in FIG. 44 is carried out. In the secondary ejection process, first, the carriage 200 is moved to the secondary ejection preparation position, in Step S321, and ink is sequentially ejected from the nozzle blocks, starting from the side closer to the blade 303, in Step S322. As soon as ink is ejected from all the nozzles, the ink ejection and carriage movement are stopped, ending the secondary ejection process. It is not mandatory that the carriage 200 is continuously moved in a scanning manner during the aforementioned scanning ink ejection. Instead, the carriage 200 may be intermittently stopped, and ink may be ejected while the carriage 200 is standing still.

Figure 45:
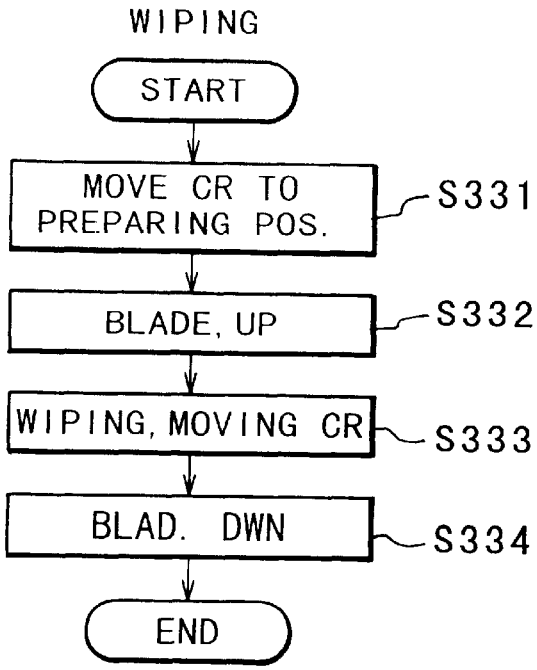
FIG. 45 is a flow chart of a wiping process.

Next, in Step 305, either an envelope or continuous paper (tape) is moved to the printing position, and in Step 306, a timer T is started after it is reset. In Step S307, if no print command to print on the printing medium conveyed to the printing position in Step S306 is detected, the process advances to Step 311. On the contrary, if a print command is detected in Step S307, the time T is referred to, in Step S308. If the timer count is no more than 60 seconds, the process returns to Step S306, In which printing is started again. However, if the timer count is no less than 60 seconds, Step S308 is taken, in which the wiping process, which is shown in FIG. 45, is carried out to wipe away the ink adhering to the nozzle equipped surface 401*a*.

As for the wiping process, the carriage 200 is moved to the wiping preparation position, in Step S331. Next, the motor is rotated in the counterclockwise direction in Step S332, to change the state of the wiping means correspondent to the cam position (1) to the state correspondent the cam position (2); in other words, the state in which the tip of the blade 303 is facing downward (FIG. 38) is changed into the state in which the tip of the blade 303 is facing upward for wiping (FIG. 39). Next, the carriage 200 is moved in a scanning manner to wipe the nozzle equipped surface 401*a*, in Step S333. During this movement of the carriage 200, the velocity at which the carriage 200 is moved does not need to be constant: for example, it may be varied according to ink type. After the entire range of the nozzle equipped surface 401*a* of the liquid ejection head unit 401 is wiped, the carriage 200 is stopped, and the motor is rotated in the counterclockwise direction to put to the wiping means in the state correspondent to the cam position (3), in which the blade 303 is parked with its tip facing downward, ending the wiping process.

Figure 46:
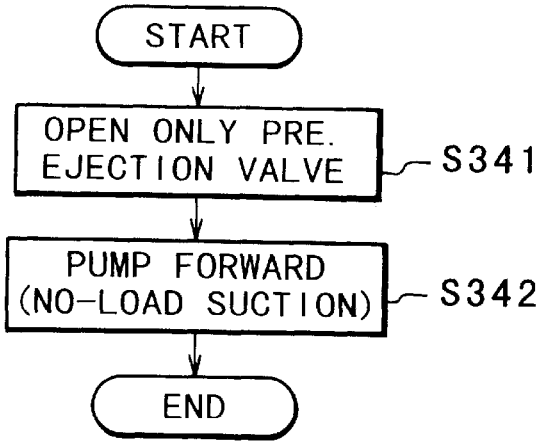
FIG. 46 is a flow chart of a preliminary ejection opening non-load suction suction process.
Figure 47:
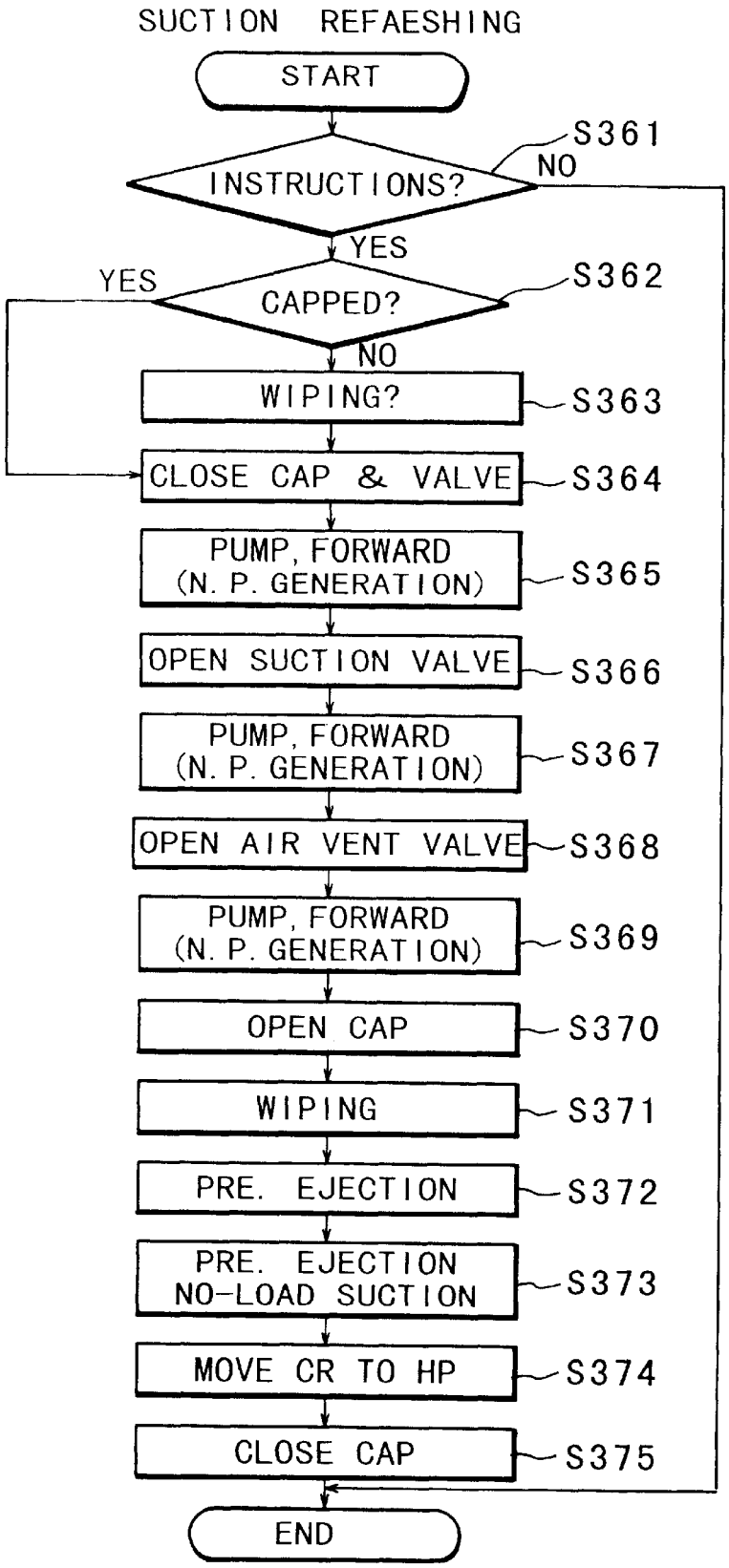
FIG. 47 is a flow chart of a suction recovery or refreshing process.

Next, in Step 310, in order to discharge dry ink and/or inks of different types, and the like, which are possible to be pushed into the nozzles by the wiping process, the secondary ejection process is carried out. As the transmission of print commands stops, the wiping process is carried out, as the final process in a printing operation, to remove the ink on the nozzle equipped surface 401*a*, in Step S311. Therefore, in order to discharge the ink remaining in the secondary ejection openings, into the unillustrated waste ink processing means, the no-load secondary suction process, which is shown in FIG. 46, is carried out, in Step S312.

In Step S341, the motor is rotated in the counterclockwise direction to place the wiping means in the state correspondent to the cam position (3). Then, the ink within the secondary ejection openings is discharged into the waste ink absorbing member through the pump tube 325, by rotating the motor in the clockwise direction by a predetermined rotational angle to drive the pump, ending the no-load secondary ejection process. The aforementioned predetermined rotational angle means a minimum rotational angle necessary to assure that the amount of the ink remaining in the secondary ejection openings and/or tube is reduced to the amount which does not interfere with the operations of the liquid ejection head unit 401 and recovery system unit 300.

Next, in Step S313, the carriage 200 is moved to the home position S, which also is the capping position, and next, in Step S314, the motor is rotated in the counterclockwise direction to place the wiping means in the state correspondent to the cam position (4), that is, the state in which the cap is on the nozzle equipped surface 401*a*, ending the printing process. The amount of the rotational angle of the motor during this period is 100 degrees, which is greater than the sum of the rotational angle of 55 degrees, by which the pumping operation timing is delayed, and the rotational angle of 40 degrees necessary to change the state in which the rollers 326 squash the pump tube 325, into the state in which the former do not squash the latter. During the period in which the printing apparatus is on standby (period in which the cap is in contact with the nozzle equipped surface), the pump is in the state illustrated in FIG. 31.

Described next will be the suction based recovery process, which is automatically or manually carried out as ink solidifies and lodges within the nozzles because the liquid ejection head unit 401 is left unused for an extended period, or as ink is prevented from being ejected, by the bubbles which have strayed into the ink flow paths.

First, as a suction based recovery command is issued in Step S361, the state of the printing apparatus is detected in Step S362. If the printing apparatus is in the state correspondent to the cam position (4), in other words, if the cap is in contact with the nozzle equipped surface 401*a*, Step S364 is taken. Otherwise, Step S363 is taken, in which the wiping process is carried out. Then, in Step S364, the nozzle equipped surface 401*a* is covered with the cap to realize the state correspondent to the cam position (4), and the motor is further rotated in the counterclockwise direction to realize the state correspondent to the cam position (5), in which all valves are in the closed positions. Next, in Step S365, the motor is rotated in the clockwise direction to reduce the internal pressure of the tubes between the three types of valves (total of five valves) and pumps (total of two pumps) to a predetermined level. Then, in Step S366, the motor is rotated in the counterclockwise direction to realize the state correspondent to the cam position (6), in which only the suction valve is opened to make negative the internal pressure of the cap. While the state of the recovery system unit 300 is changed from the state correspondent to the cam position (5) to the state correspondent to the cam position (6), the pump driving system rotates to rotate the pump in the direction of the arrow mark $A_{310}$ by only 45 degrees. However, since the driving mechanism of the pump driving system is structured so that the roller guide does not rotate during the period correspondent to the aforementioned play of 55 degrees, the pump is not driven during this period, and therefore, the pump tube 325 remains squashed.

If it is possible in this state to suction the predetermined amount of ink necessary to remove the dry ink, bubbles, and the like in the nozzles, the suction based recovery operation may be ended at this point. In this embodiment, however, it is assumed that the amount of ink suctioned up to this point is not sufficient, and suctioning is continued. Next, in Step S367, the motor is rotated again in the clockwise direction to activate the pump, so that negative pressure is generated for auctioning. Next, in Step S368, as soon as the amount of the ink which has been suctioned reaches the predetermined amount, the motor is rotated in the counterclockwise direction to open the air vent valve and stop the auctioning, so that the state correspondent to the cam position (7), in which the internal space of the cap 308 is open to the atmospheric air, is realized. Next, in Step 369, the motor is rotated in the clockwise direction to discharge the ink within the air vent tube 339, cap tube 338, and pump tube 325 into the waste ink processing means. Then, in Step S370, the motor is rotated in the counterclockwise direction to realize the state correspondent to the cam position (1), in which the cap is open, and in Step S371, the wiping process is carried out. Next, in Step 372, the secondary ejection process is carried out, and in Step 373, the no-load secondary ejection process is carried out. Lastly, in Step S374, the carriage is moved to he home position, and in Step 375, the motor is rotated in the counterclockwise direction to cap the nozzle equipped surface, ending the suction based recovery process.

Figure 42:
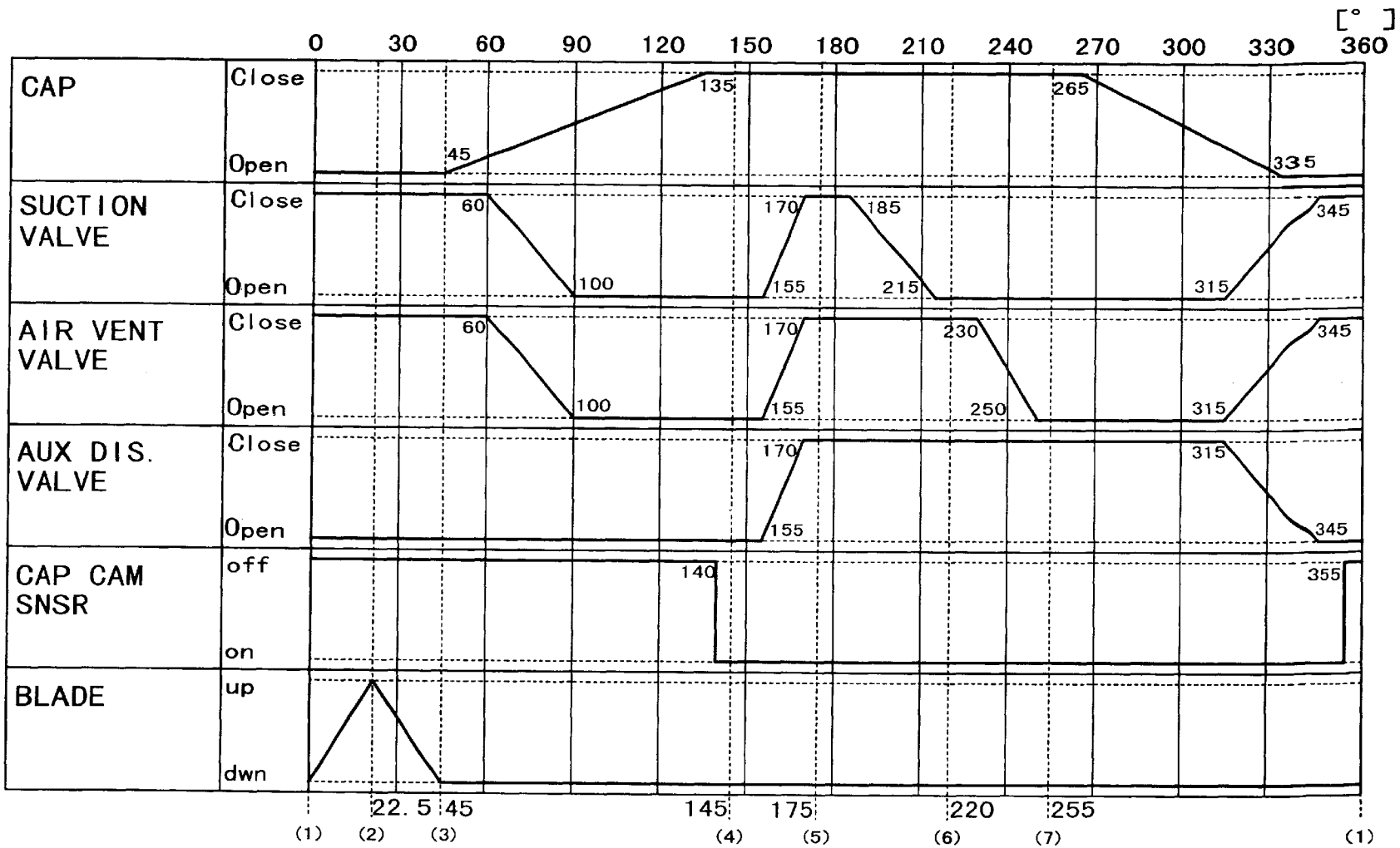
FIG. 42 is a timing chart illustrating an operation of various members interrelated with a cam.
Figure 43A:
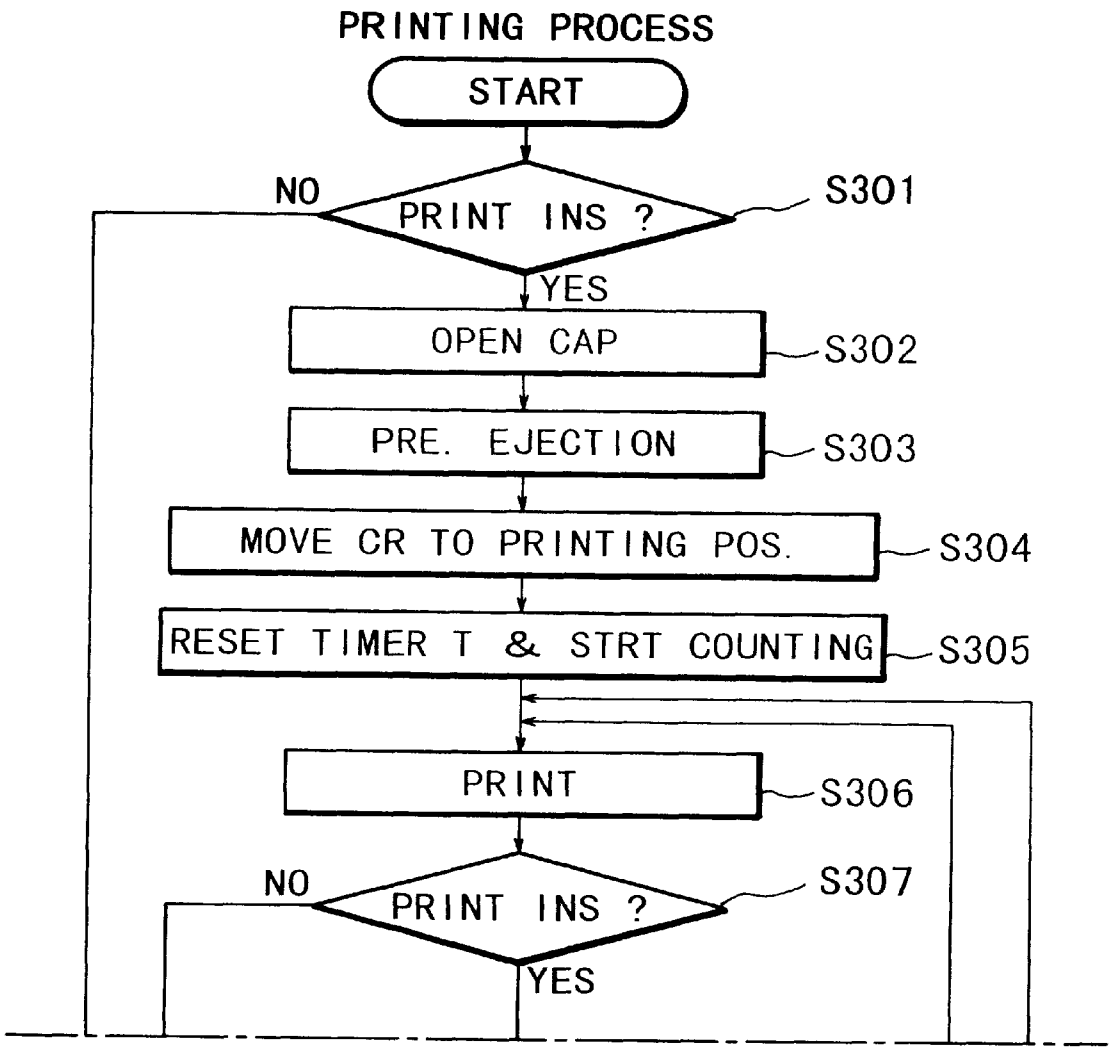
FIG. 43 is a flow chart of a printing process.
Figures 43, 43B:
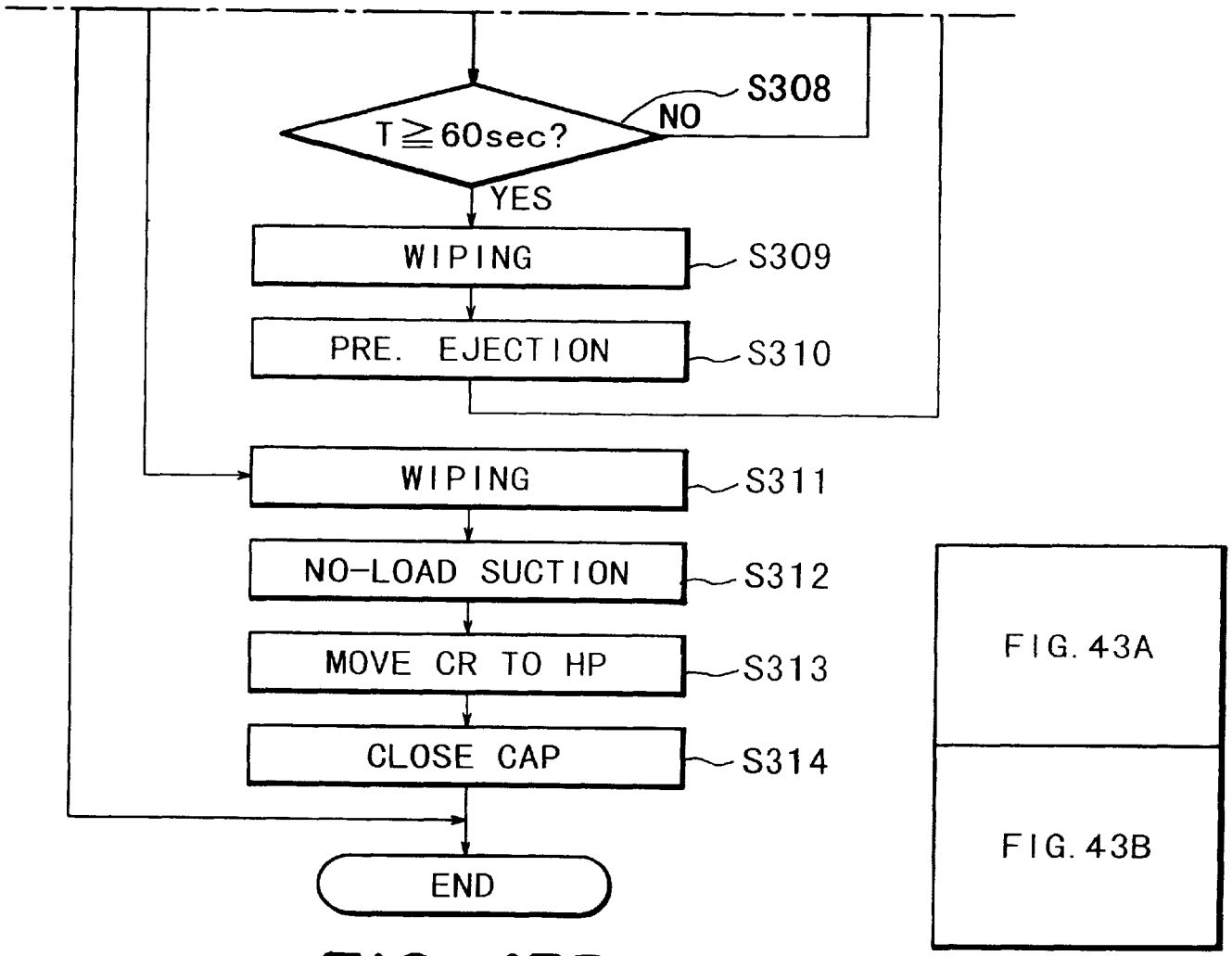

The cam sensor listed in FIG. 42 is a photo-interrupter which uses, as a flag, an unillustrated cap cam fixed to the cam shaft. It is a sensor that makes it possible for the phases of the cam and the like fixed to the cam shaft to be determined based on the result of its detection. The detection timings of the cap cam sensor are set to be immediately before the cap is opened and immediately before the cap is closed. This is due to the following facts. That is, in this embodiment, when the cap is open, the cap lever cam 350 is under the force applied in the counterclockwise direction in FIG. 36 by the cap spring, which has a total resiliency of approximately 800 gf, through the cam follower 311*a* integral with the cap lever 311, and therefore, there is a possibility that the cap lever cam 350 will overrun in the direction in which the one-way clutch slips, which results in phase synchronization errors. On the other hand, when the cap is in the closed position, the cam shaft is subjected to the large amount of load, presenting a danger that the motor for driving the recovery unit system, that is, a stepping motor, will go out of synchronism. In other words, the cam sensor is provided to correct the phase synchronization errors so that the cam is controlled under the condition in which all the components are in synchronism in terms of operational phase.

(Liquid Ejecting Head Unit)

Figure 48:
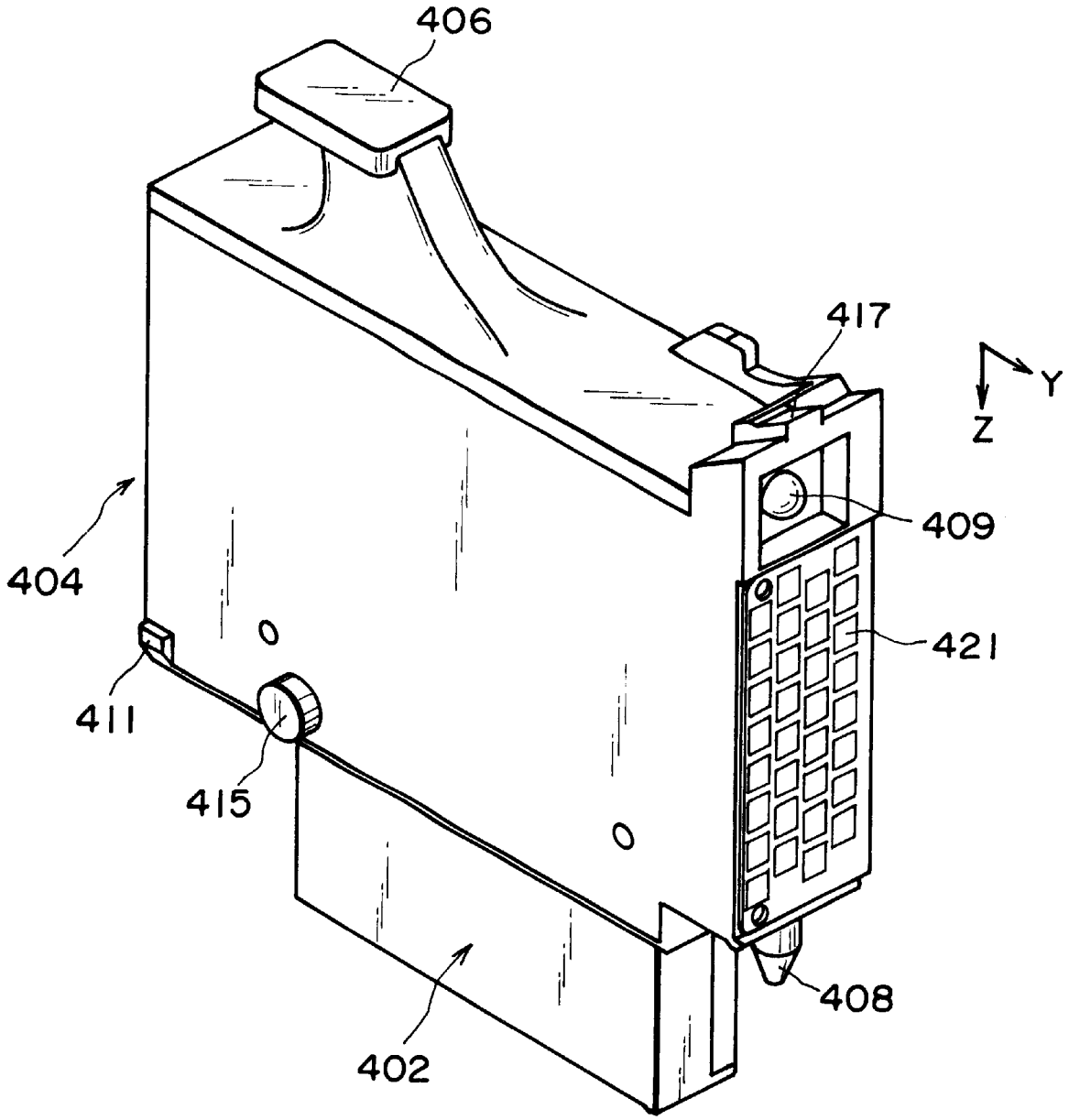
FIG. 48 is a perspective view of a liquid ejecting head unit.
Figure 49:
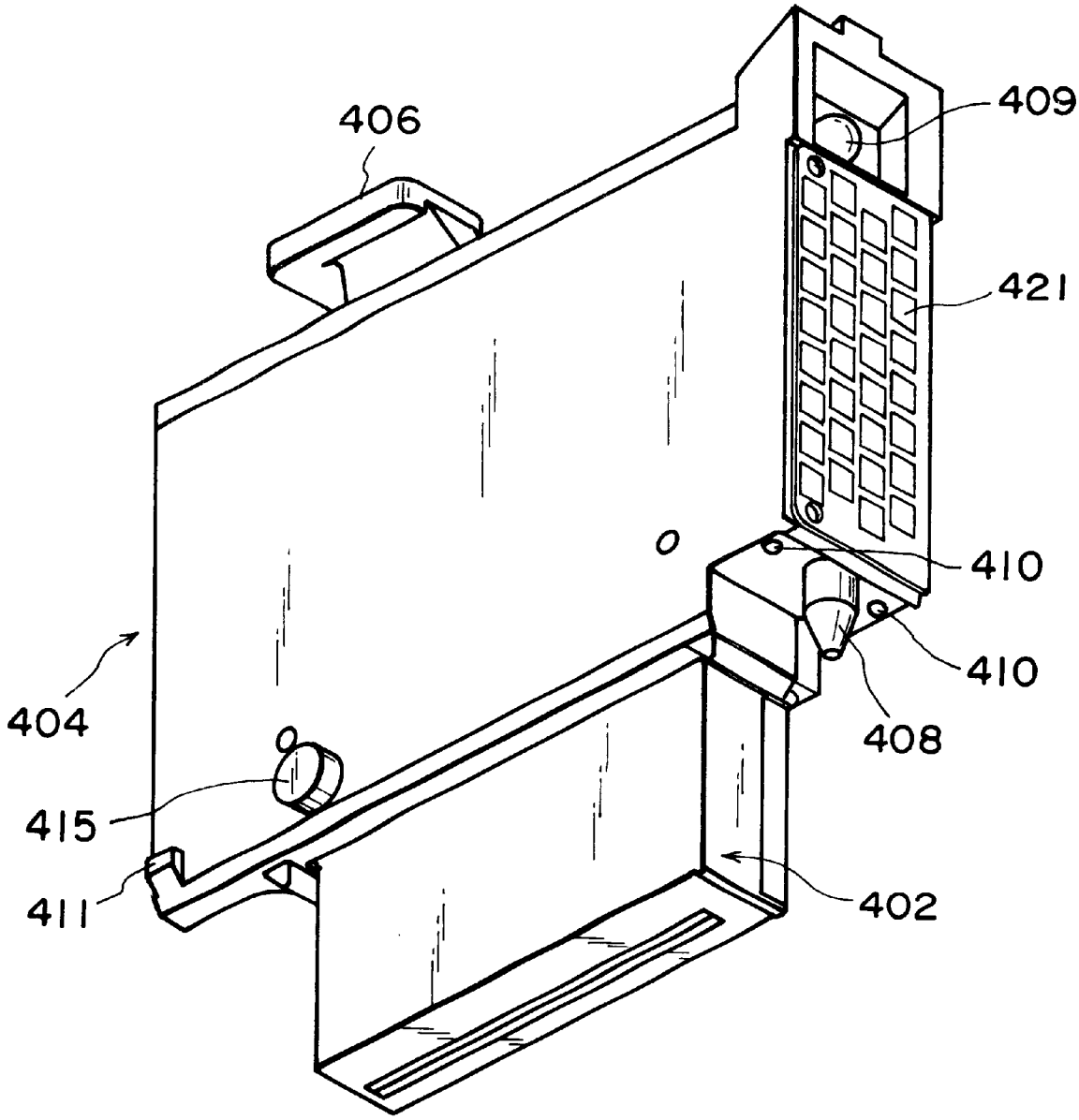
FIG. 49 is a perspective view of a liquid ejecting head unit.
Figure 50:
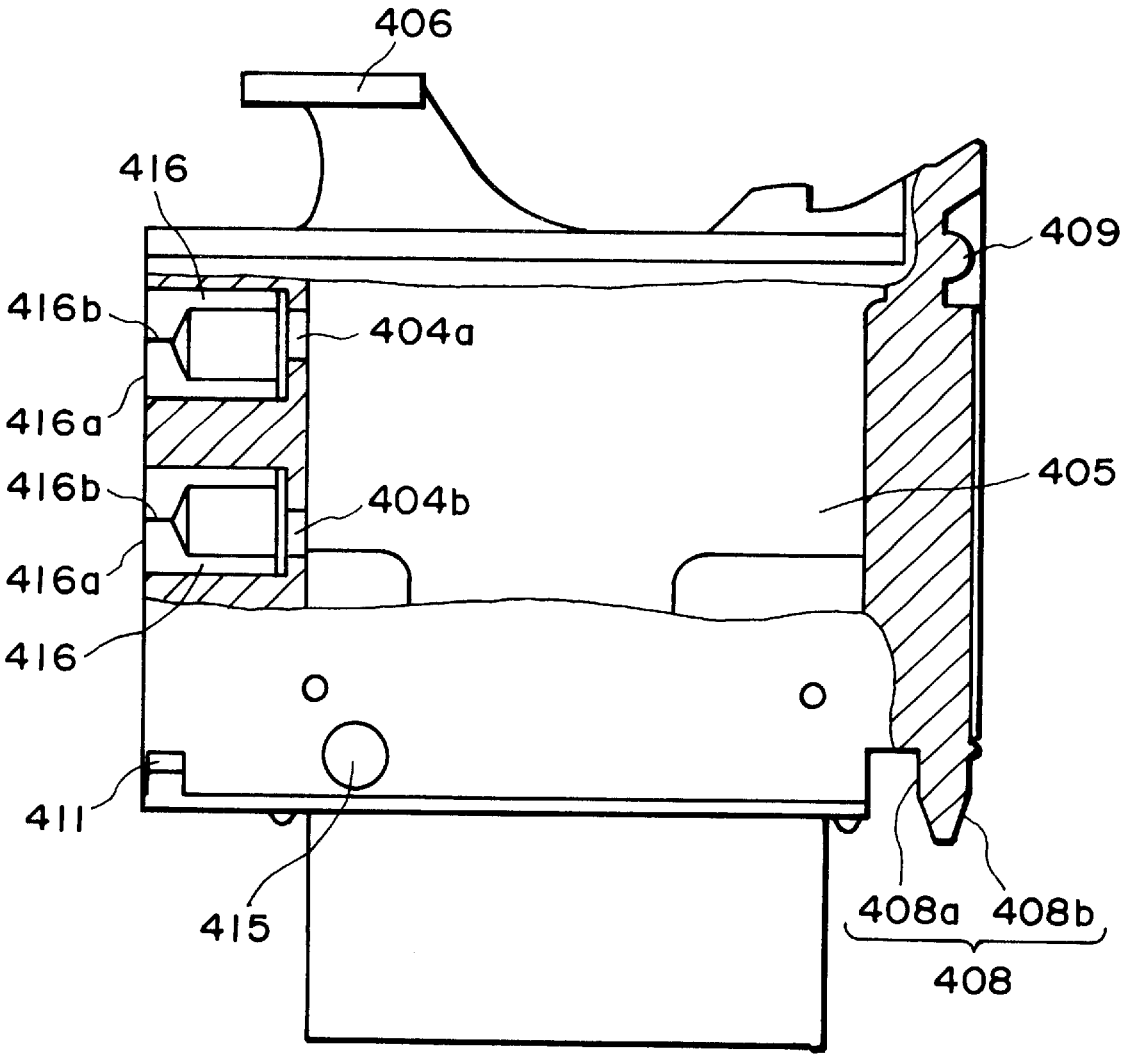
FIG. 50 is a sectional view of a liquid ejecting head unit.

FIGS. 20, 48–50 illustrates a structure of the liquid ejecting head unit 401, and FIGS. 20, 48, 49 are perspective views of an outer appearance, and FIG. 50 is a partially sectional view.

In this embodiment, the liquid ejecting head unit 401 comprises a droplet ejection member having an array of ejection outlets (nozzles) through which droplets are ejected in response to printing signals, ("head chip") 402, a sheet wiring member 403 for a flexible cable, a TAB or the like for electric communication of printing signals between the printing machine and the main assembly, an ink storing chamber for accommodating the liquid such as ink to be supplied to the head chip 402, and a unit frame 404 for holding the head chip 402.

The head chip 402 the fixed to the unit frame 404 by welding of a positioning boss 404*a* or by screws 451 or the like, and they can be easily separable.

In the unit frame 404, there is provided a second common liquid chamber 405 for accommodating a desired amount of the ink, and the ink in the second common liquid chamber 405 is supplied to the head chip 402 and is supplied to the nozzle portion through the ink passage of the container chip 603, and the first common liquid chamber 605*a* of the top plate 605.

The grip 406 disposed at an upper position of the liquid ejecting head unit 401 facilitates the mounting and demounting of the liquid ejecting head unit 401 of relative to the carriage 200.

The positioning portions 408–411 are effective to correctly position the liquid ejecting head unit 401 in the carriage 200, and include a guide pin 408 having a circular column configuration disposed on the bottom surface of the liquid ejecting head unit 401 and spherical projection 409 disposed on the rear surface of the liquid ejecting head unit 401. The center of the spherical projection 409 is positioned on an extension of a center line of the circular column portion of the guide pin 408. When the inner circular column wall 408*a* of the guide pin 408 and the spherical projection 409 are abutted to a predetermined position of the carriage 200, the liquid ejecting head unit 401 is correctly positioned relative to the print medium in the perpendicular direction.

The taper surface 408*b* at the free end portion or leading end portion of the guide pin 408 functions as a guide for inserting the guide pin 408 to a predetermined position.

When the spherical projection 410 which is provided at each of two positions on the bottom surface of the liquid ejecting head unit 401 is adopted to a predetermined position of the carriage 200, the liquid ejecting head unit 401 is correctly positioned in the direction of the height.

By a trapezoidal projection 411 provided on a side surface of the liquid ejecting head unit 401, the liquid ejecting head unit 401 (and ejection outlet array) is correctly positioned in the lateral direction of the carriage 200 and the inclination thereof is correctly set. The degree of inclination of the liquid ejecting head unit 401 relative to a line connecting a center of the guide pin 408 and a center of the spherical projection 409, changes with the height of the trapezoidal projection 411.

The circular column projection 415 provided on the side surface of the liquid ejecting head unit 401 is an insertion for forcedly inclining the liquid ejecting head unit 401, when the liquid ejecting head unit 401 is inserted into the carriage 200, and the free end of the guide pin 408 is guided to a predetermined position by the liquid ejecting head unit 401 being inclined.

When a carriage needle 222 is pierced through a joint rubber 416 into the second common liquid chamber 405, the ink is supplied from the main container 501 into the second common liquid chamber 405 which is disposed upstream of the carriage needle 222 and which is connected with the carriage needle 222 by connecting means such as a tube or the like.

The joint rubber 416 a has a plugging hole 416*b* formed by piercing the needle-like member from the front side 416*a*, and the joint rubber 416 is press-fitted into a hole portion having an inner diameter which is smaller than the outer diameter of the joint rubber 416. By such press-fitting, the plugging hole 416*b* receipts a compression weight from the outer periphery of the joint rubber 416, and therefore, when the carriage needle 222 is not inserted, the inside of the second common liquid chamber 405 is kept hermetically sealed. When the carriage needle 222 is inserted, a griping force (compressive force from the outer periphery) is applied to the carriage needle 222, and therefore, the joint portion can be completely sealed except for the hollow portion of the carriage needle 222.

The joint rubber 416 is provided at each of upper and lower positions, and the lower one is for a supply passage for supplying the ink from the main container 501, in which the ink is supplied into the second common liquid chamber 405 through the lower carriage needle 222 and hole 404*b*. On the other hand, the upper one is a suction passage for controlling the negative pressure in the liquid chamber by discharging the air accumulated within the second common liquid chamber 405 to the outside, and it is discharged to the outside of the second common liquid chamber 405 through the hole 404*c* and the upper carriage needle 222 by suction driving means such as a pump.

By raising the negative pressure in the second common liquid chamber 405 through the suction passage, the ink supply control into the second common liquid chamber 405 can be accomplished.

The inclined abutment surface 417 receives load of the carriage to the liquid ejecting head unit 401, and because of the inclination, when the surface 417 receives the load, a component force is produced in the arrow Z direction and in the arrow Y direction, so that liquid ejecting head unit 401 is urged in the two directions.

A contact pad 421 is provided for complication of the printing signals between the head chip 402 and the printing machine.

(Chip Structure)

Figure 63:
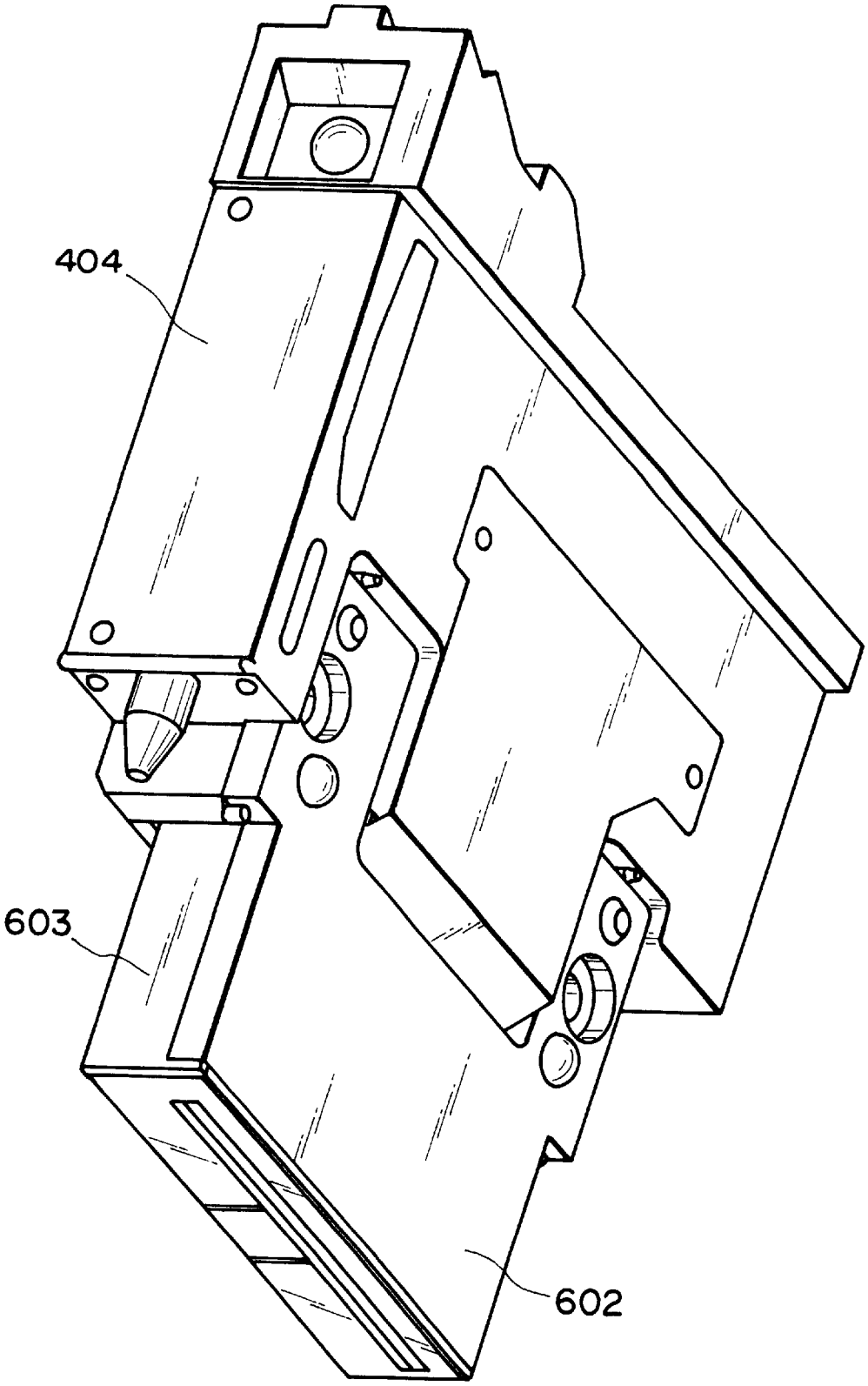
FIG. 63 is a perspective view illustrating a liquid ejecting head unit according to an embodiment of the present invention.
Figure 64:
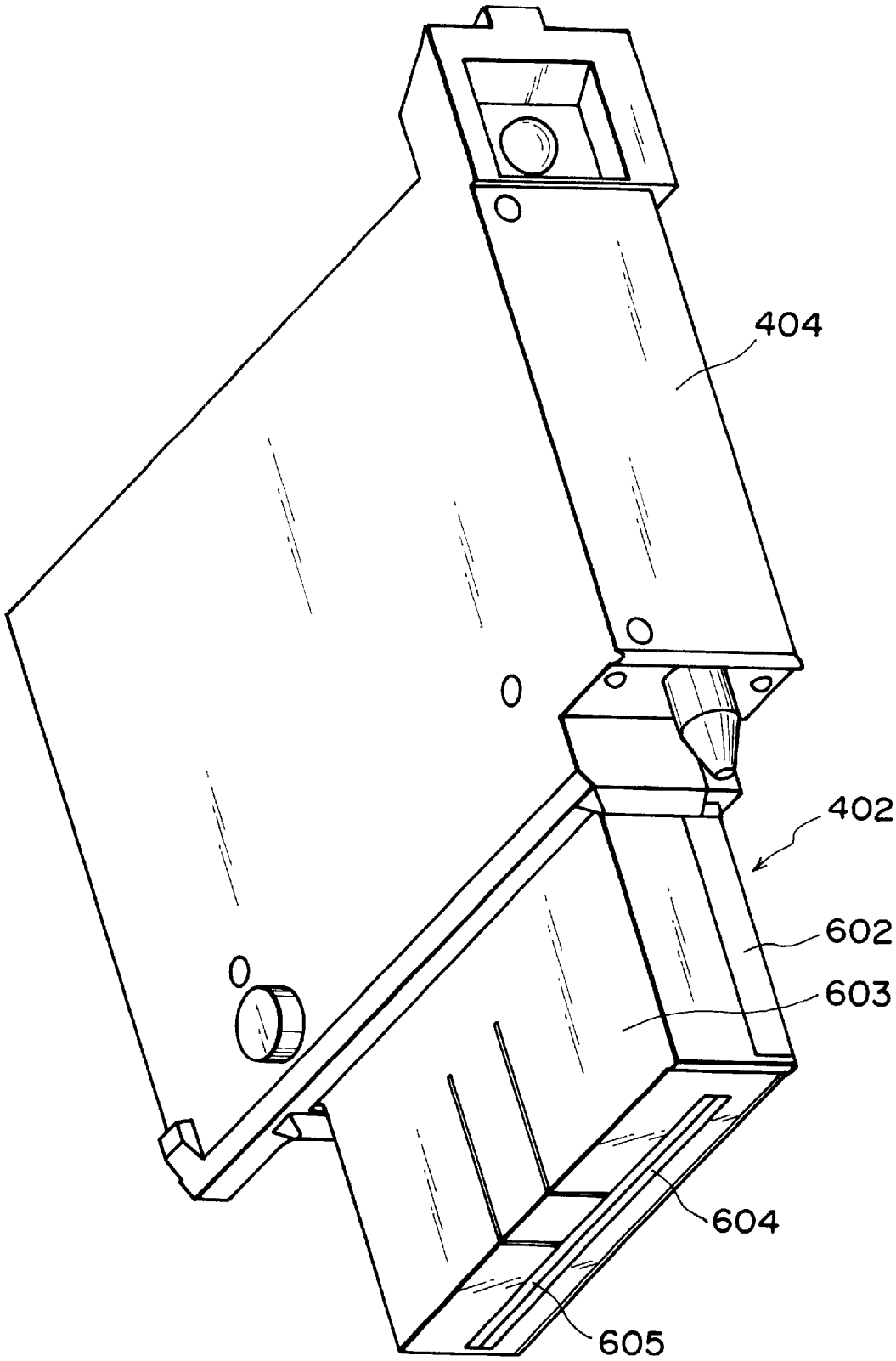
FIG. 64 is a perspective view of the liquid ejecting head unit of FIG. 63 as seen in another direction.
Figure 65:
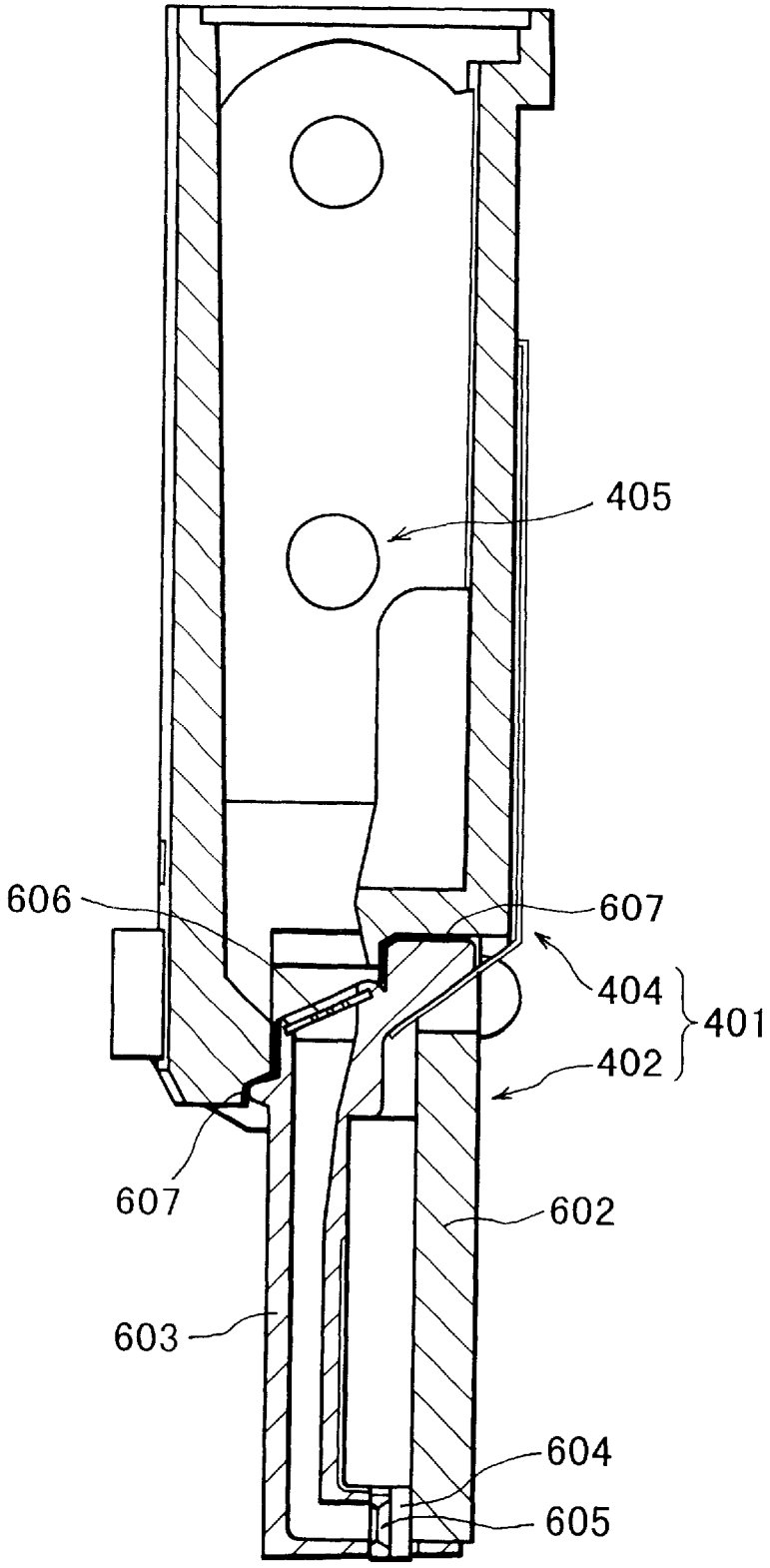
FIG. 65 is a longitudinal sectional view of the liquid ejecting head unit shown in FIG. 63.
Figure 66:
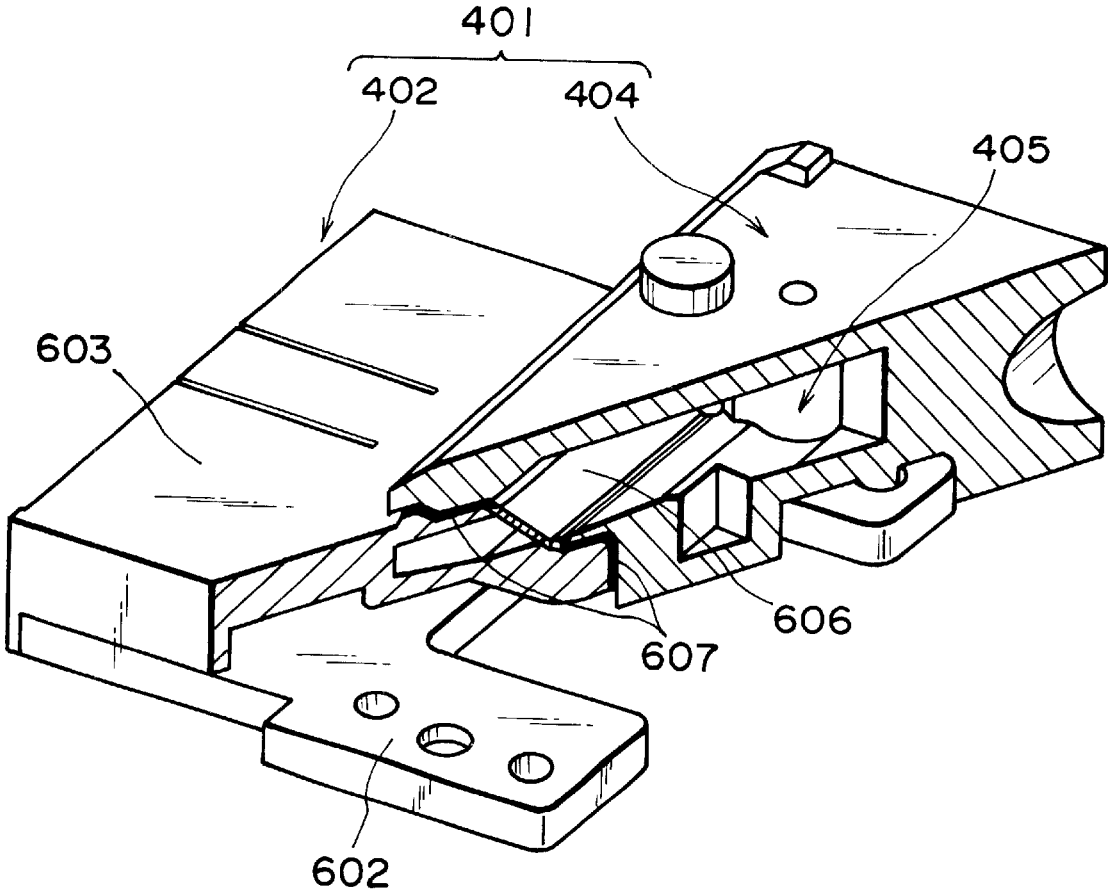
FIG. 66 is a partly broken perspective view of the liquid ejecting head unit, the container chip and the second common liquid chamber.
Figure 67:
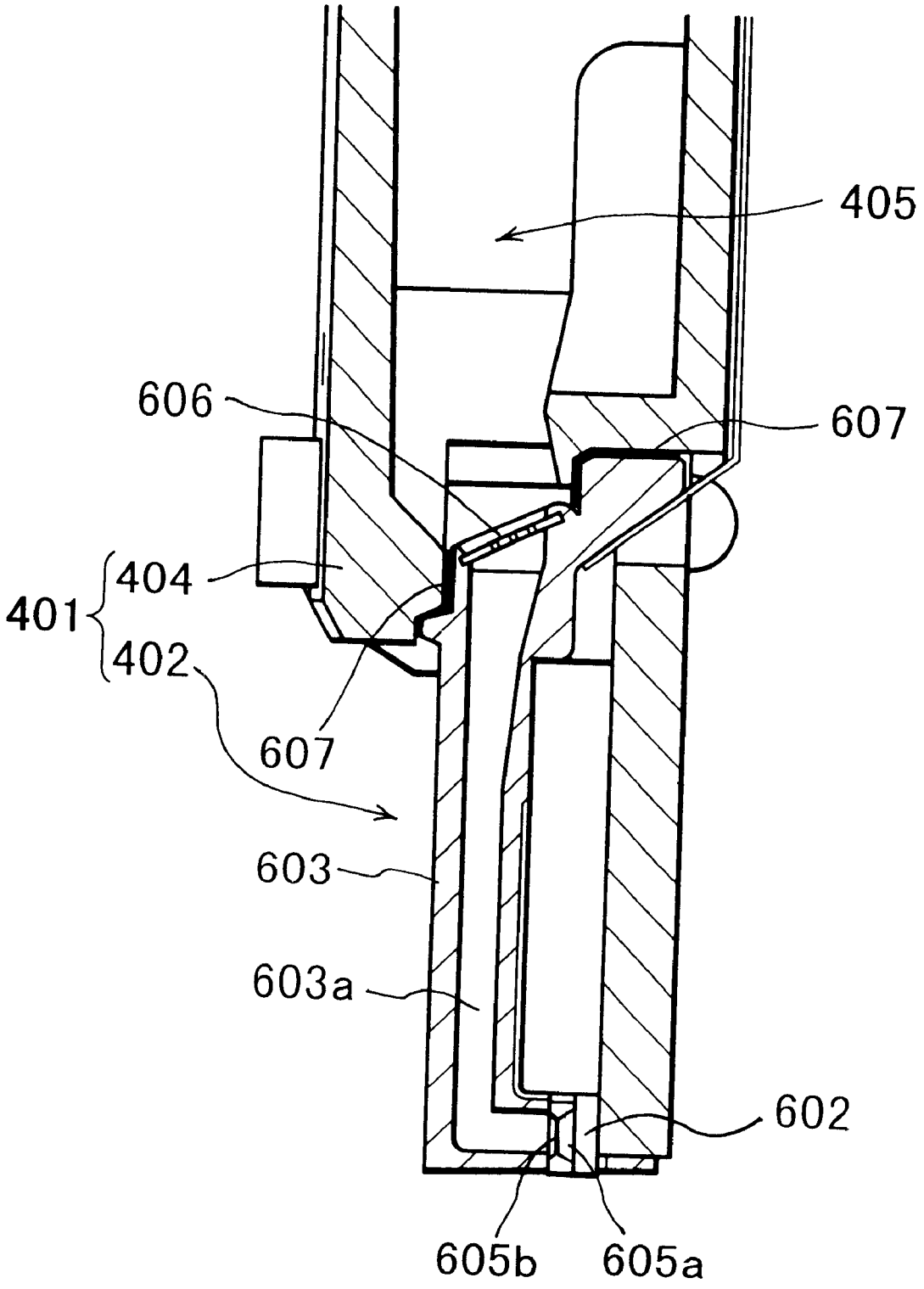
FIG. 67 is an enlarged sectional view of a connecting portion between the container chip of the liquid ejecting head unit and the second common liquid chamber.

The description will be made as to the structure of the liquid ejecting head unit 401 in more detail. FIG. 63 is a perspective view illustrating the liquid ejecting head unit 401 of this embodiment, FIG. 64 is a perspective view as seen in another direction, and FIG. 65 is a longitudinal sectional view. FIG. 66 is a proudly broken-away perspective view of the liquid ejecting head unit 401 shown in FIG. 63, without parts of the container chip 603 and the second common liquid chamber 405, FIG. 67 is an enlarged sectional view of the connecting portion between the container chip 603 and the second common liquid chamber 405.

The head chip 402 of the liquid ejecting head unit 401 of this embodiment comprises an element substrate 604 having an array of ejection energy generating elements (unshown), provided for the flow paths, for applying ejection energy to the print liquid (ink or the like), a top plate 605, provided opposed thereto, for constituting the flow path, a container chip 603 functioning as a supply member for supplying the print liquid to the flow path, and a reference member 602 to which they are mounted with precise positions. A unit frame 404 of the liquid ejecting head unit 401 comprises a connecting portion for feeding the supply liquid to the container chip 603, a connecting portion for escaping the air in the liquid chamber, and a second common liquid chamber 405 for retaining the print liquid temporarily or until it is used up. To the container chip 603 of the head chip 402, there is mounted a porous member 606 having pores, at the boundary portion relative to the second common liquid chamber 405, for trapping impurities in the print liquid. A filling material 607 of silicone rubber or the like is filled into the connecting portion between the second common liquid chamber 405 and the container chip 603.

The description will be made as to various parts.

The second common liquid chamber 405 functions as a buffer for retaining the print liquid, and when the print liquid is consumed by ejections, the print liquid is supplied properly from the second common liquid chamber 405 into the first common liquid chamber 605*a* (FIG. 67) constituted by the top plate 605 and the element substrate 604. The second common liquid chamber 405 is provided with a connecting portion for receiving the print liquid from a print liquid storing container which is separately provided, and a connecting portion for escaping the air from the liquid chamber to the outside.

The container chip 603 functions as a flow path for properly supplying the print liquid from the second common liquid chamber 405 to the first common liquid chamber 605*a* (FIG. 67).

The porous member 606 is provided between the second common liquid chamber 405 and the container chip 603 and functions to trap the impurities or the like In the print liquid. In this embodiment, the porous member 606 is connected with the container chip 603 by welding. Therefore, no gas enters the flow path through the connecting portion between the container chip 603 and the porous member 606.

The container chip 603 and the top plate 605, as shown in FIG. 67, are connected to each other with the print liquid supply passage 603*a* of the container chip 603 in fluid communication with the print liquid supply port 605*b* of the top plate 605. The fastening within the container chip 603 and the top plate 605 are effected by press-contact at the connection surfaces, and for the supplementation, a filling material (unshown) is applied to the circumference of the connection surfaces, for the purpose of sealing.

As described hereinbefore, between the container chip 603 and the second common liquid chamber 405, a filling material 607 is applied all around to provide hermetical seal between the second common liquid chamber 405 and the container chip 603. However, the filling material 607 of silicone rubber or the like exhibits gas permeability, the ambience can enter the second common liquid chamber 405 through the filling material 607. The gas having entered the second common liquid chamber 405 rises in the second common liquid chamber 405 due to the buoyancy and stagnates at the top of the liquid chamber to constitute a gas layer. The gas is passed through a connecting portion (unshown) for escaping the gas from the second common liquid chamber 405 to the outside, and is finally discharged to the outside.

In this embodiment, the connecting portion between the container chip 603 and the second common liquid chamber 405 is disposed upstream of the porous member 606 with respect to a direction of flow of the print liquid. Therefore, the gas having passed through the filling material 607 does not enter the container chip 603 which is downstream of the porous member 606. Even if a solid matter is produced due to coagulation of a part of print liquid due to drying or the like in the second common liquid chamber 405, the porous member 606 is capable of trapping the solidified material.

With the above described structure, the amount of the gas which enters the flow path within the range downstream of the porous member 606, that is between the print liquid supply passage 603*a* and the head chip 402, and therefore, the influence to the liquid ejecting property attributable to the existence of the gas in the flow path downstream of the porous member 606. Additionally, the amount of the gas existing in the flow path downstream of the porous member 606 decreases, and therefore, the refreshing operation which is carried out when the liquid ejecting head is used after a long-term rest, can be simplified.

Accordingly, the amount of the print liquid discharged wastefully by the refreshing operation is decreased, so that usage of the print liquid is improved.

Figure 68:
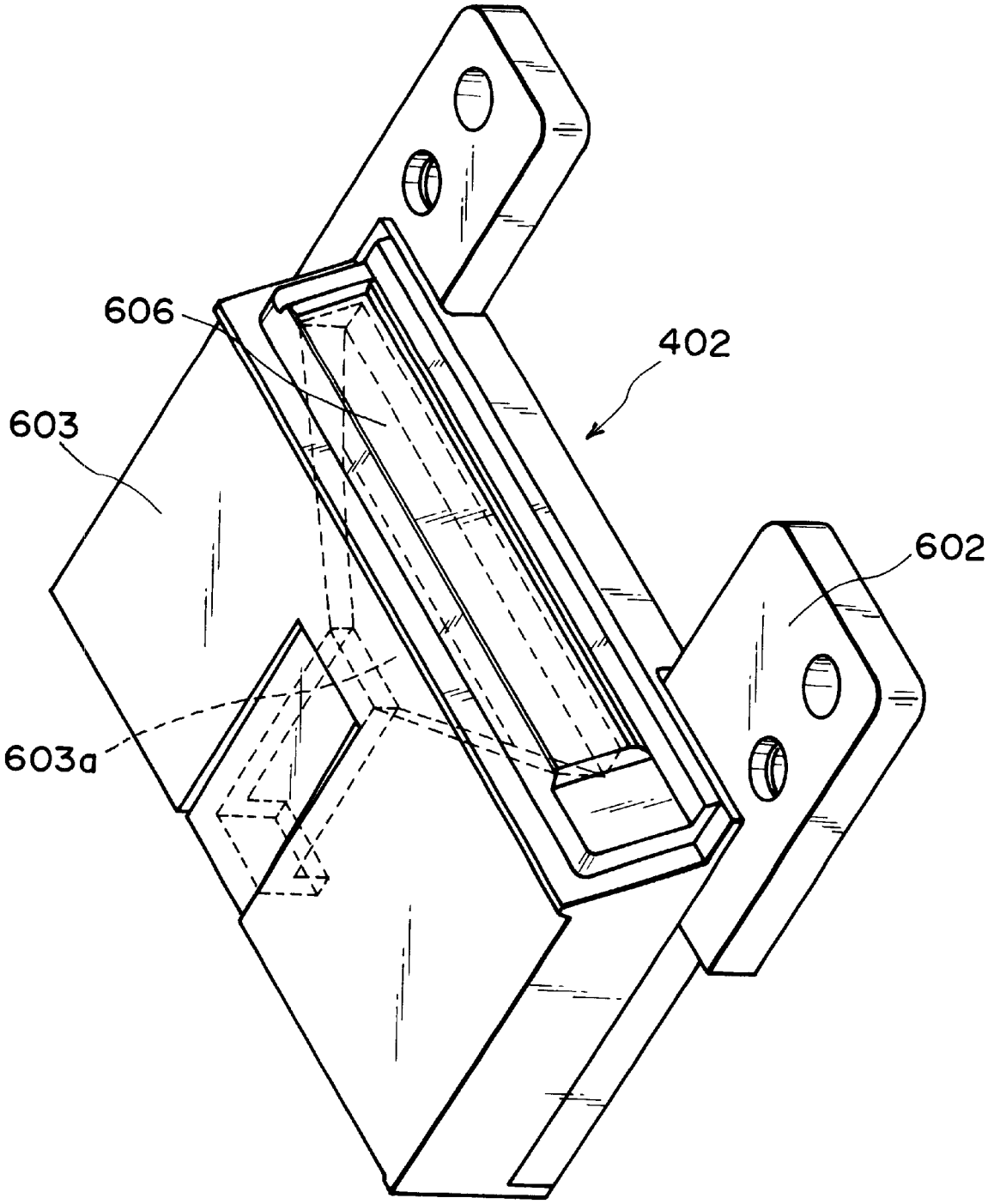
FIG. 68 is a perspective view illustrating a head chip of the liquid ejecting head unit shown in FIG. 63.
Figure 69:
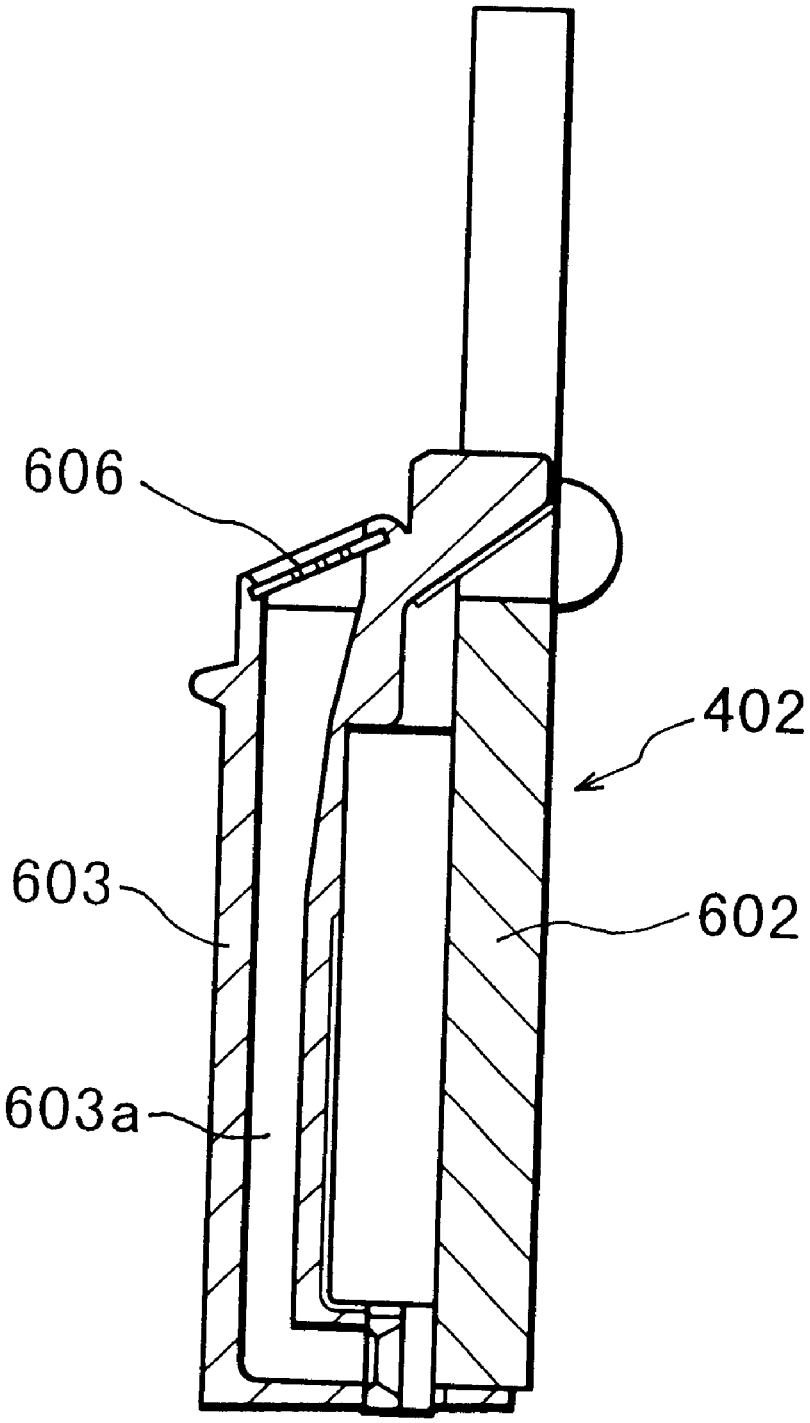
FIG. 69 is a sectional view of a head chip of the liquid ejecting head unit shown in FIG. 63.

FIG. 68 is a perspective view illustrating only the head chip 402 (without the unit frame 404) of the liquid ejecting head unit 401 shown the FIG. 63. FIG. 69 is a sectional view thereof.

As shown in FIG. 68, a cross-sectional area of the connecting portion of the container chip 603 relative to the second common liquid chamber 405 at the upstream side of the porous member 606 in the flow path, that is, at the second common liquid chamber 405 (FIG. 63 and so on) side is maximum in the print liquid supply passage 603*a*.

The porous member 606 is inclined relative to the liquid flow direction of the print liquid supply passage 603*a* of the container chip 603. The area of the porous member 606 is larger than the cross-sectional area (the area in a plane perpendicular to the flow path direction adjacent the connecting portion between the container chip 603 and the second common liquid chamber 405. In this embodiment, the area of the porous member 606 is approximately 20 times the minimum cross-sectional area of the print liquid supply passage 603*a*.

With the porous member 606 disposed in the above described manner, the bubble which is produced during the liquid ejecting operation and which rises in the print liquid supply passage 603*a* is trapped at an upper side (upstream side of the flow path) of the porous member 606 which is inclined. On the other hand, the lower side (downstream side of the flow path) of the porous member 606 is always contacted to the print liquid, and therefore, the print liquid flowing from the second common liquid chamber 405 through the porous member 606 to the print liquid supply passage 603*a* of the container chip 603 is not discontinued. Therefore, a sufficient flow rate of the print liquid required for the liquid ejection is supplied to the head chip 402.

Figure 70:
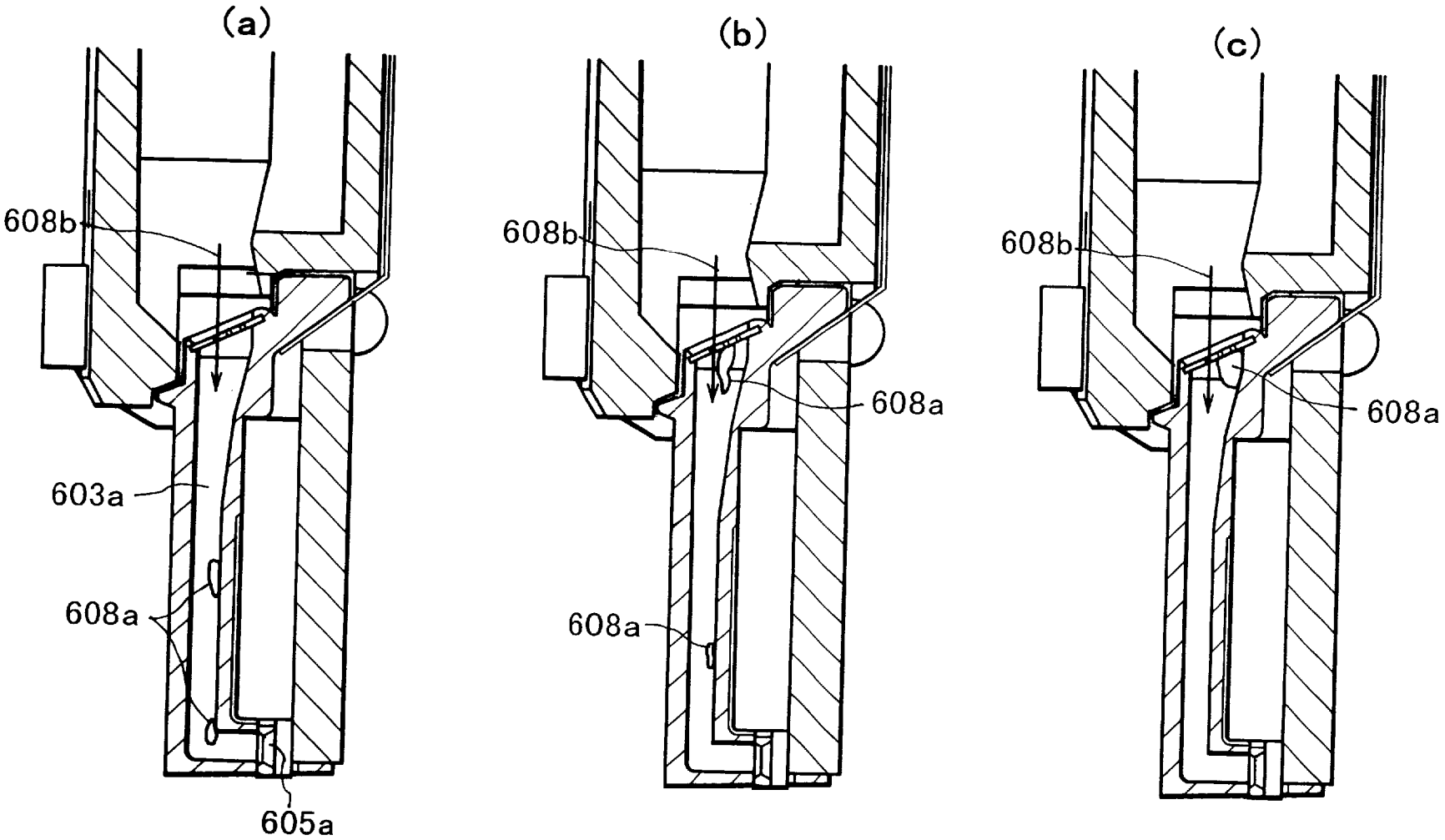
FIG. 70 is a sectional view stepwisely illustrating the flow of a bubble in the print liquid supply passage of the container chip.

Referring to FIG. 70, the description will be made as to the flow of the bubble in the print liquid supply passage 603*a* of the container chip 603.

As shown in FIG. 70, (a), the bubble 608*a* produced in the flow path by the ejecting operation rises in the print liquid supply passage 603*a*. At the time, the bubble 608*a* does not reach the porous member 606. Therefore, the entire area of the porous member 606 is contacted to the print liquid at the lower part, so that sufficient flow path area is provided. The flow of the print liquid from the second common liquid chamber 405 through the porous member 606 to the print liquid supply passage 603*a* of the container chip 603 is smooth. As shown in FIG. 70, (b), the bubble 608*a* reaches the porous member 606. The bubble 608*a* cannot pass through the porous member 606 because of the surface tension, and therefore, it stagnates at the lower part of the porous member 606. Even in this case, the bubbles 608*a* do not cover the whole surface of the porous member 606 in the lower part, and the bubbles 608*a* do not grow so largely as to cover the entire cross-sectional area of the passage of the print liquid supply passage 603*a*, and therefore, a sufficient flow path area is assured so that flow of the print liquid 608*b* is assured to get The flow 608*b* is in the vertical direction.

The bubbles 608*a* stagnating at the lower part of the porous member 606, as shown in FIG. 70, (c), move up along the porous member 606 which is inclined to relative to the liquid flow direction of the print liquid supply passage 603*a*. The print liquid flow path downstream of the porous member 606 is assured until the bubbles 608*a* cover the whole surface of the porous member 606. Before that, the flow of the print liquid is assured. In this embodiment, the porous member 606 has an area which is approximately 20 times the area of the print liquid supply passage, and therefore, the flow of the print liquid is assured for a substantially long-term. Moreover, the bubbles 608*a* stagnating at the lower part of the porous member 606 can be removed by properly carrying out the recovery sucking operation.

A ratio of the cross-sectional area of the passage of the part of the print liquid supply passage 603*a* to which the porous member 606 is mounted and the area of the porous member 606, can be selectively determined by changing a mounting angle of the porous member 606.

The horizontal direction is 0° here. When the mounting angle of the porous member 606 is 30°, the area of the porous member 606 is approximately 1.1 times the cross-sectional area of the passage of the portion to which the porous member 606 is mounted or a little larger than that. When the angle is 45°, it is 1.4 times or a little larger than that, and when the angle is 60°, it is 1.7 times or a little larger than that. The area ratio is determined in consideration of the outer dimensions of the liquid ejecting head unit 401, the assembling property thereof or the like.

If the porous member 606 is extended perpendicularly to the liquid flow direction in the print liquid supply passage 603*a*, that is, the print liquid supply passage 603*a* is along the rising direction of the bubble, the bubble 608*a* ads tended to stagnate at the center of the print liquid supply passage 603*a* in the lower part of the porous member 606. The bubbles 608*a* stagnating there may expand in the horizontal direction with a result of plugging the flow path in the lower part of the porous member 606. However, since the porous member 606 is inclined, the bubbles reaching the porous member 606 stagnated at the upper part of the print liquid supply passage, and do not expand in the horizontal direction. Accordingly, the flow 608*b* of the print liquid is assured in the lower part of the porous member 606. Thus, the frequency of the refreshing operations for assuring the print liquid flow path can be reduced, and therefore, the decrease of the print liquid use efficiency and the decrease of the recording speed due to the necessity for the refreshing operation can be avoided.

When the porous member 606 is inclined, the connecting portion within the container chip 603 and the second common liquid chamber 405 is also inclined. Therefore, by injecting the filling material 607 into the connecting portion from the upper part, the filling material 607 can be smoothly injected, and therefore, the productivity of the liquid ejecting head is improved.

(Ink Container Portion)

Figure 5:
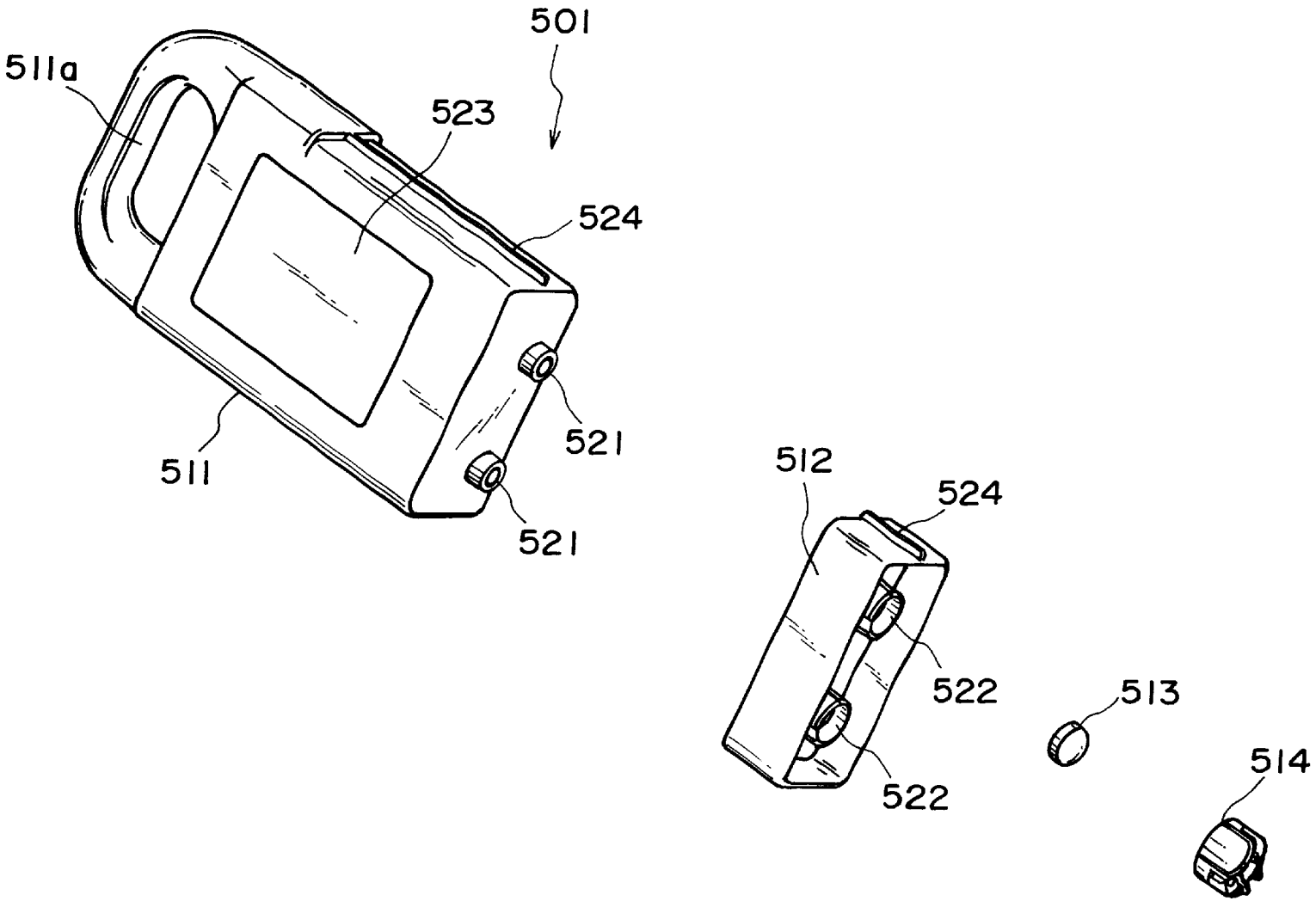
FIG. 5 is an exploded view of the main container.

FIG. 5 is an exploded perspective view of an ink cartridge according to an embodiment of the present invention.

An ink storing chamber is constituted by an ink container 511 and a cap 512 of the ink container 511. The ink container 511 is manufactured by blow molding method, and is provided with a grip 511*a* to facilitate mounting and demounting of the container relative to the main assembly. A side surface of the ink container 511 is provided with a space 523 for being stuck with a label for product discrimination.

The cap 512 is fixed to the housing 521 of the ink container 511 by ultrasonic welding. A housing 522 for constituting communication ports are provided for the cap 512. They are provided with dome-like elastic members (rubber plugs) 513, respectively. Connecting portions are constituted with crown caps 514 as fixing members, for the connection with the main assembly of the printing machine, thus constituting an integral ink container, that is, an ink cartridge.

A circular column projection 415 is provided on the side surface of the unit frame 404 of the liquid ejecting head unit 401 to correctly guide the free end of the guide pin 408 to the rib 200*m* which provides a hole in a carriage 200 by contacting the guide portion 200*g* when the liquid ejecting head unit 401 is inserted into the carriage 200 in the direction indicated by an arrow J in FIG. 58, and a trapezoidal projection 411 provided on the side surface of the liquid ejecting head unit 401 is correctly positioned relative to the left-hand circumference surface 241*a* of the CR cam head 241 which is an adjusting mechanism portion for adjusting the inclination of the liquid ejecting head unit 401.

When the circular column projection 415 is not provided, the trapezoidal projection 411 on the side surface of the liquid ejecting head unit 401 is these engaged from the carriage head cam 241, and the liquid ejecting head unit 401 as a whole is urged laterally minor urging force provided by the carriage head spring 242, when the liquid ejecting head unit is mounted to the carriage 200.

In this case, it is difficulty to restore the liquid ejecting head unit 401 to the insertion position. In addition, if an attempt is made to move the liquid ejecting head unit 401 back to the head unit, a shearing force is applied to each of the trapezoidal projection 411 and the carriage head cam 411, the trapezoidal projection 411 and the carriage head cam 241 are likely to be broken.

In this embodiment, as described hereinbefore, when the liquid ejecting head unit 401 is inserted into the carriage 200, the circular column projection 415 on the side surface of the liquid ejecting head unit 401 is abutted to the guide portion 200*q* of the carriage 200, and a circular column projection 415 is slid on the cam surface of the guide portion 200*q*. By this time, the liquid ejecting head unit 401 is inserted with inclination toward the operator, but the circular column projection 415 and the trapezoidal projection 411 to the guide pin 408 are limited within a predetermined range by the sliding of the circular column projection 415 along the guide portion 200*q*, so that trapezoidal projection 411 is prevented from disengaging from a contact surface of the carriage head cam 241, and that free end of the guide pin 408 is prevented from disengaging from the engaging portion of the rib portion 200*m*.

On the other hand, when the retaining force for the liquid ejecting head unit 401 is released by the rotation of the CR lever 237 upon dismounting of the liquid ejecting head unit 401, the liquid ejecting head unit 401 is pushed out by the reaction force of the carriage joint lever spring 216 and the arm (unshown) of the CR lever 237. In this case, the circular column projection 415 abuts to the guide portion 200*q*, and therefore, the liquid ejecting head unit 401 is inclined toward the operator, and the inclination angle is limited within a predetermined range. Therefore, the liquid ejecting head unit 401 is prevented from disengaging from the carriage 200 with the trapezoidal projection 411 disengaged from the contact surface of the carriage head cam 241.

In this number, by inserting the liquid ejecting head unit 401 into the carriage 200 while sliding the circular column projection 415 provided on the side surface of the liquid ejecting head unit 401 on the cam surface of the guide portion 200*q* provided on the carriage 200, the liquid ejecting head unit 401 can be correctly mounted easily to the head unit inserting position of the carriage 200 having the angular position adjusting mechanism portion.

By the provision of the circular column projection 415 on the side surface of the liquid ejecting head unit 401, the circular column projection 415 abuts the guide portion 200*q* when the liquid ejecting head unit 401 is dismounted from the carriage 200, and therefore, the inclination angle of the liquid ejecting head unit 401 is limited within the predetermined range. Thus, it is avoided that liquid ejecting head unit 401 is dismounted from the carriage 200 with the trapezoidal projection 411 out of engagement with the contact surface for the carriage head cam 241, and therefore, the possible damage of the trapezoidal projection 411 and the carriage head cam 241 constituting the angular position adjusting mechanism portion.

In the foregoing description, the liquid ejecting head unit 401 is provided with the guide pin 408, and the carriage 200 is provided with the corresponding hole (rib portion 200*m*), but the carriage 200 may be provided with a guide pin, and liquid ejecting head unit 401 may be provided with a hole.

As described in the foregoing, the presentation provides the following advantageous effects.

The projection is provided on the side surface of the liquid ejecting head unit, and the liquid ejecting head unit is inserted into the carriage, and therefore, the liquid ejecting head unit is correctly led to the predetermined position of the angular position adjusting mechanism portion, so that pin providing the fulcrum for the rotation of the liquid ejecting head unit is correctly guided to the hole, by which the liquid ejecting head unit can be correctly and easily mounted to the head unit inserting position.

When the liquid ejecting head unit is dismounted from the carriage, the projection may be prevented from disengaging from the predetermined position of the angular position adjusting mechanism portion, and in such a case, the damage of the angular position adjusting mechanism portion can be prevented.

In the printing apparatus according to an embodiment of the present invention, the liquid ejecting head unit is support rotatably on the carriage for rotation about a predetermined station, and the angular position of the liquid ejecting head unit thus supported is controllable, and therefore, the relative inclination of the liquid ejecting head in the direction of the ejection outlet array. The description will be made as to specific embodiment of the liquid ejecting head unit and the carriage.

The carriage has the structure shown in FIGS. 16, 19, 55–57, and the liquid ejecting head unit has the structure shown in FIGS. 48 and 49. With this structure, a line connecting the circular column center of the guide pin 408 and the center of the spherical projection 409 is the center of rotation of the cartridge 404. Thus, the front side of the liquid ejecting head unit moves about the rear side. Therefore, as shown In FIG. 57, when the carriage head cam 241 rotates, the trapezoidal projection 411 sandwiched between the carriage head cam 241 and the carriage head spring 242 moves along the cam surface so that unit frame 404 rotates about the fulcrum. By doing so, the relative position between the liquid ejecting head unit and the carriage can be adjusted.

With this structure, the carriage head cam 241 may be an eccentric cam having a true circular shape, or may be a cam of free curve. When the use is made with the, the degree of eccentricity changes depending on the rotation angle, and it is desirable that intervals of the grooves 243*a* formed in the outer surface of the carriage head dial 243 is made non-uniform so as to provide uniform degrees of the eccentricity. Thus, this system is advantageous in that parts are inexpensive, but the operativity is not good because of the non-uniformity of the clicking pitch, and only one half of the periphery of the eccentric cam (180°) is usable.

On the other hand, when the free curve is used, the intervals of the grooves 243*a* provided on the outer surface of the carriage head dial 243 may be regular, so that clicking pitch is uniform, and therefore, the operativity is better than the eccentric cam, and the eccentricity setting is possible over the entire periphery of the cam (360°). However, the provision of the free curve is made the parts expensive.

In the foregoing, the angle adjusting means for controlling the angular position position of the carriage head cam 241 comprises the carriage head dial 243 which has on the outer surface grooves 243*a* at predetermined circumferential intervals and which is rotatable in interrelation with the carriage head cam 241, and the locking mechanism (FIG. 57) which is slidable on the outer surface of the carriage head dial 243 and which is effective to the retain the rotational position of the carriage head dial 243 by engagement with the groove formed in the outer surface. However, the angle adjusting means is not limited to such a structure, but another mechanism is usable if the angular position of the liquid ejecting head unit can be controlled of stepwisely.

The carriage head dial 243 may be provided with an index which provides a rough indication of the angular position of the liquid ejecting head unit corresponding to the rotational position of the carriage head cam 241, by which the angular position can be adjusted on the basis of the index.

In consideration of the influence of the relative inclination in the direction of the ejection outlet array of the liquid ejecting head to the print quality, the adjusting angular pitch of rotation of the liquid ejecting head unit is desirably not more than 0.02°. More particularly, the angular position of the liquid ejecting head unit per 1 pitch of the grooves formed on the outer surface of the drum member is not more than 0.02°.

When the high precision control (the angular position is not more than 0.02°) is carried out, the carriage head cam 241 is directly rotated not through the drive-transmission system such as a gear. More particularly, as shown in FIG. 57, a slot is formed on an end surface of the cam shaft of the carriage head cam 241, and a "–" type screwdriver is used to rotate the cam shaft in the slot. By doing so, the influence of the play in the drive-transmission system can be avoided.

Furthermore, there may be provided a rotation angle detection portion for detecting mechanically or electrically the rotation position of the carriage head cam 241. By doing so, the angular position of the liquid ejecting head unit can be easily known, and therefore, the angle of rotation or the angular position of the liquid ejecting head unit can be easily adjusted.

Figure 71:
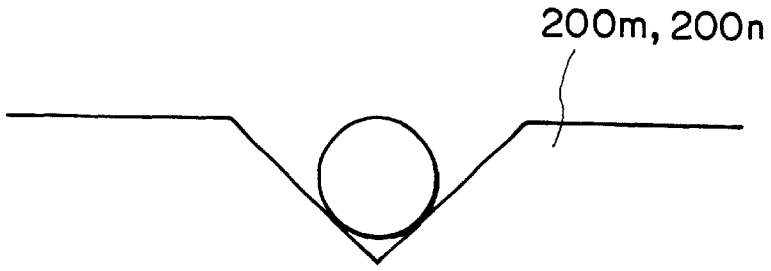
FIG. 71 illustrates an example of a rib in the carriage according to an embodiment of the present invention.

In order to effect the positioning of the liquid ejecting head unit, the "U"-shaped rib portions 200*m*, 200*n* provided on the carriage may be "V"-shaped as shown in FIG. 71. By using the "V"-shaped configuration, the contact surface relative to the abutting portion on the side surface of the boss provided on the bottom surface of the liquid ejecting head unit and the contact surface relative to the spherical abutting portion provided above the contact portion at the rear side of the liquid ejecting head unit can be made smaller. By doing so, the frictional resistance in the rotational direction of the liquid ejecting head unit can be reduced, so that urging force to be applied on the side surface of the unit frame 404 can be reduced.

Figure 72:
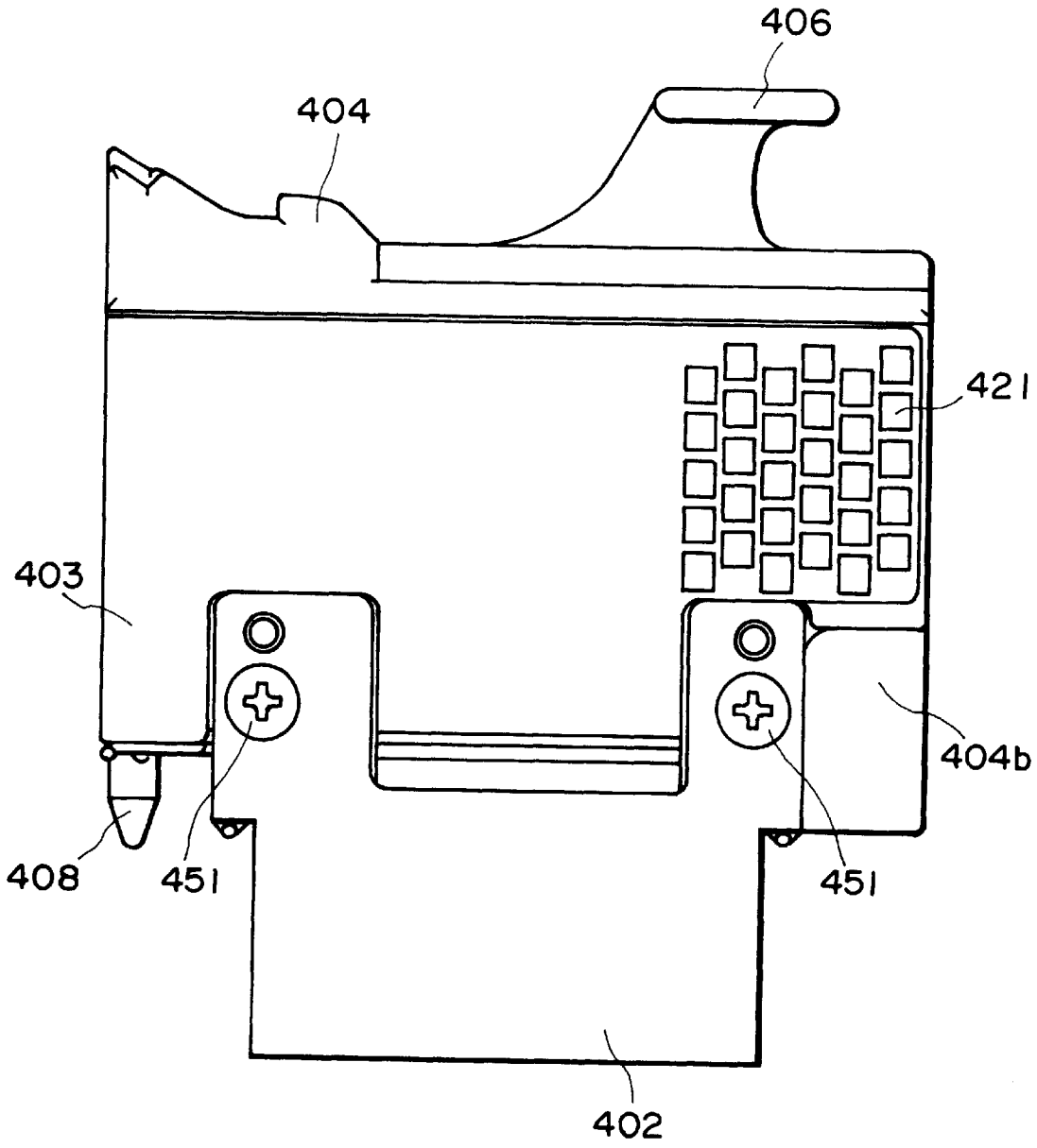
FIG. 72 illustrates a modified example of a liquid ejecting head unit according to an embodiment of the present invention.
Figure 73:
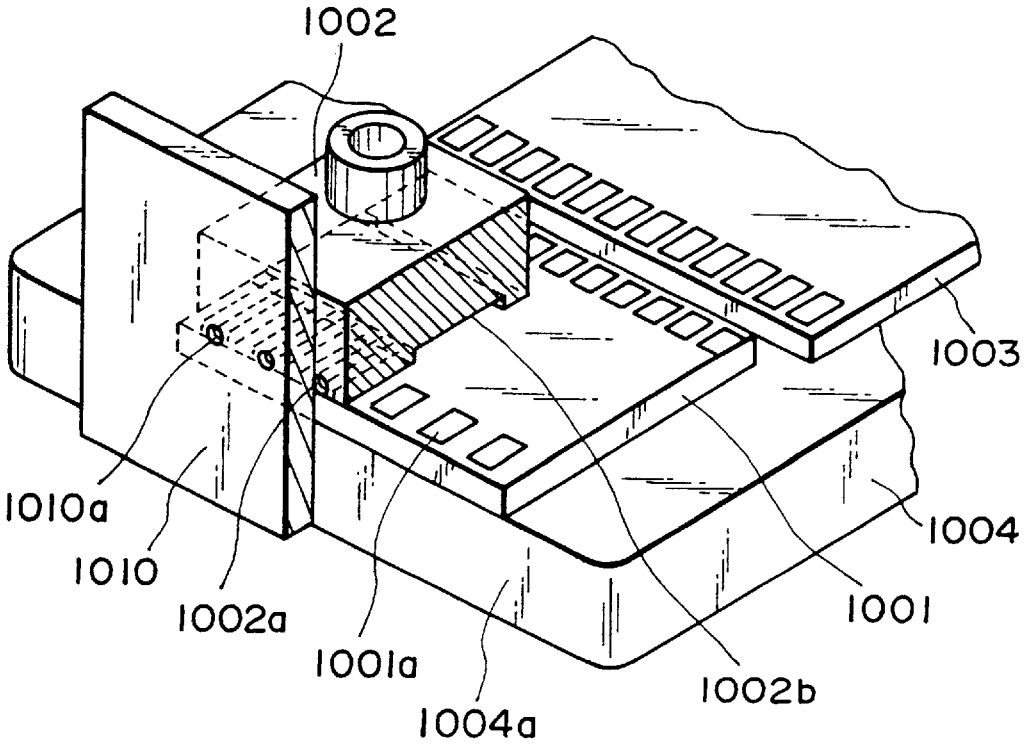
FIG. 73 PRIOR ART
FIG. 73 illustrates a general structure of an ink jet printing head.
Figure 74:
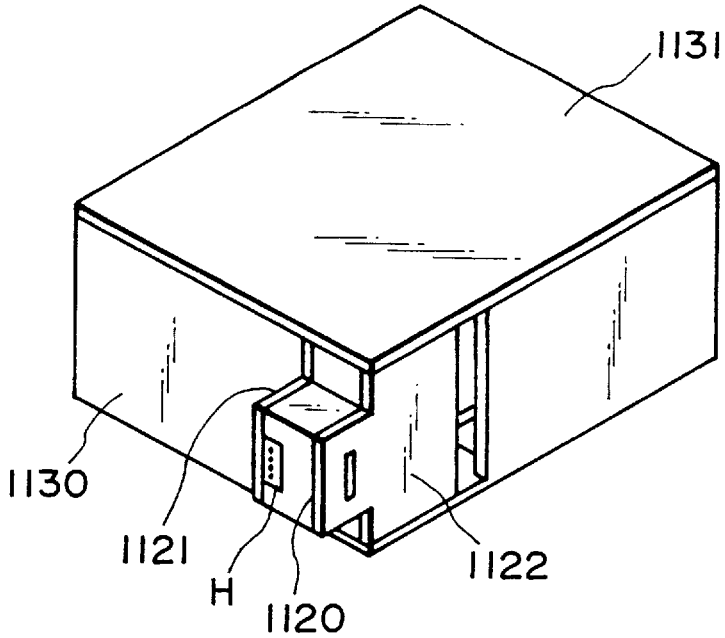
FIG. 74 PRIOR ART
FIG. 74 is a perspective view of a conventional liquid ejecting head unit.
Figure 75:
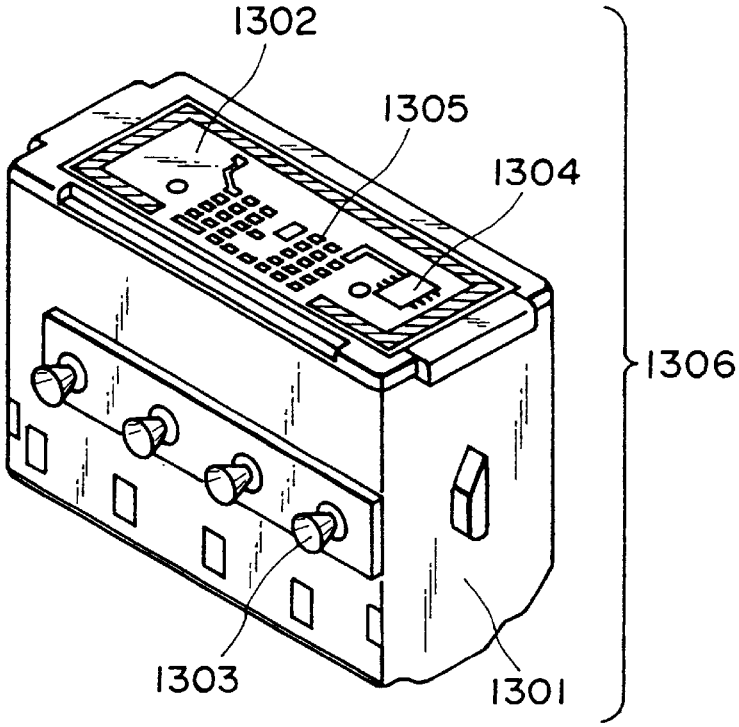
FIG. 75 PRIOR ART
FIG. 75 is a perspective view of an ink jet recording head assembly disclosed in Japanese Laid-open Patent Application Hei 9-289971.
Figure 76:
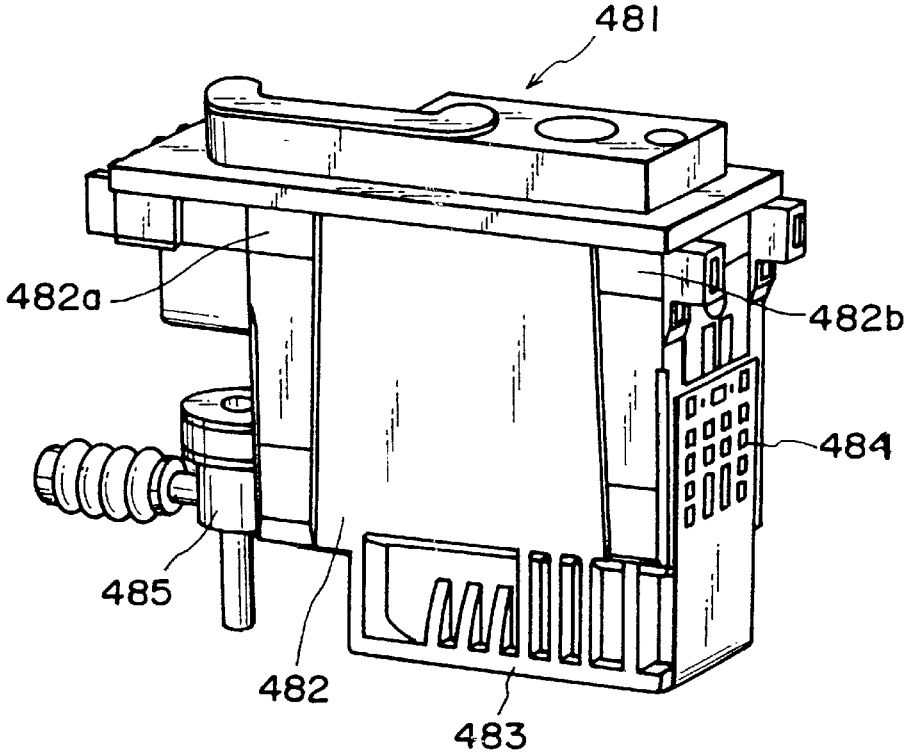
FIG. 76 PRIOR ART
FIG. 76 illustrates a conventional example of a type in which the liquid ejecting units are juxtaposed and fixed on the carriage.

The liquid ejecting head unit may have the structure shown in FIG. 71 as well as the structure shown in FIGS. 48 and 49. In FIG. 72, the same reference numerals as in FIG. 48 and 49 are assigned to the elements having the corresponding functions.

In FIG. 72, designated by reference numeral 404*d* is an urging portion provided on the side surface of the unit frame 404, and is disposed opposed to the trapezoidal projection 411. The urging portion 404*d* is disposed at a level lower than the side surface of the unit frame 404 by one step.

When the liquid ejecting head unit is mounted to the carriage described above, the trapezoidal projection 411 and the carriage head cam 241 are contacted at the outer surfaces thereof by the carriage head spring 242 urging the urging portion 404*d*. The carriage head spring 242 may be accommodated in a space formed by the step of the urging portion 404*d*, and therefore, the clearance in the arrangement of the cartridges are not required to be expanded by the space required by the carriage head spring 242. Normally, there is a head chip at the central portion of the cartridge, a spot facing cannot be formed.

With the structure shown in FIG. 72, the contact pad 421 is disposed on the side surface of the unit frame 404. CR the contact of the CR connector 216 has a proper repelling force in the direction of the contact pad 421. The repelling force of the contact of the CR connector 216 functions also to retain the cartridge. The urging force applied to the side surface of the unit frame 404 for fixing the liquid ejecting head unit may be small, and therefore, when the number of the contact pads is small, for example, the contact pads 421 may be disposed on the side surface of the unit frame 404, and the repelling force of the contact of the CR connector 216 may be used for the fixed.

In the head of this embodiment is used for a printing apparatus printable on an envelope or continuous paper which can be cut at a desired position, but the present invention is not limited to such an example, and the present invention is applicable to a normal printer using plain paper.

In this specification, "print" or "recording" includes formation, on a recording material, of significant or non-significant information such as an images a pattern, character, Figure and the like, and processing of a material on the basis of such information, visualized or non-visualized manner.

Here, the "recording material" includes paper used in a normal printer, textile, plastic resin material, film material, metal plate, glass, ceramic, wood, leather and the like which can receive ink.

Here, "ink or liquid" includes liquid usable with the "print" or "recording" defined above, and liquid usable to process the ink (coagulation of the coloring material contained in the ink or making it insoluble, for example).

The present invention is effectively usable with an electrothermal transducer which generates thermal energy to create a bubble through film boiling in the liquid.

According to the present invention, the relative position between the liquid ejecting head unit and the carriage can be adjusted after the liquid ejecting head unit is barred on the carriage, and therefore, the inclination of the ejection outlets can be adjusted at high precision.

In addition, the accuracy of the constituent element and the assembling in the liquid ejecting head unit may be moderate, and even if the carriage and/or the liquid ejecting head unit are assembled with a relatively low precision, the relative inclination of the liquid ejecting head in the direction of the ejection outlet array can be reduced by the adjustment of the angular position of the liquid ejecting head unit. Therefore, inexpensive parts are usable, thus accomplishing remarkable reduction of the manufacturing cost. Furthermore, the elimination of the necessary of the high assembling accuracy, the productivity is improved.

Even when the positional accuracy varies due of the mounting-and-demounting and/or the exchange or the like of the liquid ejecting head unit, the angular position can be readjusted easily, so that positional accuracy of the ejection outlets can be always maintained at the high level.

Furthermore, the adjustment can be incremental or stepwise, and therefore, the adjusting operation is easy.

In addition, since the pitch of the arrangement of the liquid ejecting head unit can be reduced, and therefore, the carriage can be downsized. Since the weight of the carriage can be reduced, the speed of the carriage can be increased.

When the urging member is disposed opposed to the cam member, the projection of the liquid ejecting head unit and the outer surface of the cam can be assuredly contacted. In this case, even if the cam rotates, the contact therebetween is assured.

Where the positioning is effected by the spherical surface and the surface of the circular column, the connection of the carriage to the predetermined station can be uniform.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection head unit for being rotatably and removably carried on a carriage, said head unit comprising:

a liquid ejection head for ejecting liquid droplets through a plurality of ejection outlets formed in an ejection side surface thereof to effect printing on a printing medium;

a casing for casing said liquid ejection head;

a guiding shaft member provided on a bottom surface of said casing at a predetermined position; and a projection having a curved surface provided on a side of said casing extending along an extension of an axis of said guiding shaft member, wherein said guiding shaft member and said projection are engageable with predetermined portions of said carriage and provide a substantial center of rotation for such rotation of said ejection head that said ejection side surface of said ejection head moves in directions along said ejection side surface.

2. A liquid ejection head unit according to claim 1, wherein said guiding shaft member has a tapered portion providing an outer diameter of said guiding shaft member which decreases toward a free end of said guiding shaft member.

3. A liquid ejection head unit according to claim 1, wherein said casing is provided on a side thereof with a contact pad electrically contactable to electric contacts provided in the carriage.

4. A liquid ejection head unit for being rotatably and removably carried on a carriage, said head unit comprising:

a liquid ejection head for ejecting liquid droplets through a plurality of ejection outlets formed in an ejection side surface thereof to effect printing on a printing medium;

a casing for casing said liquid ejection head;

a guiding shaft member provided on a bottom surface of said casing at a predetermined position;

a projection having a curved surface provided on a side of said casing extending along an extension of an axis of said guiding shaft member; and a positioning portion, provided on a side of said casing, for positioning said ejection head unit in a direction of a rotation thereof;

said carriage including:

a supporting mechanism for rotatably supporting said liquid ejection head unit, said supporting mechanism for being engageable with said guiding shaft member and said projection of said liquid ejection head unit to provide a substantial center of rotation of said liquid ejection head unit;

a cam member having an outer peripheral cam surface rotatably contactable with said positioning portion of said liquid ejection head unit; and an angle adjusting mechanism for adjusting an angle of rotation of said cam member including a drum member rotatable in interrelation with said cam member and having a plurality of grooves on an outer peripheral surface of said drum member, and a locking member, slidable on said outer peripheral surface of said drum member, for locking said drum member by engagement with said grooves so as to prevent rotation of said drum member, wherein said angle adjusting mechanism rotates said cam member contacted to said positioning portion by said drum member to move said liquid ejection head unit carried on said carriage along said ejection side surface.

5. A liquid ejection head unit according to claim 4, wherein said cam has a free curved surface, and said grooves are formed at regular intervals.

6. A liquid ejection head unit according to claim 4, wherein said cam has an eccentric right circular cam surface, wherein said grooves are formed at such irregular intervals that rotational angles of said liquid ejection head unit rotated by said eccentric cam surface are at regular intervals.

7. A liquid ejection head unit according to claim 4, wherein a rotational angle of said liquid ejection head unit of one interval of said grooves is not more than 0.02°.

8. A liquid ejection head unit according to claim 4, wherein said carriage further comprises an urging member, disposed opposed to said cam member, for contacting said cam to said positioning portion.

9. A liquid ejection head unit according to claim 4, wherein said carriage further comprises an electric contact for being supplied with a signal for actuating said liquid ejection head unit, and said liquid ejection head unit further comprises a contact pad electrically connectable with said electric contact on a side which is adjacent a rotational axis which extends connecting said guiding shaft member and said projection and which extends along the rotational axis.

10. A liquid ejection head unit according to claim 4, wherein said supporting mechanism comprises a first receiving portion having an inner surface for receiving an outer peripheral surface of said guiding shaft member of said liquid ejection head unit, and a second receiving portion having an inner surface for receiving a curved surface of said projection of said liquid ejection head unit.

11. A liquid ejection head unit according to claim 10, wherein said guiding shaft member has a tapered portion providing an outer diameter of said guiding shaft member which decreases toward a free end of said guiding shaft member, and said first receiving portion of said carriage has an inner surface having a configuration corresponding to said tapered portion.

12. A liquid ejection head unit according to claim 10, wherein said first receiving portion has a U-shaped or V-shaped surface having an inner surface portion for receiving said outer peripheral surface of said guiding shaft member.

13. A liquid ejection head unit according to claim 10, wherein said second receiving portion has a U-shaped or V-shaped surface having an inner surface portion for receiving said projection.

* * * * *